US006799828B2

(12) United States Patent
Silverbrook

(10) Patent No.: US 6,799,828 B2
(45) Date of Patent: Oct. 5, 2004

(54) INERT GAS SUPPLY ARRANGEMENT FOR A PRINTER

(75) Inventor: Kia Silverbrook, Balmain (AU)

(73) Assignee: Silverbrook Research Pty Ltd, Balmain (AU)

( * ) Notice: Subject to any disclaimer, the term of this patent is extended or adjusted under 35 U.S.C. 154(b) by 60 days.

(21) Appl. No.: 10/171,986

(22) Filed: Jun. 17, 2002

(65) Prior Publication Data

US 2002/0157252 A1 Oct. 31, 2002

Related U.S. Application Data

(63) Continuation-in-part of application No. 09/575,125, filed on May 23, 2000, now Pat. No. 6,526,658.

(51) Int. Cl.[7] ..... B41J 2/165
(52) U.S. Cl. ..... 347/25
(58) Field of Search ..... 347/22, 25, 39–47

(56) References Cited

U.S. PATENT DOCUMENTS 5,136,310 A * 8/1992 Drews ..... 347/45
5,665,249 A * 9/1997 Burke et al. ..... 216/2
6,168,774 B1 * 1/2001 Van den Sype ..... 423/351
6,382,763 B1 * 5/2002 Albuquerque et al. ..... 347/21

* cited by examiner

*Primary Examiner*—Shih-wen Hsieh

(57) ABSTRACT

A printing assembly has a printing unit. An inert gas supply is connected to the printing unit to provide components of the printing unit with inert gas.

8 Claims, 49 Drawing Sheets

172
172
110
110
110

INERT GAS SUPPLY ARRANGEMENT FOR A PRINTER

REFERENCES TO RELATED APPLICATIONS

This application is a continuation-in-part application of U.S. application Ser. No. 09/575,125 filed May 23, 2000 now U.S. Pat. No. 6,526,658. Various methods, systems and apparatus relating to the present invention are disclosed in the following co-pending applications filed by the applicant or assignee of the present invention simultaneously with the present application: U.S. Ser. Nos. 09/575,197, 09/575,195, 09/575,159, 09/575,132, 09/575,123, 09/575,148, 09/575,130, 09/575,165, 09/575,153, 09/575,118, 09/575,131, 09/575,116, 09/575,144, 09/575,139, 09/575,186, 09/575,185, 09/575,191, 09/575,145, 09/575,192, 09/575,181, 09/575,193, 09/575,156, 09/575,183, 09/575,160, 09/575,150, 09/575,169, 09/575,184, 09/575,128, 09/575,180, 09/575,149, 09/575,179, 09/575,133, 09/575,143, 09/575,187, 09/575,155, 09/575,196, 09/575,198, 09/575,178, 09/575,164, 09/575,146, 09/575,174, 09/575,163, 09/575,168, 09/575,154, 09/575,129, 09/575,124, 09/575,188, 09/575,189, 09/575,162, 09/575,172, 09/575,170, 09/575,171, 09/575,161, 09/575,141, 09/575,125, 09/575,142, 09/575,140, 09/575,190, 09/575,138, 09/575,126, 09/575,127, 09/575,158, 09/575,117, 09/575,147, 09/575,152, 09/575,176, 09/575,151, 09/575,177, 09/575,175, 09/575,115, 09/575,114, 09/575,113, 09/575,112, 09/575,111, 09/575,108, 09/575,109, 09/575,182, 09/575,173, 09/575,194, 09/575,136, 09/575,119, 09/575,135, 09/575,157, 09/575,166, 09/575,134, 09/575,121, 09/575,137, 09/575,167, 09/575,120, 09/575,122, 09/609,140, 09/575,115, U.S. Pat. No. 6,281,912, U.S. Ser. No. 09/575,113, U.S. Pat. No. 6,318,920, U.S. Ser. Nos. 09/575,111, 09/693,644, 09/693,737, 09/693,340.

These applications are incorporated by reference.

FIELD OF THE INVENTION

This invention relates to an inert gas supply arrangement for a printer. In particular, this invention related to an inert gas supply arrangement for a printer that incorporates a number of ink jet printheads. The ink jet printheads each have at least one printhead chip.

BACKGROUND TO THE INVENTION

As set out in the material incorporated by reference, the Applicant has developed ink jet printheads that can span a print medium and incorporate up to 84 000 nozzle assemblies. Furthermore, the printheads are able to generate text an images at speeds of from 20 ppm up to 160 ppm, depending on the application.

These printheads includes a number of printhead chips. The printhead chips include micro-electromechanical components, which physically act on ink to eject ink from the printhead chips. In order to achieve the necessary movement, the components incorporate thermal bend actuators. These use differential heat expansion to generate the necessary movement.

It is important to note that the components are microscopic. It follows that heat expansion is far more dramatic than at the macroscopic scale. The components are required to operate at very high speeds in order to achieve the print rate mentioned above. In commercial applications, these high speeds must be maintained for long periods of time. Applicant has found that the printhead chips operate most efficiently at a high heat. However, oscillatory movement at high speed and high heat for extended periods of time can create fatigue damage. This is particularly the case where the components include metal, as is the case with many of the printhead chips developed by the Applicant.

Applicant has found that oxidation tends to occur when the components are operated at temperature, which would otherwise be optimal. Accordingly, the Applicant has conceived the present invention to address the problem of oxidation at the high temperatures. As a result, the Applicant has developed a printer that has printheads that are capable of operating at optimal temperatures while avoiding oxidation.

The overall design of a printer in which this invention is applied is based on the use of replaceable printhead modules. The modules are in an array approximately 8 inches (20 cm) long. An advantage of such a system is the ability to easily remove and replace any defective modules in a printhead array. This eliminates having to scrap an entire printhead if only one chip is defective.

A printhead module in such a printer can be comprised of a "Memjet" chip, being a chip having a vast number of the nozzle assemblies mentioned above. The components, which act on the ink, are can be those as disclosed in U.S. Pat. No. 6,044,646, incorporated by reference. However, other chips may also be suitable.

The printhead might typically have six ink chambers and be capable of printing four-color process (CMYK) as well as infrared ink and fixative.

Each printhead module receives ink via a distribution molding that transfers the ink. Typically, ten modules butt together to form a complete eight-inch printhead assembly suitable for printing A4 paper without the need for scanning movement of the printhead across the paper width.

The printheads themselves are modular, so complete eight-inch printhead arrays can be configured to form printheads of arbitrary width.

Additionally, a second printhead assembly can be mounted on the opposite side of a paper feed path to enable double-sided high-speed printing.

SUMMARY OF THE INVENTION

According to the invention, there is provided a printing assembly that comprises a printing unit; and an inert gas supply that is connected to the printing unit to provide components of the printing unit with inert gas.

The printing unit may have at least one thermally actuated ink jet printhead. The ink jet printhead may incorporate micro-electromechanical components for the ejection of ink. The micro-electromechanical components may be thermally actuated.

The printing unit may include a printhead assembly that has at least one printhead chip and defines an inert gas inlet. The at least one printhead chip may comprise a plurality of nozzle assemblies positioned on a wafer substrate, each nozzle assembly having nozzle chamber walls and a roof wall that define a nozzle chamber and an ink ejection port in fluid communication with the nozzle chamber and a micro-electromechanical actuator that acts on ink within the nozzle chamber to eject ink from the nozzle chamber.

A conduit assembly may be arranged within the printing unit to provide an inert gas conduit from the inlet to the at least one printhead chip. The conduit assembly may be configured so that inert gas pumped into the conduit assembly provides an inert operating environment for the printhead assembly. An inert gas supply device may be connected to the printing unit at the inlet to supply the conduit assembly with inert gas.

The printing unit may include a number of printhead chips, and a number of corresponding nozzle guards that are positioned over respective printhead chips. Each nozzle guard may have a cover member and a support structure that supports the cover member over each printhead chip. The cover member may define a plurality of passages. Each passage may be aligned with a respective ink ejection port so that an ink droplet ejected from each ink ejection port can pass through the passage and onto a print medium. The support structure may define a plurality of openings so that inert gas can pass into a region between each printhead cover and its associated printhead chip and through the passages defined by the printhead cover.

The inert gas supply may be in the form of a nitrogen supply unit. The nitrogen supply unit may be a membrane nitrogen separation unit.

The printhead assembly may include an ink distribution structure that defines a plurality of printhead chip slots that are dimensioned so that each printhead chip can be positioned in a respective slot. The structure may also define a plurality of ink distribution pathways in fluid communication with each slot to supply the printhead chips with ink. The structure may further define an inert gas pathway from the inlet defined by the printhead assembly and said region between each printhead chip and its associated cover member so that the inert gas can be pumped from the inlet, through the ink distribution structure and out through the passages defined by the cover members.

BRIEF DESCRIPTION OF THE DRAWINGS

The invention is now described, by way of example, with reference to the accompanying diagrammatic drawings in which.

DETAILED DESCRIPTION OF THE DRAWINGS

Figure 1:
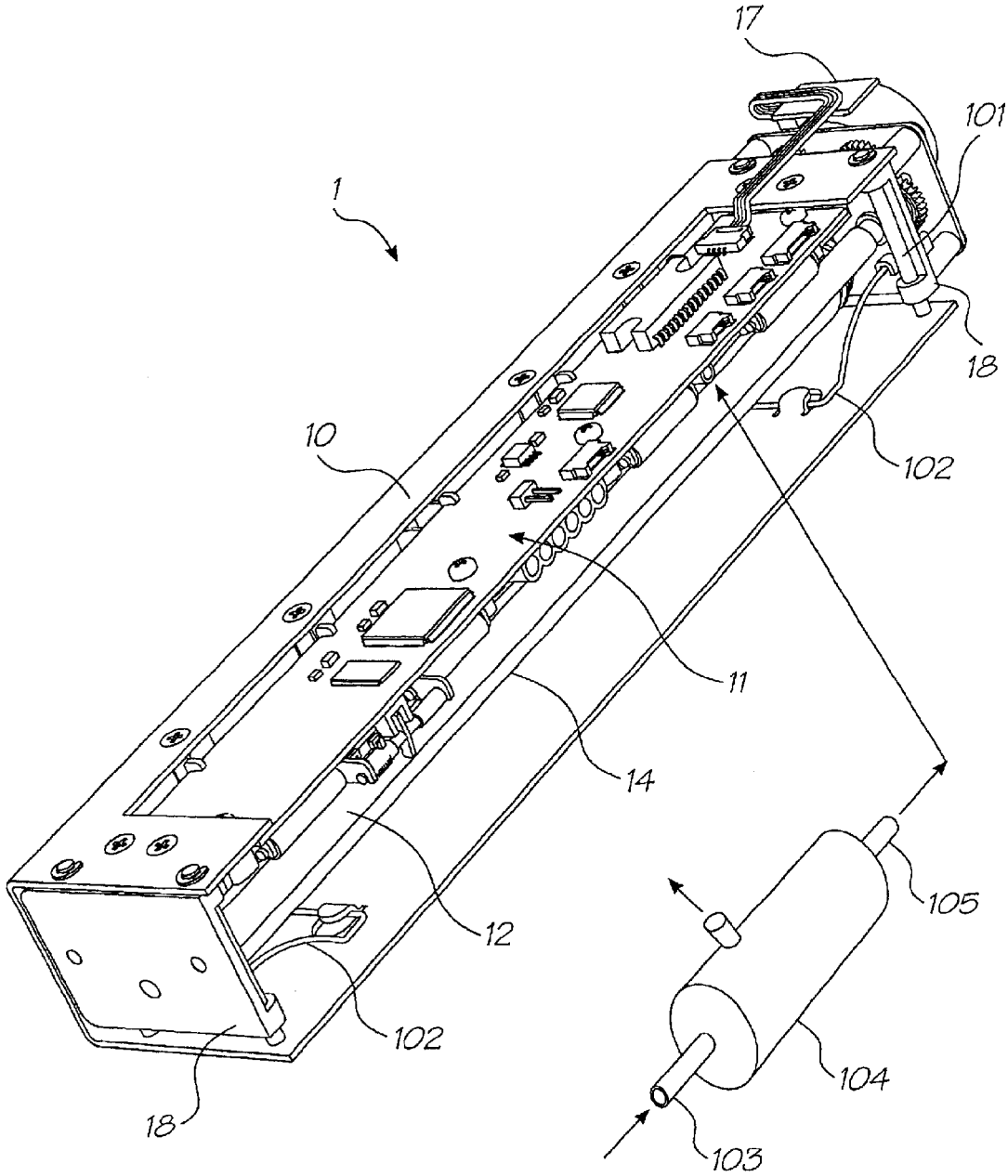
FIG. 1 is a front perspective view of a printing assembly, in accordance with the invention.
Figure 2:
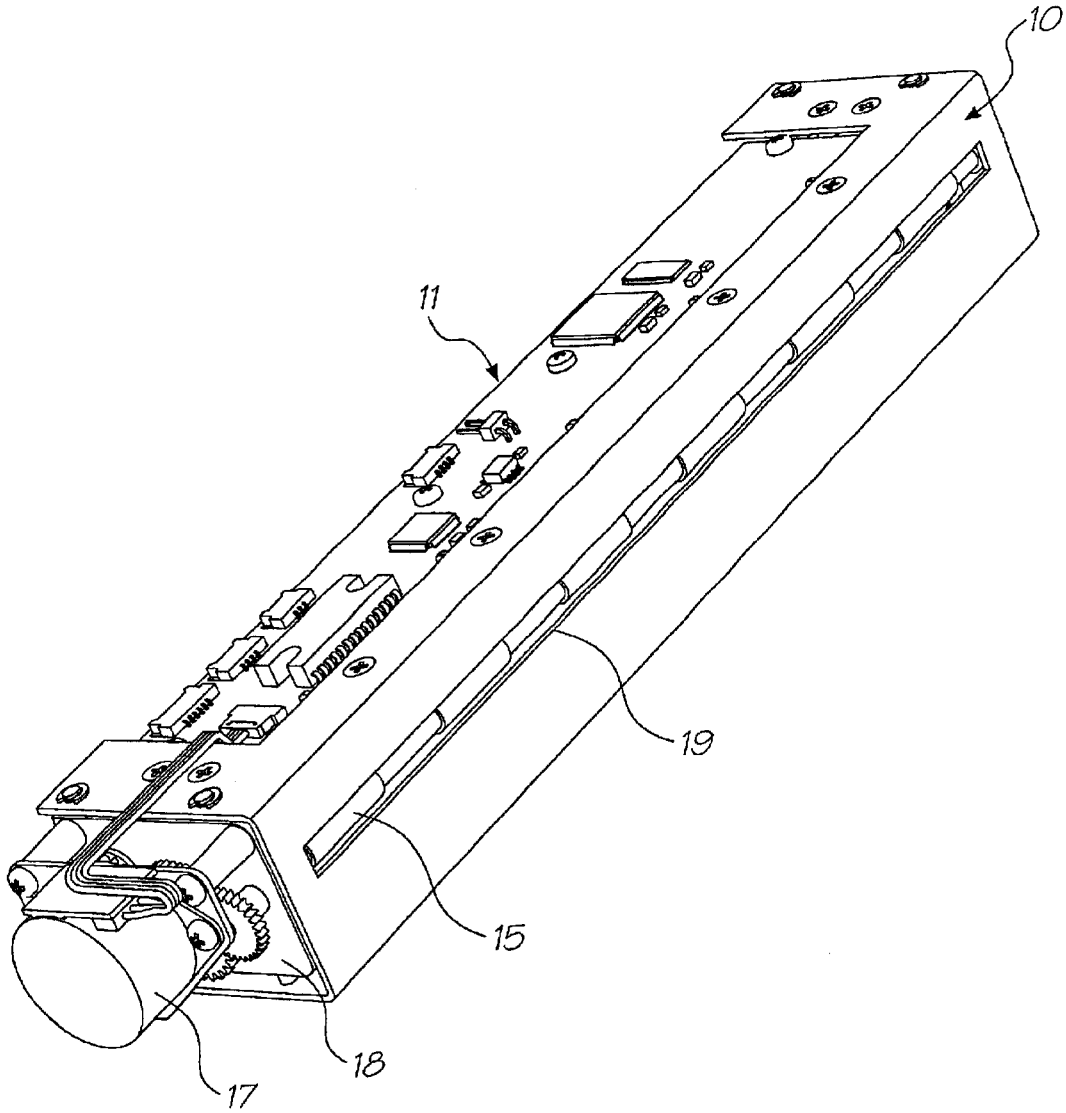
FIG. 2 is a rear perspective view of the printing assembly.
Figure 3:
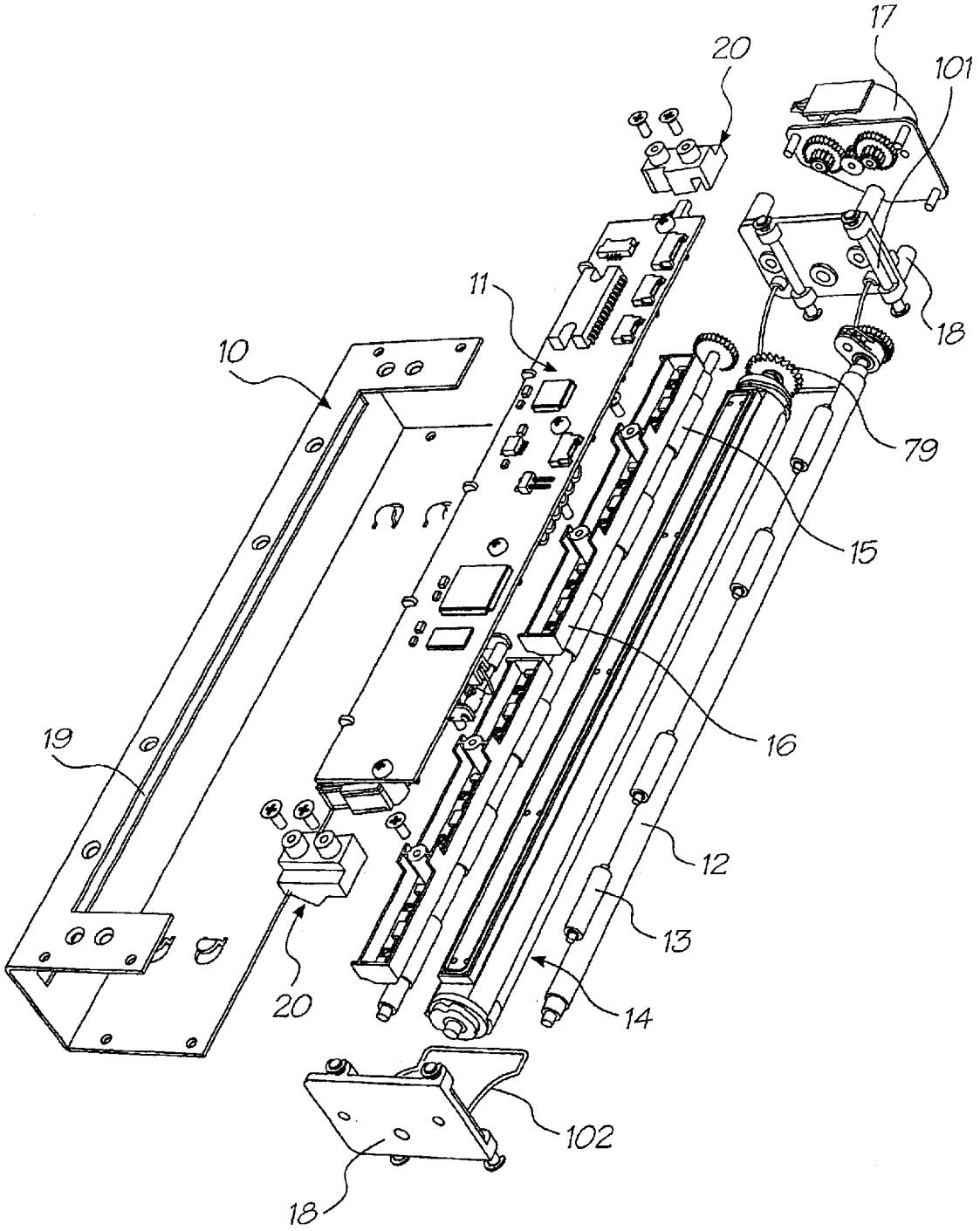
FIG. 3 is an exploded view of the printing assembly.

In FIGS. 1 to 3 of the accompanying drawings, reference numeral 1 generally indicates a printing assembly, in accordance with the invention.

The printing assembly 1 includes a printhead assembly 11 mounted on a chassis 10. The print engine assembly 11 includes a chassis 10 fabricated from pressed steel, aluminum, plastics or other rigid material.

The chassis 10 is mounted within the body of a printer (not shown). The printhead assembly 11, a paper feed mechanism and other related components within the external plastics casing of a printer are mounted on the chassis 10

In general terms, the chassis 10 supports the printhead assembly 11 such that ink is ejected therefrom and onto a sheet of paper or other print medium being transported past the printhead assembly 11 and through an exit slot 19 by the feed mechanism. The paper feed mechanism includes a feed roller 12, feed idler rollers 13, a platen generally designated as 14, exit rollers 15 and a pin wheel assembly 16, all driven by a stepper motor 17. These paper feed components arc mounted between a pair of bearing moldings 18, which are in turn mounted to the chassis 10 at respective ends.

The printhead assembly 11 is mounted to the chassis 10 with spacers 20 mounted to the chassis 10. The spacers 20 provide the printhead assembly 11 with a length to 220 mm allowing clearance on either side of 210 mm wide paper.

Figure 4:
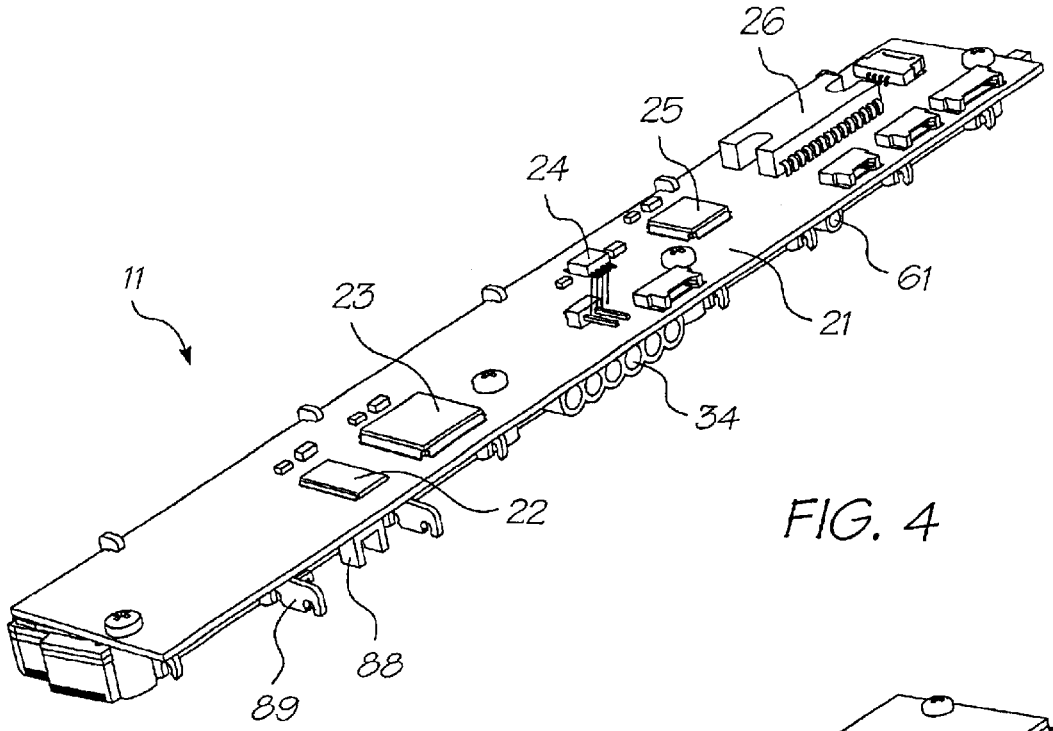
FIG. 4 is a front perspective view of a printhead assembly of an ink jet printing unit of the assembly.
Figure 5:
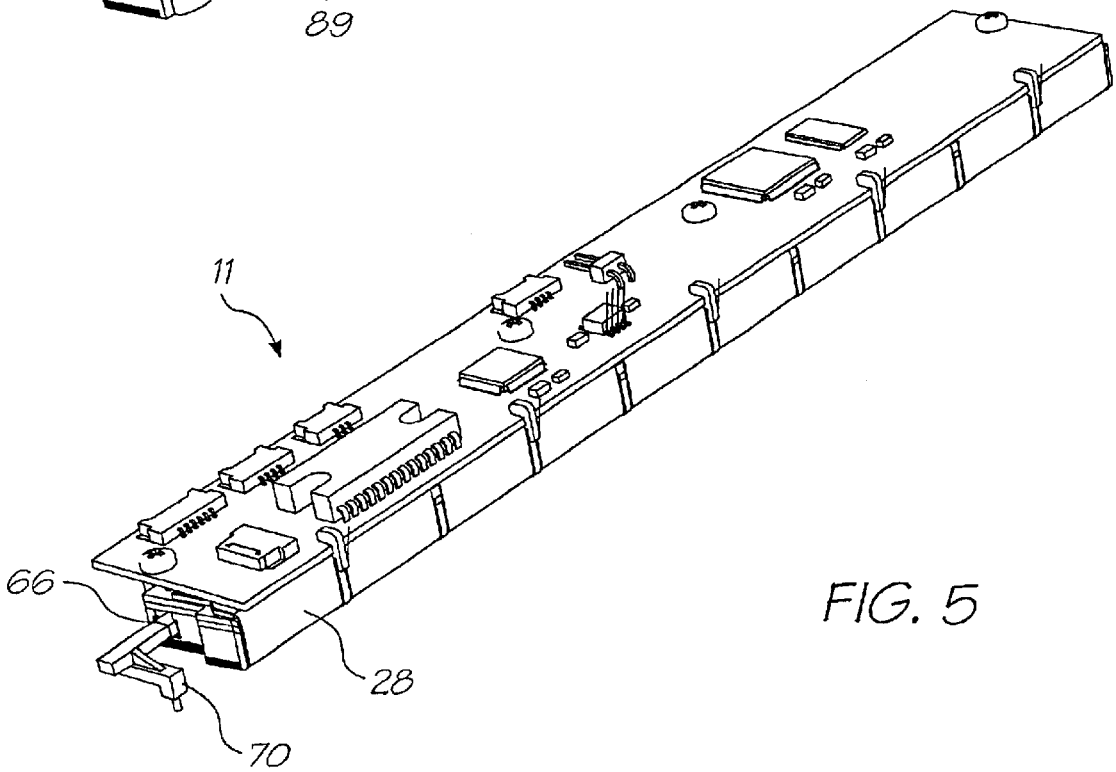
FIG. 5 is a rear perspective view of the printhead assembly.

As can be seen in FIGS. 4 and 5, the printhead assembly 11 includes a printed circuit board (PCB) 21. Electronic components including a 64 MB DRAM 22, a PEC chip 23, a QA chip connector 24, a micro controller 25, and a dual motor driver chip 26 are mounted on the PCB 21.

The printhead assembly 11 is typically 203 mm long and has ten print chips 27 (FIG. 13), each typically 21 mm long. These print chips 27 are each disposed at a slight angle to a longitudinal axis of the printhead (see FIG. 12), with a slight overlap between each print chip, which enables continuous transmission of ink over the entire length of the array.

Each print chip 27 is electronically connected to an end of one of a tape automated bond (TAB) films 28, the other end of which is maintained in electrical contact with the under surface of the printed circuit board 21 by means of a TAB film backing pad 29.

One print chip construction is as described in U.S. Pat. No. 6,044,646, incorporated by reference. Each such print chip 27 is approximately 21 mm long, less than 1 mm wide and about 0.3 mm high, and has on its lower surface thousands of inkjet nozzle assemblies 30, shown schematically in FIGS. 9A and 9B, arranged generally in six lines—one for each ink type to be applied. Each line of nozzles may follow a staggered pattern to allow closer dot spacing. Six corresponding lines of ink passages 31 extend through from the rear of the print chip to transport ink to the rear of each nozzle. To protect the delicate nozzles on the surface of the print chip each print chip has a nozzle guard 43, best seen in FIG. 9A. The nozzle guard 43 defines micro apertures 44 aligned with the nozzles 30, so that the ink drops ejected at high speed from the nozzle assemblies pass through the micro apertures 44 to be deposited on a print medium passing over the platen 14.

Figure 11:
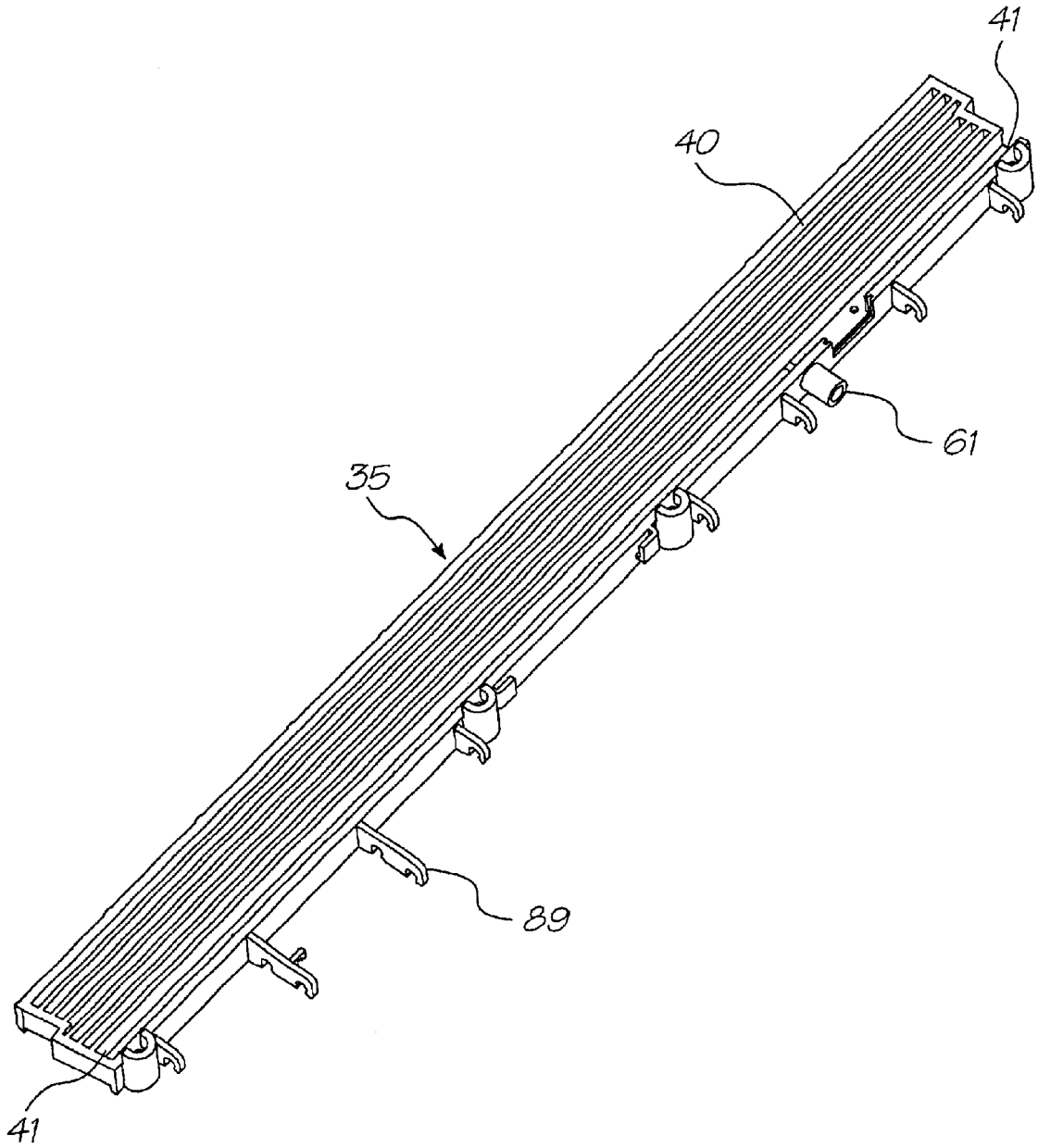
FIG. 11 is a perspective view of an ink distribution molding of an ink distribution structure of the printhead assembly.

Ink is delivered to the print chips 27 via a distribution molding 35 (FIG. 11) and laminated stack 36 forming part of the printhead assembly 11. Ink from an ink cassette 37 (FIGS. 26 and 27) is relayed via ink hoses 38 to respective ink inlet ports 34 defined by a molded plastics duct cover 39 which forms a lid over the plastics distribution molding 35. The distribution molding 35 includes six discrete longitudinal ink ducts 40 and a nitrogen duct 41 which extend along a length of the molding 35.

Figure 7:
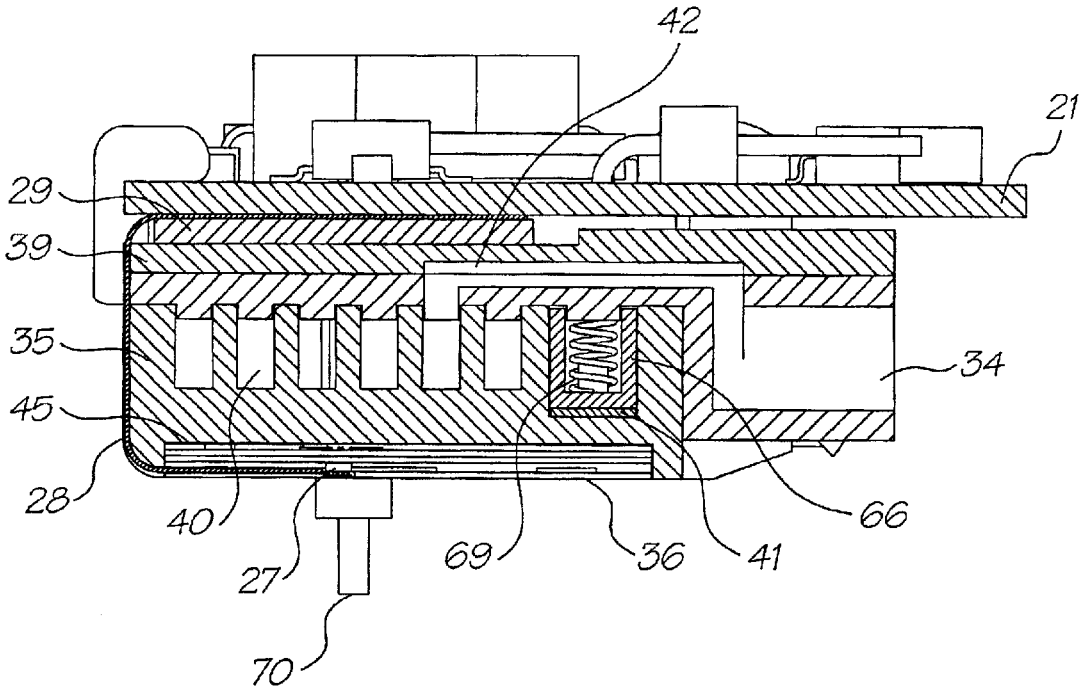
FIG. 7 is a sectional end elevation of the printhead assembly taken centrally through the printhead assembly.

Ink is transferred from the inlet ports 34 to respective ink ducts 40 via individual cross-flow ink channels 42 (FIG. 7). It should be noted that a different number of ducts might be provided. Six ducts are suitable for a printer capable of printing cyan, magenta, yellow, black (CMYK) and infrared inks and a fixative.

Nitrogen is delivered to the nitrogen duct 41 via a nitrogen inlet port 61, to supply nitrogen to each print chip 27, as described later with reference to FIGS. 6 to 8, 20 and 21.

Situated within a longitudinally extending stack recess 45 formed in the underside of distribution molding 35 are a number of laminated layers forming a laminated ink distribution stack 36. The layers of the laminate are typically formed of micro-molded plastics material. The TAB film 28 extends from the under surface of the printhead PCB 21, around the rear of the distribution molding 35 to be received within a respective TAB film recess 46 (FIG. 9*b*), a number of which are situated along a chip-housing layer 47 of the laminated stack 36. The TAB film 28 relays electrical signals from the printed circuit board 21 to individual print chips 27 positioned in the laminated stack 36.

The distribution molding 35, the laminated stack 36 and associated components are best described with reference to FIGS. 7 to 19.

Figure 10:
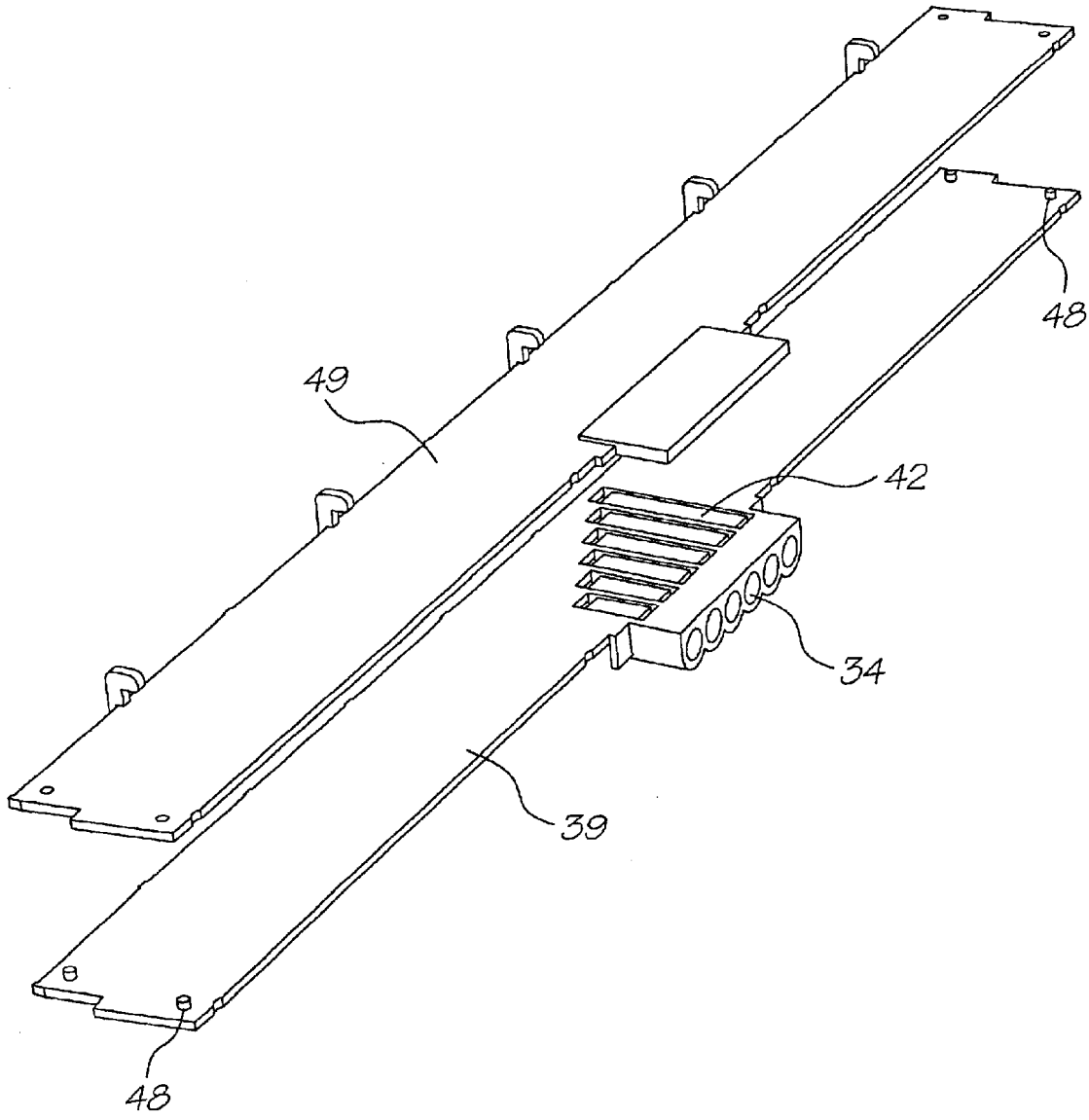
FIG. 10 is an exploded view of a cover assembly of the printhead assembly.

FIG. 10 depicts the distribution molding cover 39 formed as a plastics molding and including a number of positioning spigots 48, which serve to locate an upper cover 49.

Figure 8:
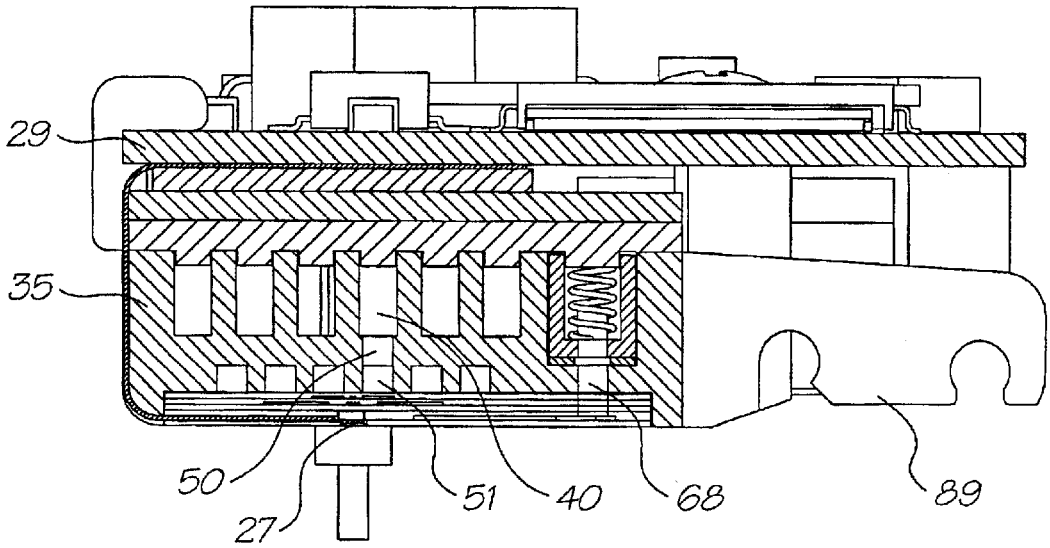
FIG. 8 is a sectional end elevation of the printhead assembly taken near a left end of the printhead assembly as shown in FIG. 4.

As shown in FIG. 8, an ink transfer port 50 connects one of the ink ducts 40 (the fourth duct from the left, as shown in FIG. 8) down to one of six lower ink ducts or transitional ducts 51 in the underside of the distribution molding 35. All of the ink ducts 40 have corresponding transfer ports 50 communicating with respective ports of the transitional ducts 51. The transitional ducts 51 are parallel with each other but angled acutely with respect to the ink ducts 40 so as to line up with rows of ink holes of a first layer 52 of the laminated stack 36 to be described below.

Figure 12:
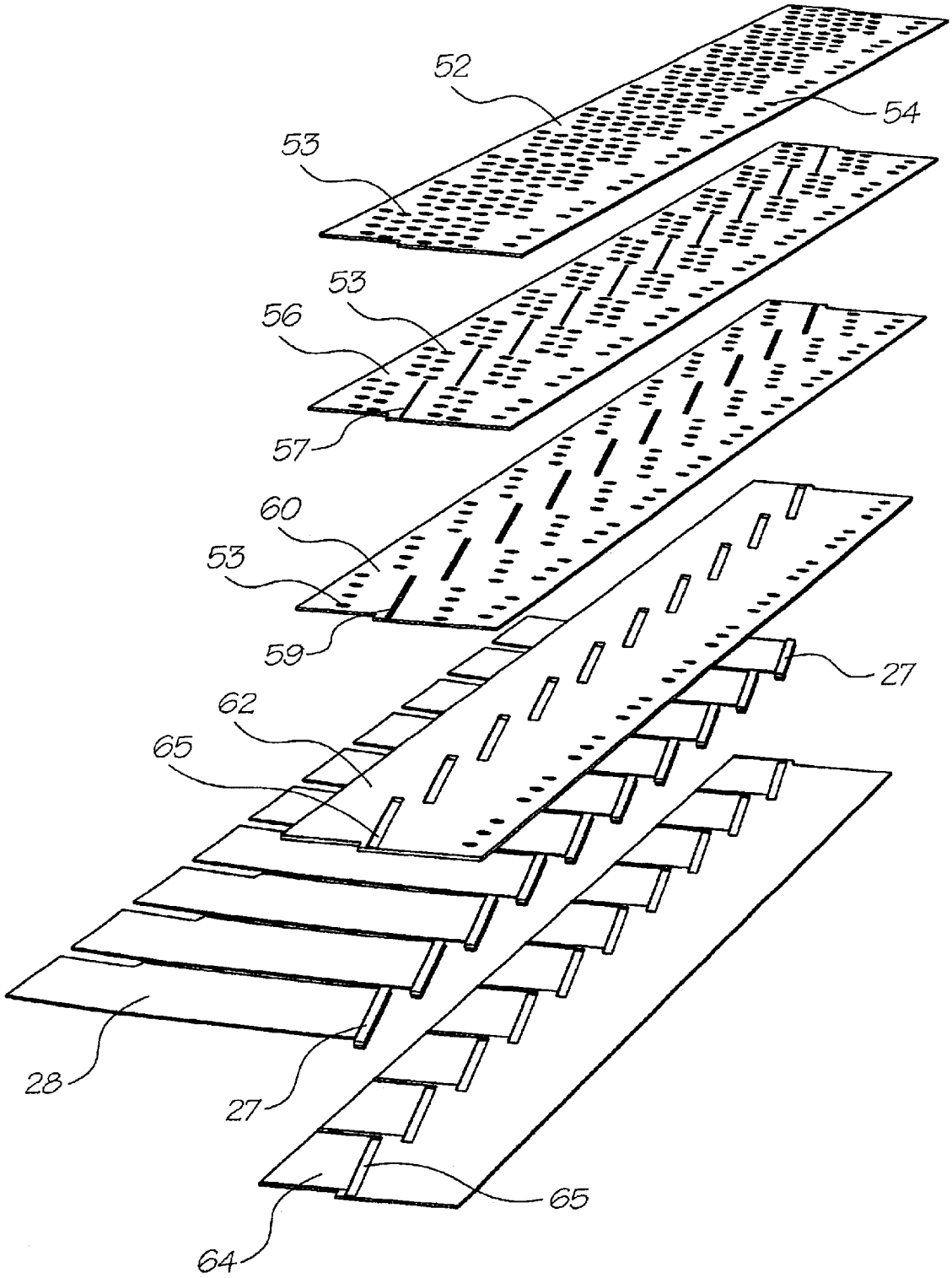
FIG. 12 is an exploded view of layers of the ink distribution structure.

The first layer 52 incorporates twenty-four individual ink holes 53 for each of ten print chips 27 (FIG. 12). That is, where ten such print chips are provided, the first layer 52 includes two hundred and forty ink holes 53. The first layer 52 also includes a row of nitrogen holes 54 alongside one longitudinal edge thereof.

The individual groups of twenty-four ink holes 53 are formed generally in a rectangular array with aligned rows of ink holes 53. Each row of four ink holes 53 is aligned with a transitional duct 51 and is parallel to a respective print chip 27.

Figure 13:
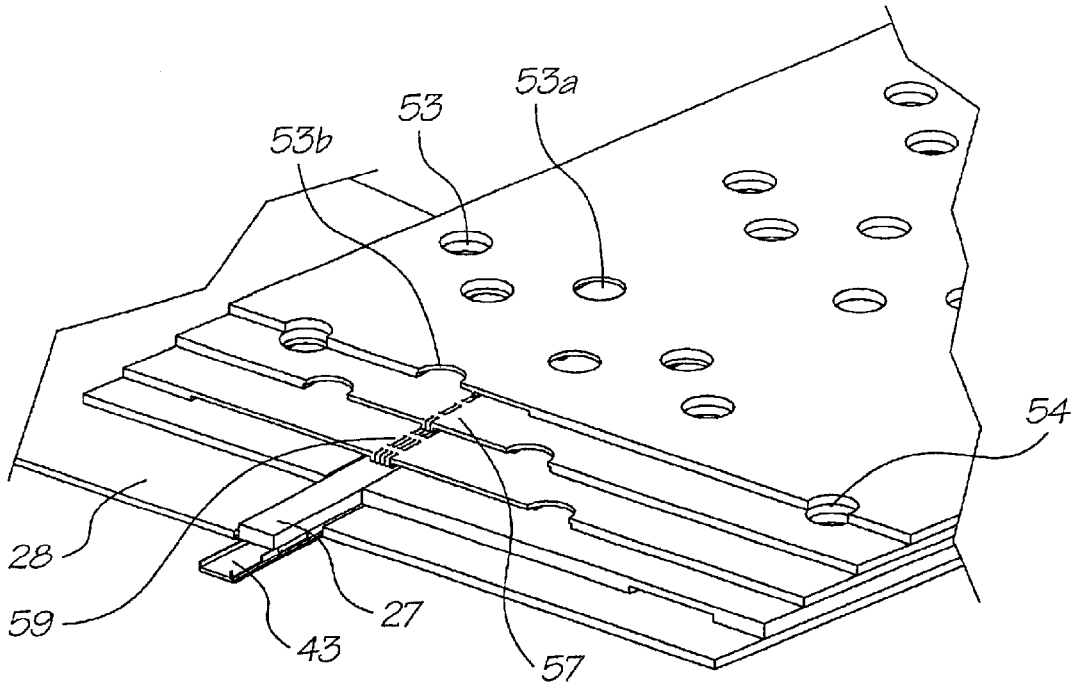
FIG. 13 is a stepped three-dimensional view from one side of the ink distribution structure showing the layers and a printhead chip.
Figure 14:
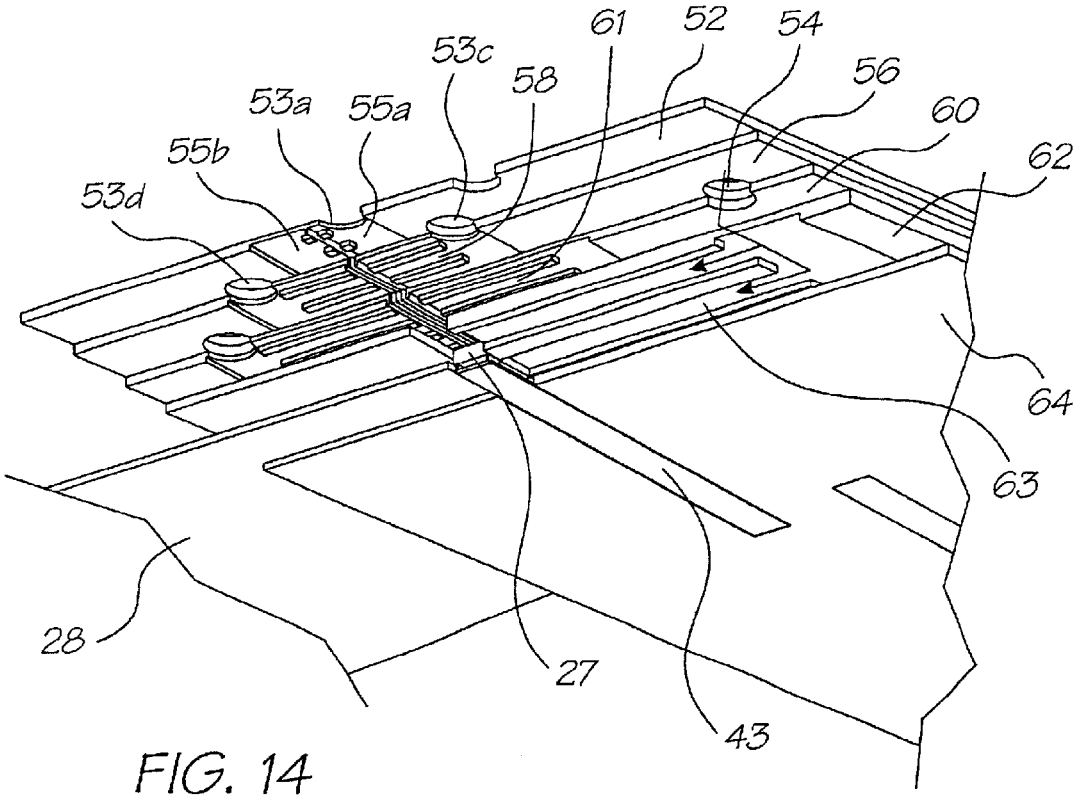
FIG. 14 is a stepped three-dimensional view from an opposite side of the ink distribution structure showing the layers and a printhead chip.
Figure 15:
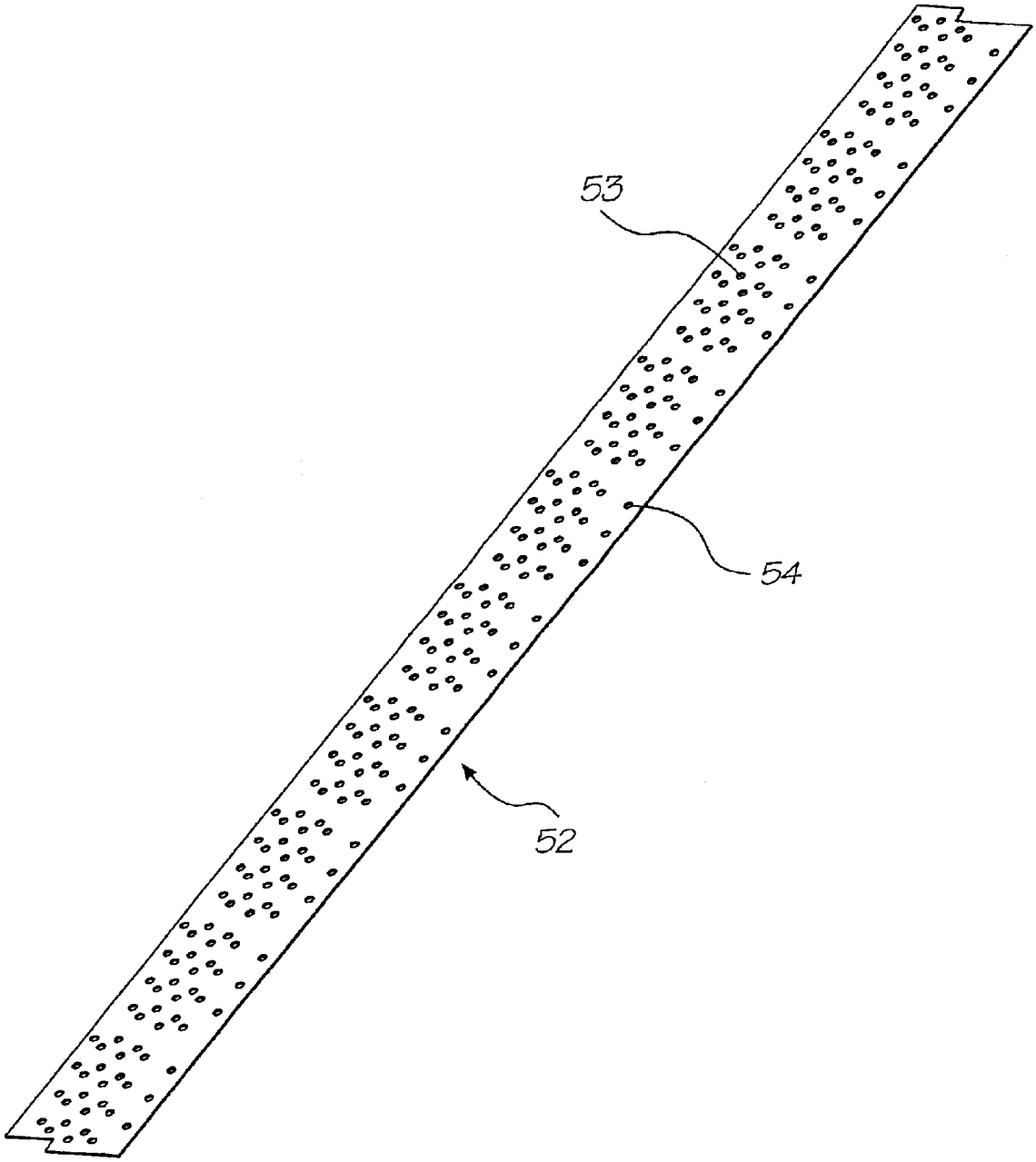
FIG. 15 is a perspective view of a first layer of the ink distribution structure, starting from the ink distribution molding of FIG. 11.
Figure 16:
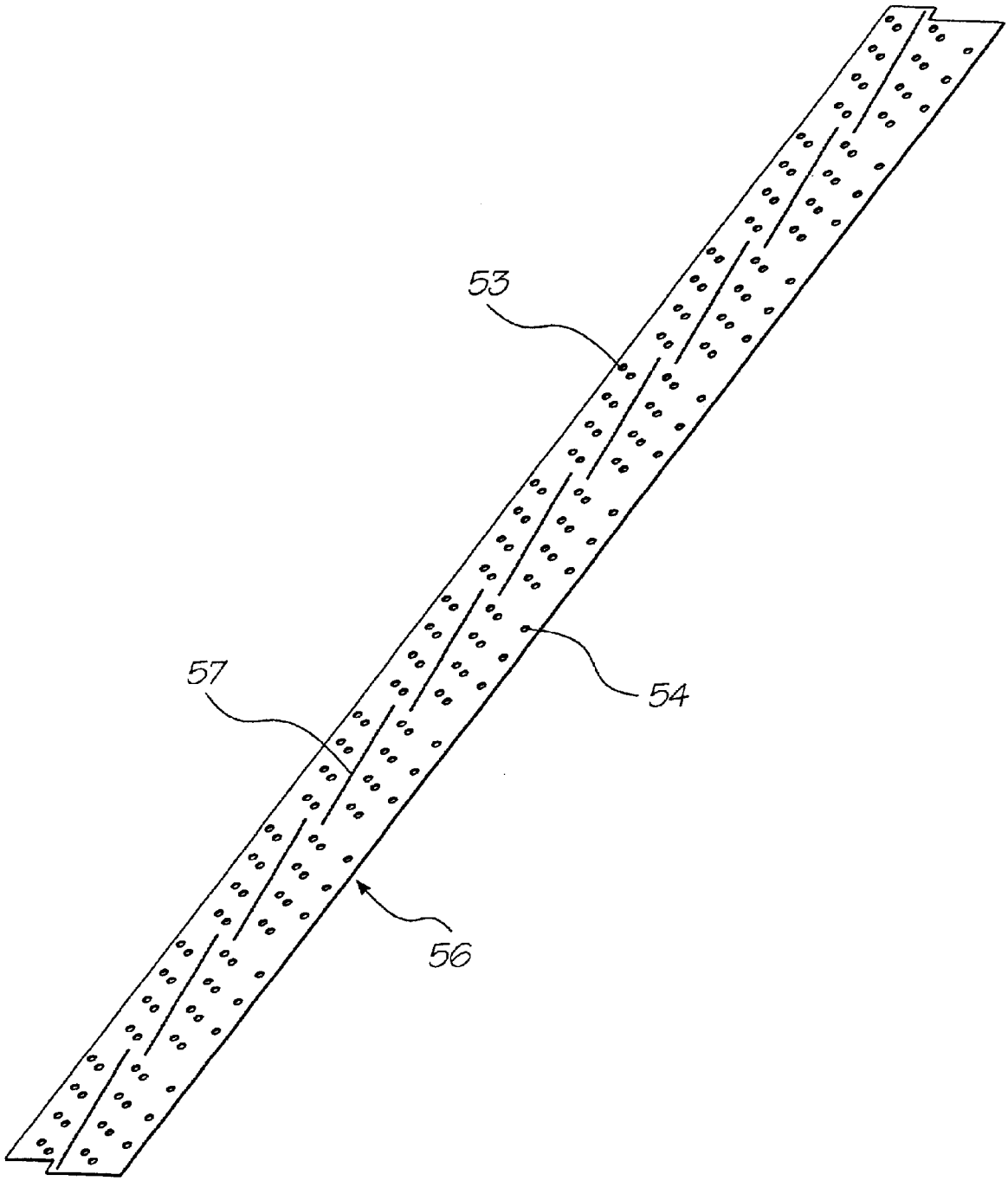
FIG. 16 is a perspective view of a second layer of the ink distribution structure, starting from the ink distribution molding of FIG. 11.
Figure 17:
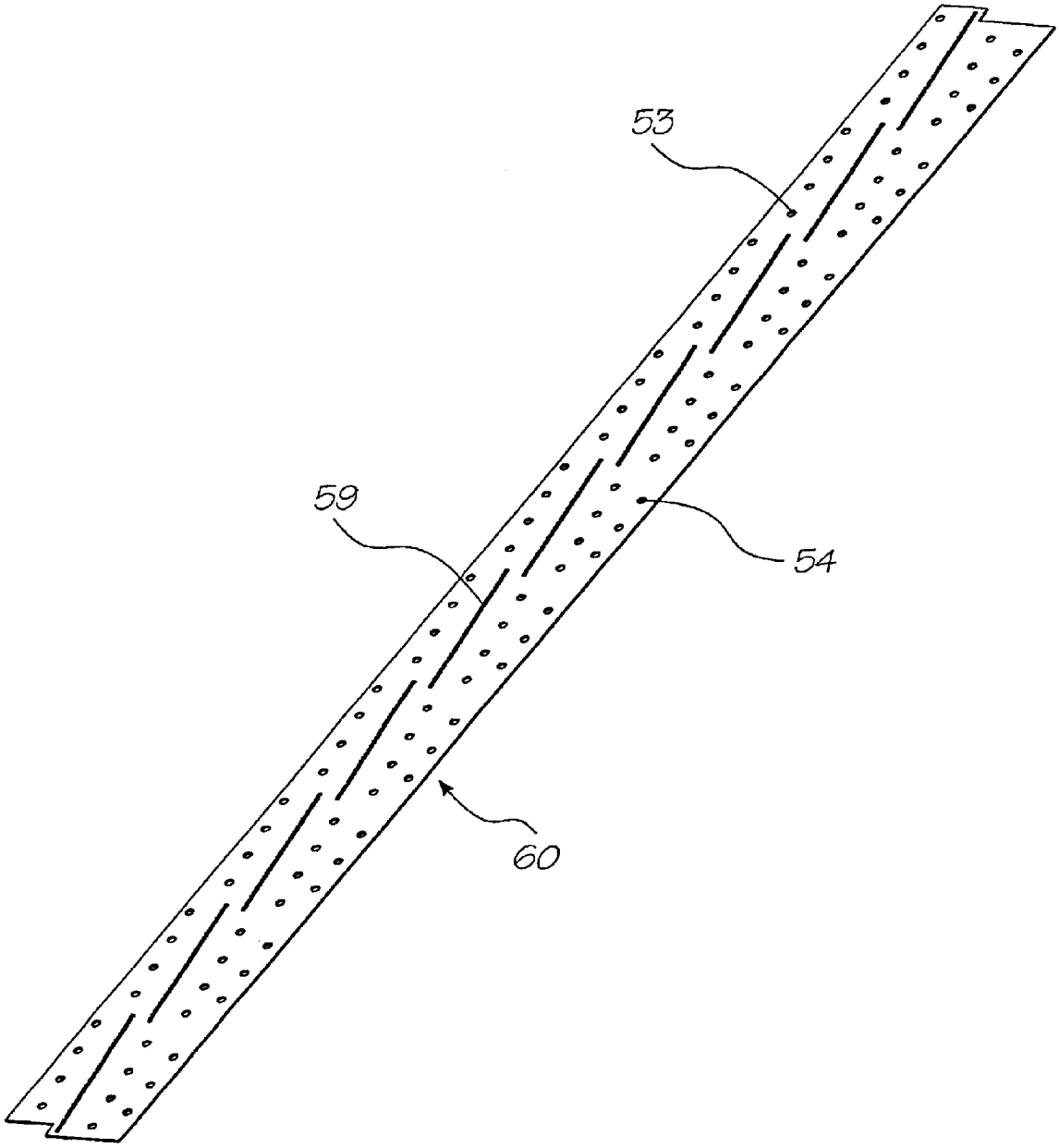
FIG. 17 is a perspective view of a third layer of the ink distribution structure, starting from the ink distribution molding of FIG. 11.
Figure 18:
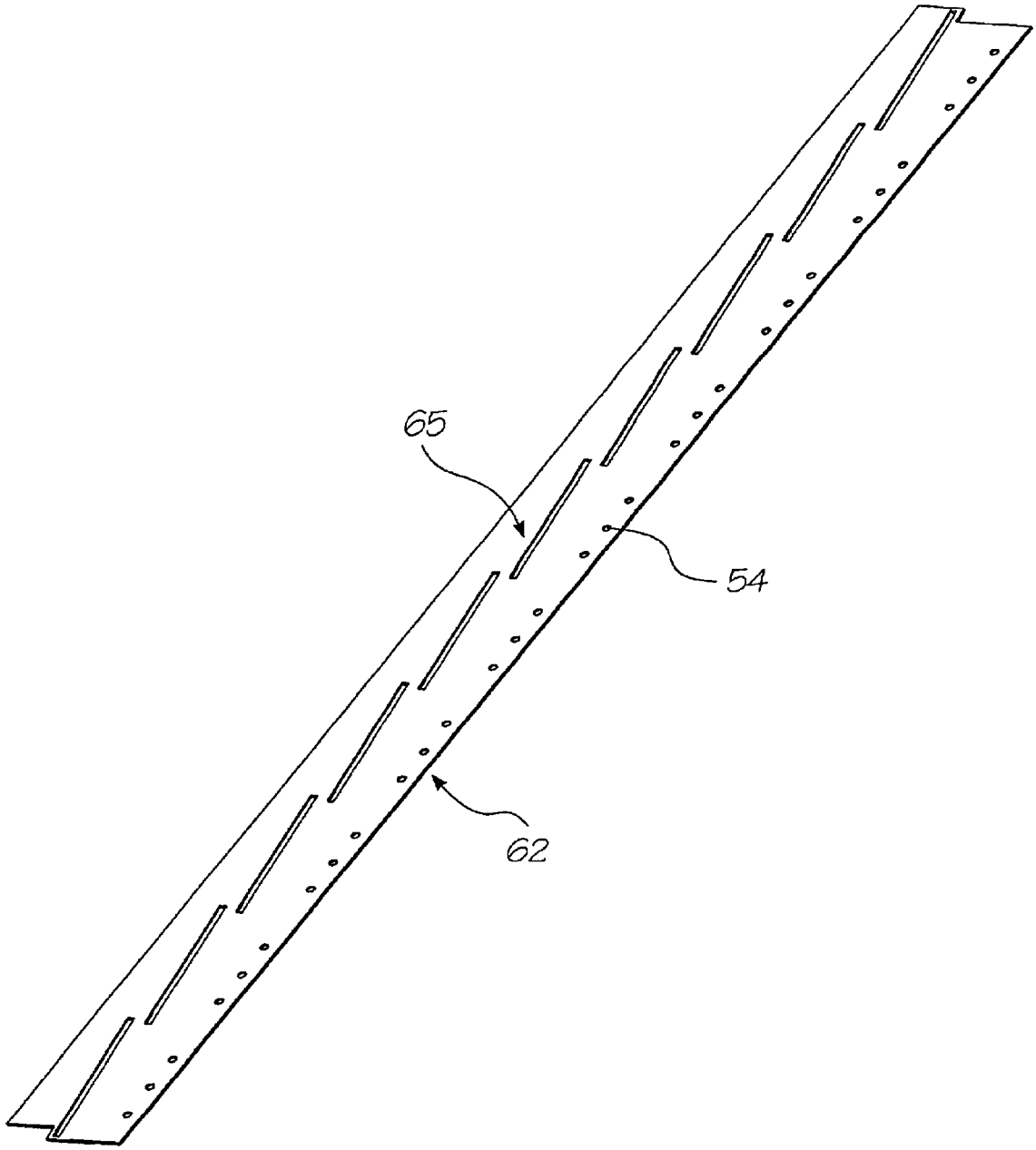
FIG. 18 is a perspective view of a fourth layer of the ink distribution structure, starting from the ink distribution molding of FIG. 11.
Figure 19:
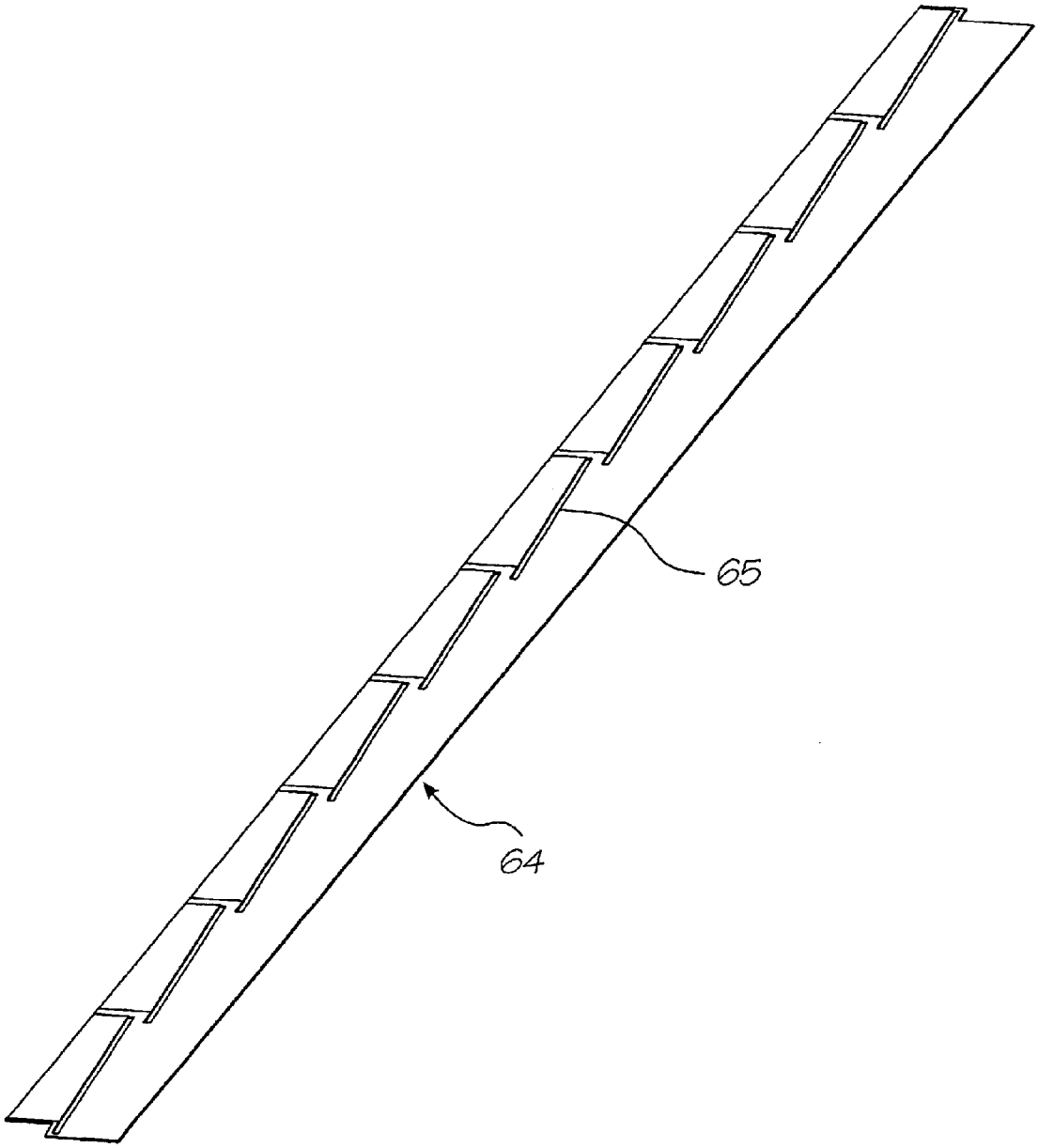
FIG. 19 is a perspective view of a fifth layer of the ink distribution structure, starting from the ink distribution molding of FIG. 11.
Figure 20:
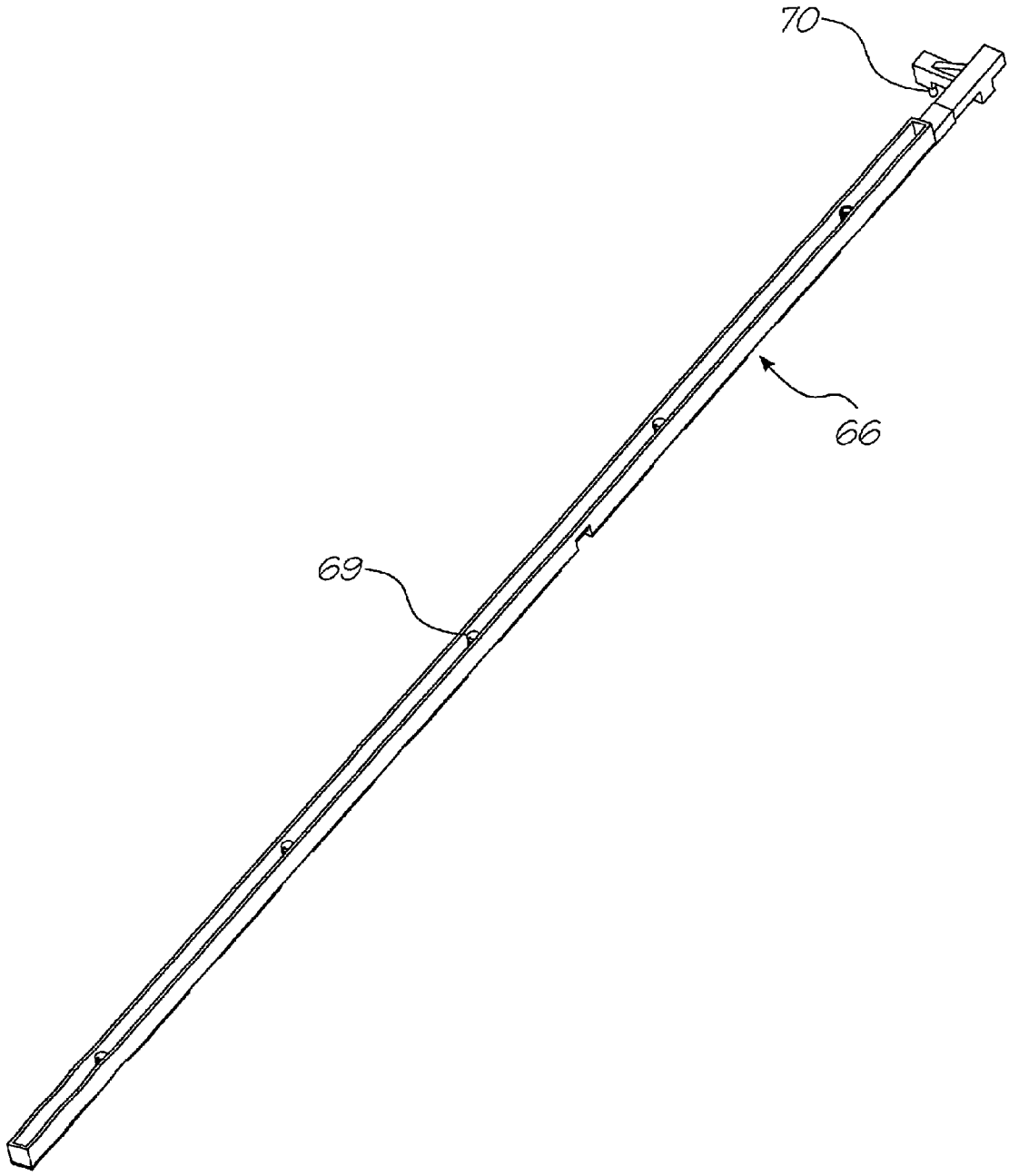
FIG. 20 is a perspective view of a nitrogen valve molding of the printhead assembly.
Figure 21:
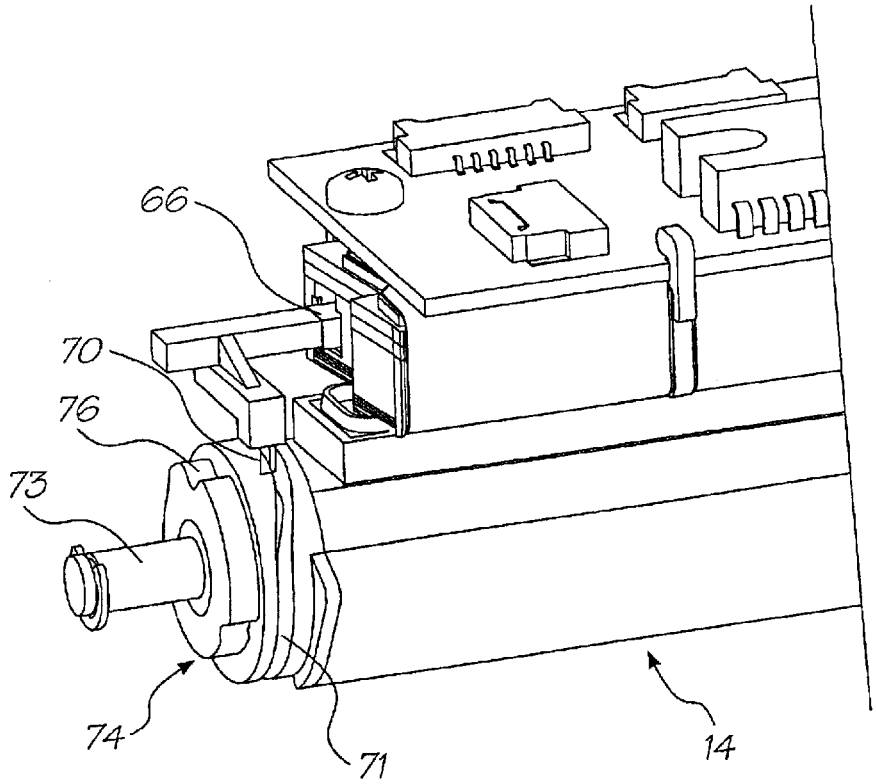
FIG. 21 is a rear perspective view of one end of a platen of the ink jet printing unit.
Figure 22:
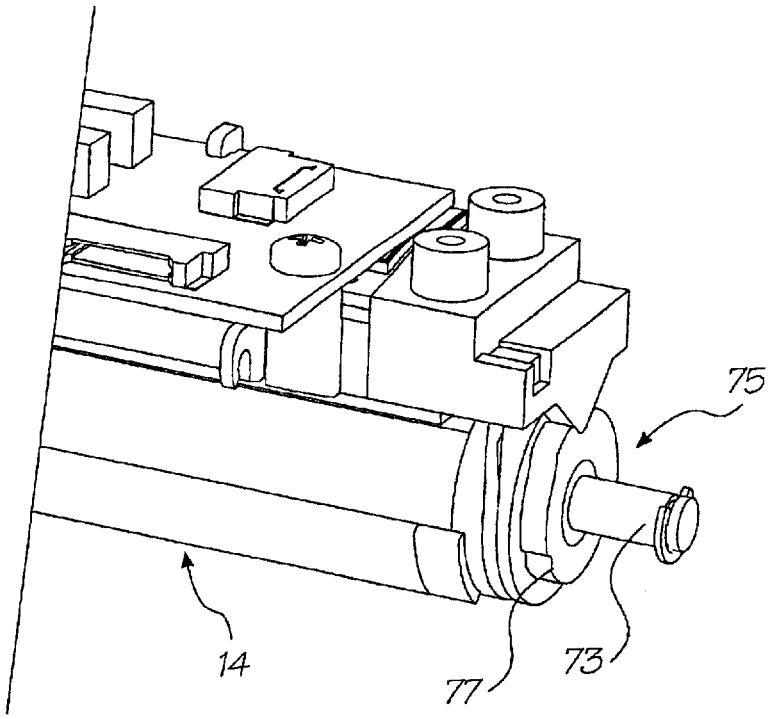
FIG. 22 is a rear perspective view of an opposite end of the platen.

An under surface of the first layer 52 includes underside recesses 55 (FIG. 14). Each recess 55 communicates with one of the ink holes of the two centre-most rows of four holes 53 (considered in the direction transversely across the layer 52). That is, holes 53*a* (FIG. 13) deliver ink to the right hand recess 55*a* shown in FIG. 14, whereas the holes 53*b* deliver ink to the left most underside recesses 55*b* shown in FIG. 14.

The second layer 56 includes a pair of slots 57, each receiving ink from one of the underside recesses 55 of the first layer 52.

The second layer 56 also includes ink holes 53 which are aligned with the outer two sets of ink holes 53 of the first layer 52. That is, ink passing through the outer sixteen ink holes 53 of the first layer 52 for each print chip pass directly through corresponding holes 53 passing through the second layer 56.

The underside of the second layer 56 has formed therein a number of transversely extending channels 58 to relay ink passing through ink holes 53*c* and 53*d* toward the centre. These channels 58 extend to align with a pair of slots 59 formed through a third layer 60 of the laminate. The third layer 60 of the laminate includes four slots 59 corresponding with each print chip 27, with two inner slots 59 being aligned with the pair of slots 57 formed in the second layer 56 and outer slots between which the inner slots reside.

Figure 9A:
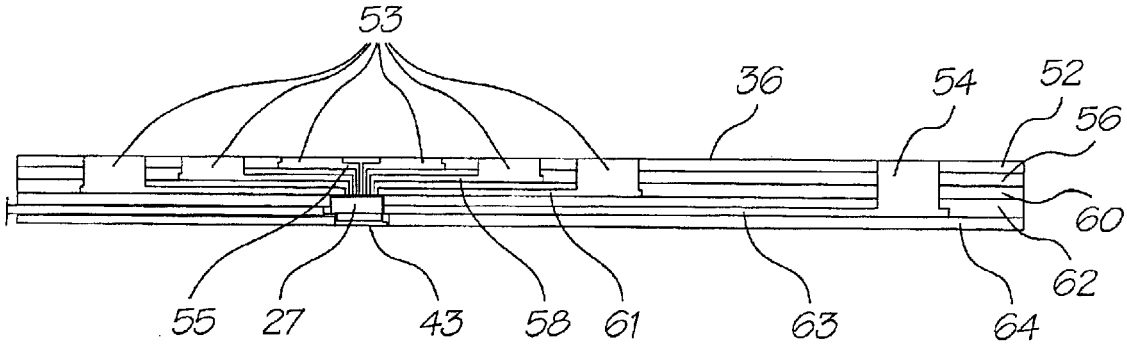
FIG. 9*a* is a schematic end elevation of a part of the printhead assembly showing a position of a printhead chip.
Figure 9B:
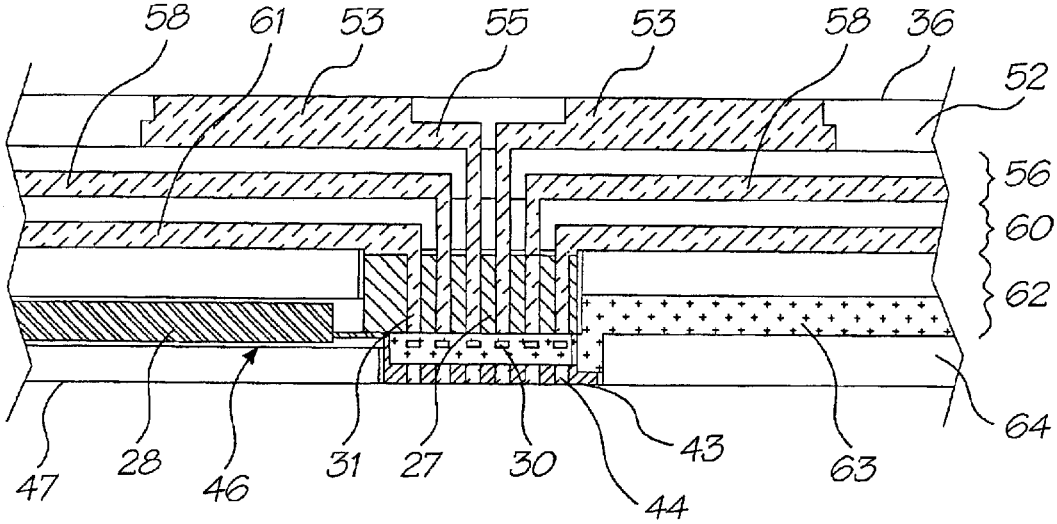
FIG. 9*b* is a schematic end elevation of the part of FIG. 9*a*, enlarged to show some printhead chip detail.

The third layer 60 also includes an array of nitrogen holes 54 aligned with the corresponding nitrogen hole arrays 54 provided in the first and second layers 52 and 56. The third layer 60 has only eight remaining ink holes 53 corresponding with each print chip. These outermost holes 53 are aligned with the outermost holes 53 provided in the first and second layers 52, 56. As shown in FIGS. 9A and 9B, the third layer 60 includes in its underside surface a transversely extending channel 61 corresponding to each hole 53. The channels 61 deliver ink from the corresponding hole 53 to a position just outside the alignment of the slots 59.

As best seen in FIGS. 9A and 9B, the top three layers 52, 56, 60 of the laminated stack 36 thus serve to direct the ink (shown by broken hatched lines in FIG. 9B) from the more widely spaced ink ducts 40 of the distribution molding to slots aligned with the ink passages 31 through the upper surface of each print chip 27.

Furthermore, the top three layers 52, 56, and 60, also serve to define a nitrogen passage with the openings 54 from the nitrogen duct 41 to the print chips 27.

As shown in FIG. 13, which is a view from above the laminated stack, the slots 57 and 59 can in fact be comprised of discrete co-linear spaced slot segments.

A fourth layer 62 of the laminated stack 36 includes an array of ten chip-slots 65 each receiving an upper portion of a respective print chip 27.

The fifth and final layer 64 also includes an array of chip-slots 65 which receive the print chips 27 and nozzle guard assembly 43.

The TAB film 28 is sandwiched between the fourth and fifth layers 62 and 64, one or both of which can be provided with the recess 46 to accommodate the TAB film 28.

The laminated stack 36 is formed as a precision micro-molding, injection molded in an Acetal type material. It accommodates the array of print chips 27 with the TAB film 28 already attached and mates with the cover molding 39 described earlier.

Rib details in the underside of the micro molding provide support for the TAB film 28 when they are bonded together. The TAB film 28 forms the underside wall of the printhead module, as there is sufficient structural integrity between the pitches of the ribs to support a flexible film. The edges of the TAB film 28 seal on the underside wall of the cover molding 39. Each chip 27 is bonded onto one hundred micron wide ribs that run the length of the micro molding, providing a final ink feed to the nozzle assemblies 30.

The design of the micro molding allow for a physical overlap of the print chips 27 when they are butted in a line. Because the print chips 27 form a continuous strip with a generous tolerance, they can be adjusted digitally to produce a near perfect print pattern rather than relying on very close toleranced moldings and exotic materials to perform the same function. The pitch of the modules is typically 20.33 mm.

The individual layers of the laminated stack 36 as well as the cover molding 39 and distribution molding 35 can be glued or otherwise bonded together to provide a sealed unit. The ink paths can be sealed by a bonded transparent plastic film serving to indicate when inks are in the ink paths, so they can be fully capped off when the upper part of the adhesive film is folded over. Ink charging is then complete.

The four upper layers 52, 56, 60, 62 of the laminated stack 36 have aligned nitrogen holes 54 which communicate with nitrogen passages 63 formed as channels formed in the bottom surface of the fourth layer 62, as shown in FIGS. 9*b* and 13. These passages 63 provide nitrogen to the space between the print chip surface and the nozzle guard 43 whilst the printer is in operation. Nitrogen from this pressurised zone passes through the micro-apertures 44 in the nozzle guard 43, thus preventing the build-up of any dust or unwanted contaminants at those apertures 44. This supply of pressurised nitrogen can be turned off to prevent ink drying on the nozzle surfaces during periods of non-use of the printer, control of this nitrogen supply being by means of the nitrogen valve assembly shown in FIGS. 6 to 8, 20 and 21.

Figure 6:
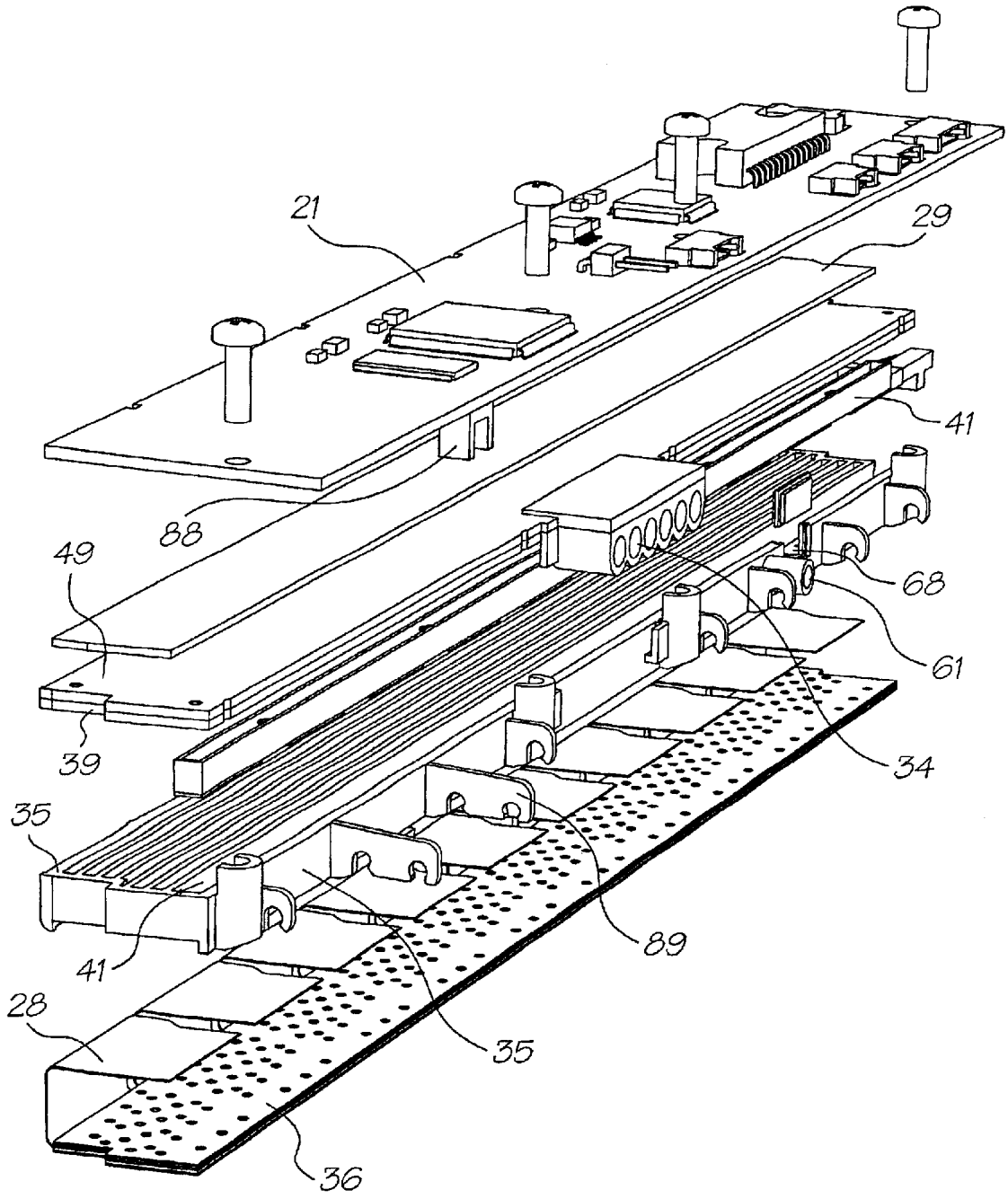
FIG. 6 is an exploded view of the printhead assembly.

With reference to FIGS. 6 to 8, within the nitrogen duct 41 of the printhead assembly 11 there is located a nitrogen valve molding 66 formed as a channel with a series of apertures 67 in its base. The spacing of the apertures 67 corresponds to nitrogen passages 68 formed in the base of the nitrogen duct 41 (see FIG. 6). The nitrogen valve molding 66 is movable longitudinally within the nitrogen duct 41. The apertures 67 can thus be brought into alignment with passages 68 to allow the nitrogen through the laminated stack to the cavity between the print chip 27 and the nozzle guard 43, or moved out of alignment to close off the nitrogen supply. Compression springs 69 maintain a sealing inter-engagement of the bottom of the nitrogen valve molding 66 with the base of the nitrogen duct 41 to prevent leakage when the valve is closed.

The nitrogen valve molding 66 has a cam follower 70 extending from one end thereof, which engages a nitrogen valve cam surface 71 on an end cap 74 of the platen 14 so as to selectively move the nitrogen valve molding 66 longitudinally within the nitrogen duct 41 according to the rotational positional of the multi-function platen 14, which may be rotated between printing, capping and blotting positions depending on the operational status of the printer, as will be described below in more detail with reference to FIGS. 21 to 24. When the platen 14 is in its rotational position for printing, the cam holds the nitrogen valve 66 in its open position to supply nitrogen to the print chip surface. When the platen 14 is rotated to the non-printing position in which it caps off the micro-apertures of the nozzle guard 43, the cam moves the nitrogen valve molding 66 to the valve closed position.

With reference to FIGS. 21 to 24, the platen member 14 extends parallel to the printhead, supported by a rotary shaft 73 mounted in bearing molding 18 and rotatable by means of a gear 79 (see FIG. 3). The shaft 73 is provided with a right hand end cap 74 and left hand end cap 75 at respective ends, having cams 76, 77.

The platen member 14 has a platen surface 78, a capping portion 80 and an exposed blotting portion 81 extending along its length, each separated by 120°. During printing, the platen member 14 is rotated so that the platen surface 78 is positioned opposite the printhead assembly 11 so that the platen surface 78 acts as a support for that portion of the paper being printed at the time. When the printer is not in use, the platen member 14 is rotated so that the capping portion 80 contacts the bottom of the printhead assembly 11, sealing in a locus surrounding the micro apertures 44. This, in combination with the closure of the nitrogen valve 66 when the platen 14 is in its capping position, maintains a closed atmosphere at the print nozzle surface. This serves to reduce evaporation of the ink solvent (usually water) and thus reduce drying of ink on the print nozzles while the printer is not in use.

The third function of the rotary platen member 14 is as an ink blotter to receive ink from priming of the print nozzle assemblies 30 at printer start up or maintenance operations of the printer. During this printer mode, the platen member 14 is rotated so that the exposed blotting portion 81 is located in the ink ejection path opposite the nozzle guard 43. The exposed blotting portion 81 is an exposed part of a body of blotting material 82 inside the platen member 14, so that the ink received on the exposed portion 81 is drawn into the body of the platen member 14.

Figure 23:
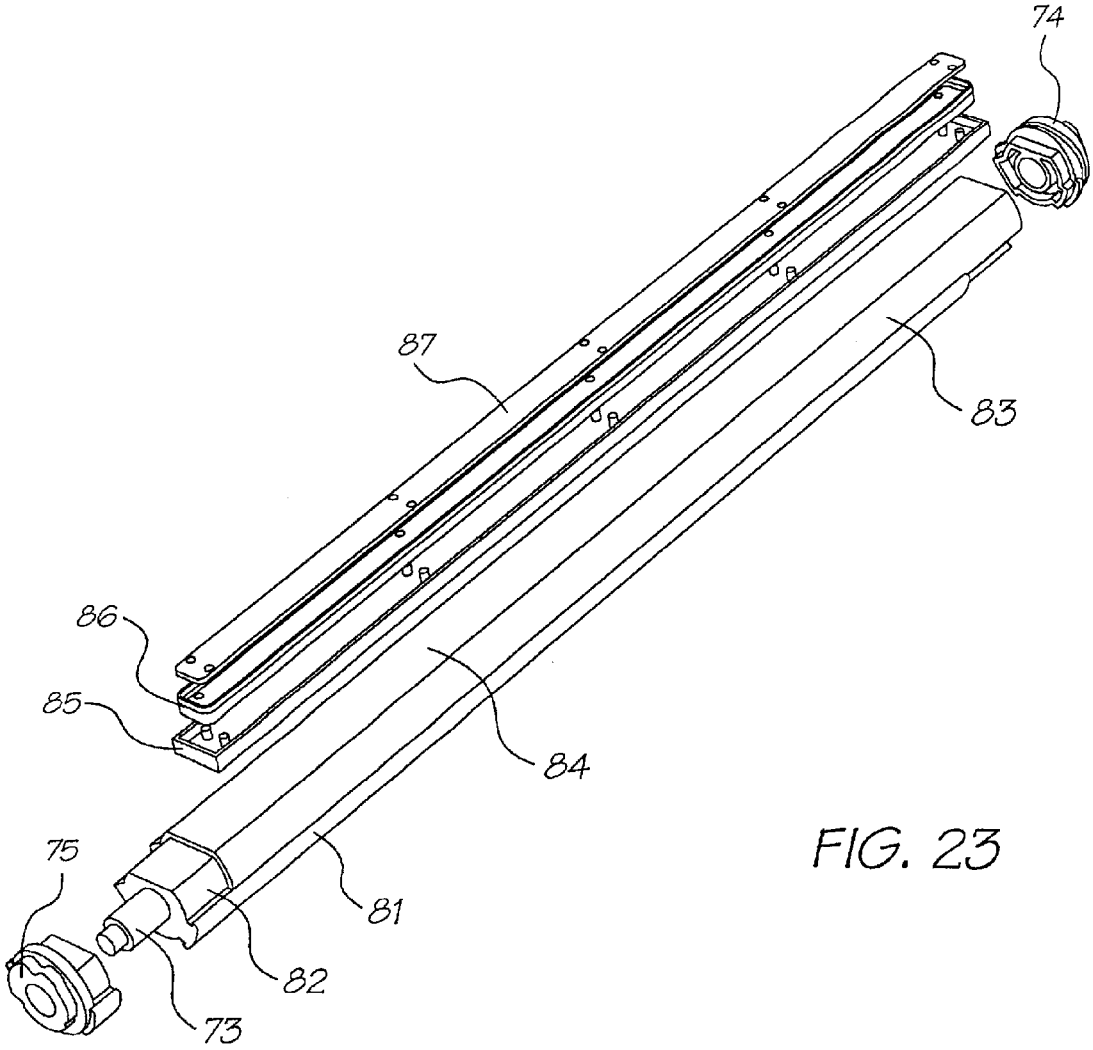
FIG. 23 is an exploded view of the platen.
Figure 24:
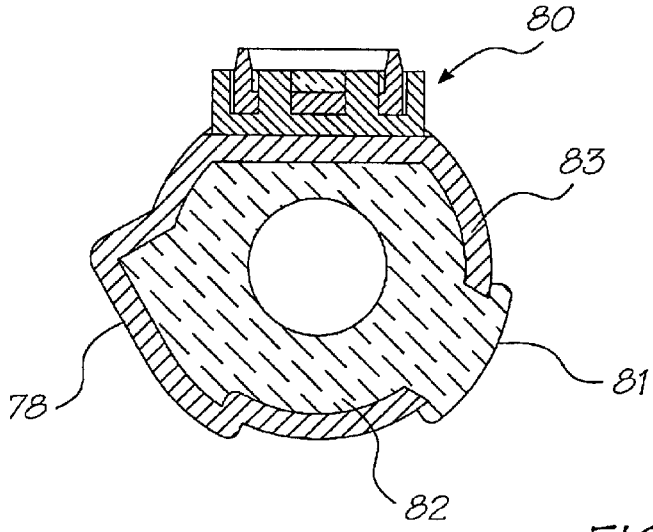
FIG. 24 is a transverse cross-sectional view of the platen.

Further details of the platen member construction may be seen from FIGS. 23 and 24. The platen member 14 consists generally of an extruded or molded hollow platen body 83 which forms the platen surface 78 and receives the shaped body of blotting material 82 of which a part projects through a longitudinal slot in the platen body 83 to form the exposed blotting surface 81. A flat portion 84 of the platen body 83 serves as a base for attachment of the capping member 80, which consists of a capper housing 85, a capper seal member 86 and a foam member 87 for contacting the nozzle guard 43.

With reference again to FIG. 1, each bearing molding 18 rides on a pair of vertical rails 101. That is, the capping assembly is mounted to four vertical rails 101 enabling the assembly to move vertically. A spring 102 under either end of the capping assembly biases the assembly into a raised position, maintaining cams 76,77 in contact with spacer projections 100.

The printhead assembly 11 is capped when not is use by the full-width capping member 80 using the elastomeric (or similar) seal 86. In order to rotate the platen assembly 14, the main roller drive motor is reversed. This brings a reversing gear into contact with the gear 79 on the end of the platen assembly and rotates it into one of its three functional positions, each separated by 120°.

The cams 76, 77 on the platen end caps 74, 75 co-operate with projections 100 on the respective printhead spacers 20 to control the spacing between the platen member 14 and the printhead depending on the rotary position of the platen member 14. In this manner, the platen is moved away from the printhead during the transition between platen positions to provide sufficient clearance from the printhead and moved back to the appropriate distances for its respective paper support, capping and blotting functions.

Figure 25:
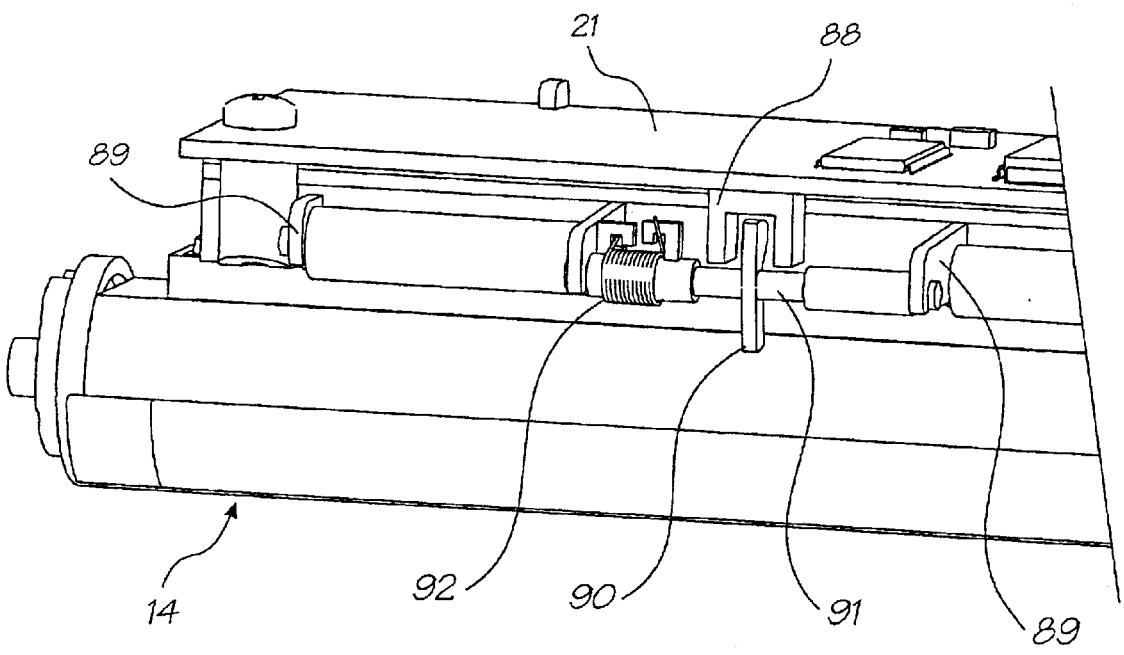
FIG. 25 is a front perspective view of an optical paper sensor arrangement.

In addition, the cam arrangement for the rotary platen provides a mechanism for fine adjustment of the distance between the platen surface and the printer nozzles by slight rotation of the platen 14. This allows compensation of the nozzle-platen distance in response to the thickness of the paper or other material being printed, as detected by the optical paper thickness sensor arrangement illustrated in FIG. 25.

The optical paper sensor includes an optical sensor 88 mounted on the lower surface of the PCB 21 and a sensor flag arrangement mounted on the arms 89 protruding from the distribution molding. The flag arrangement comprises a sensor flag member 90 mounted on a shaft 91, which is biased by a torsion spring 92. As paper enters the feed rollers 12, the lowermost portion of the flag member 90 contacts the paper and rotates against the bias of the spring 92 by an amount dependent on the paper thickness. The optical sensor 88 detects this movement of the flag member 90 and the PCB responds to the detected paper thickness by causing compensatory rotation of the platen 14 to optimize the distance between the paper surface and the nozzles.

Figure 26:
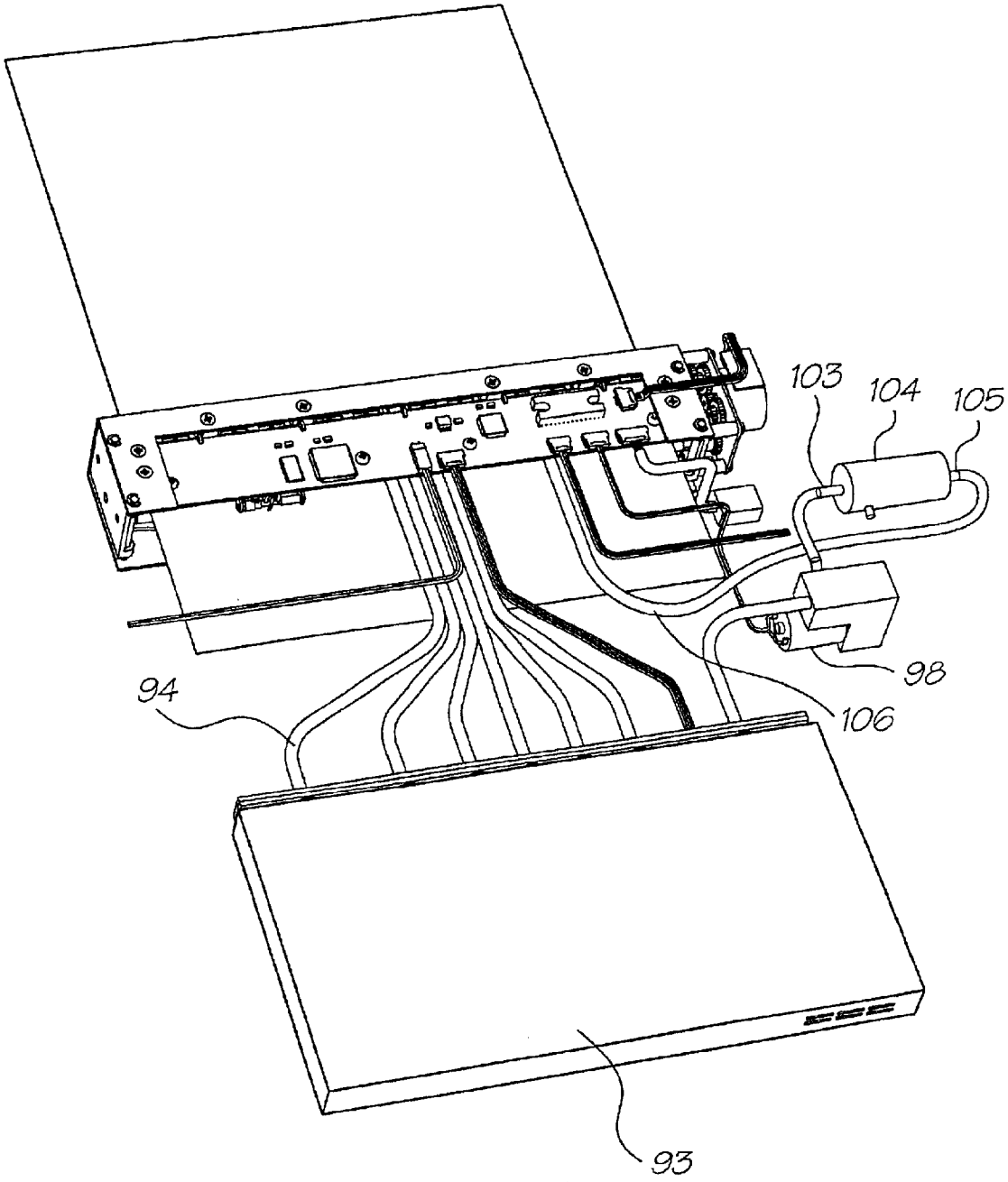
FIG. 26 is a schematic perspective illustration of a printing unit showing an ink reservoir cassette and media being fed through the printing unit.
Figure 27:
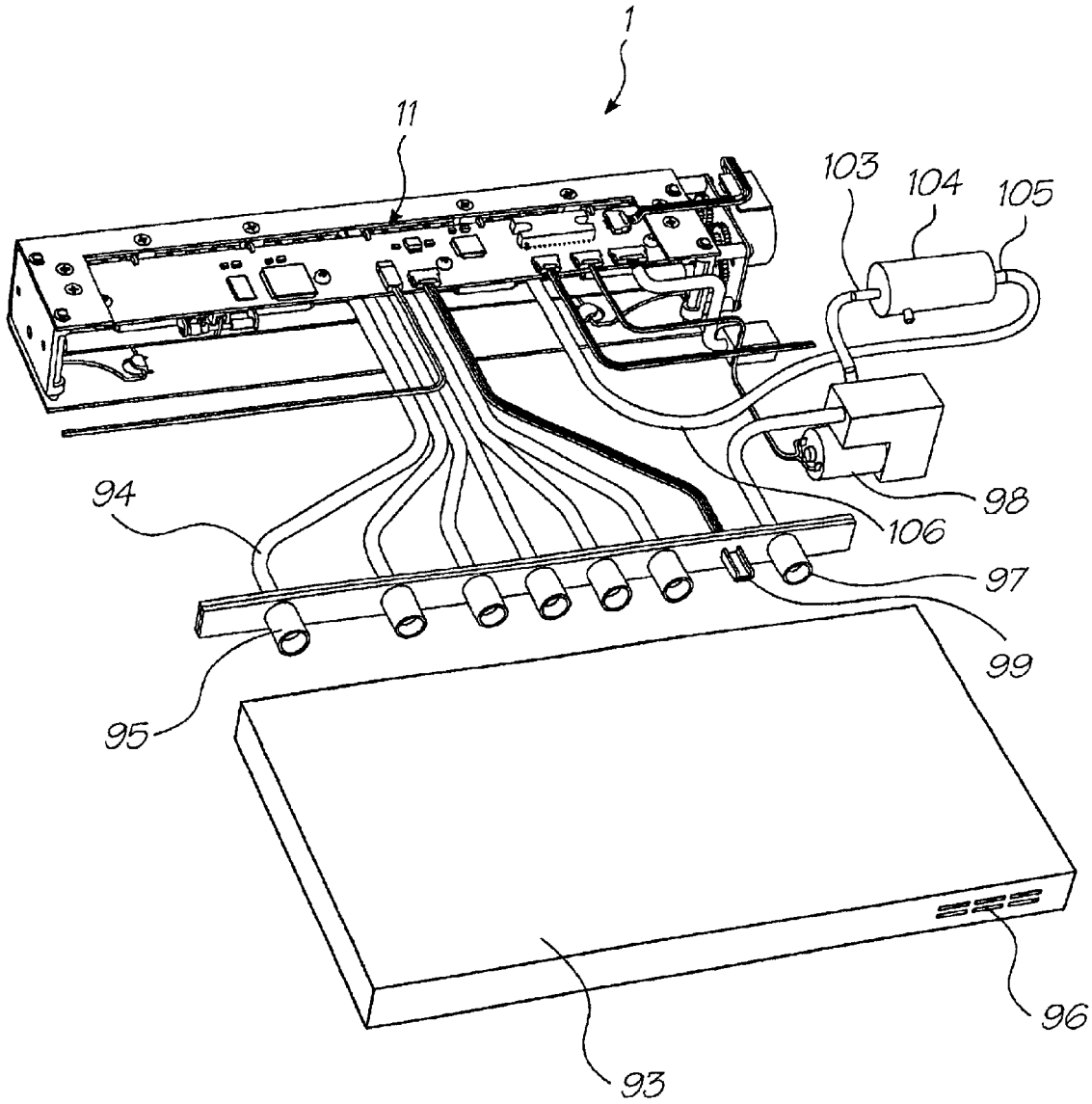
FIG. 27 is a partly exploded view of the printing unit as shown in FIG. 26.

FIGS. 26 and 27 show attachment of the illustrated printhead unit 1 to a replaceable ink cassette 93. Six different inks are supplied to the printhead through hoses 94 leading from an array of female ink valves 95 located inside the printer body. The replaceable cassette 93 containing a six compartment ink bladder and corresponding male valve array is inserted into the printer and mated to the valves 95. The cassette also contains an air inlet 96 and air filter (not shown), and mates to an air intake connector 97 situated beside the ink valves 95, leading to an air pump 98.

The air pump 98 is connected to an inlet 103 of a nitrogen separation unit 104. An outlet 105 of the unit 104 is connected to a hose 106. The hose 106 supplies nitrogen to the nitrogen duct 41 and thus to the print chips 27 as is clear from the above description.

A QA chip is included in the cassette. The QA chip meets with a contact 99 located between the ink valves 95 and air intake connector 97 in the printer as the cassette is inserted to provide communication to the QA chip connector 24 on the PCB 21.

The following description sets out details of a printhead chip that is suitable for use in the printhead assembly 11. Applicant has invented many other printhead chips that are also suitable. It is therefore to be understood that the following description is not intended to limit the choice of printhead chip for use with the invention. However, the following description is useful in describing a particular nozzle assembly, printhead chip and nozzle guard in the context of providing an inert operating environment for such components.

Figure 28:
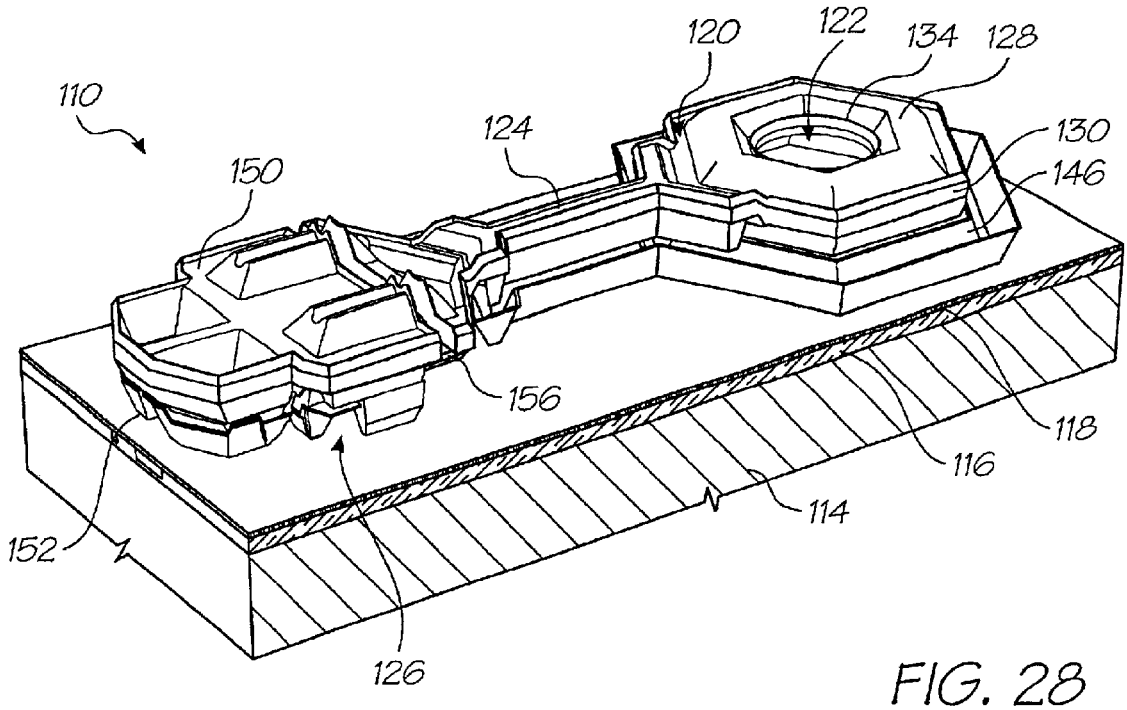
FIG. 28 is a three dimensional, schematic view of a nozzle assembly of a printhead chip for the printhead assembly.

In FIG. 28 of the drawings, reference 110 indicates a possible nozzle assembly of one printhead chip 27 of the printhead assembly 11. The printhead assembly 11 has a plurality of printhead chips 110 arranged in an array 112 (FIGS. 32 and 33) on a silicon substrate 114. The array 112 is described in greater detail below.

The nozzle assembly 110 includes a silicon substrate or wafer 114 on which a dielectric layer 116 is deposited. A CMOS passivation layer 118 is deposited on the dielectric layer 116.

Each nozzle assembly 110 includes a nozzle 120 defining a nozzle opening 122, a connecting member in the form of a lever arm 124 and an actuator 126. The lever arm 124 connects the actuator 126 to the nozzle 120.

Figure 29:
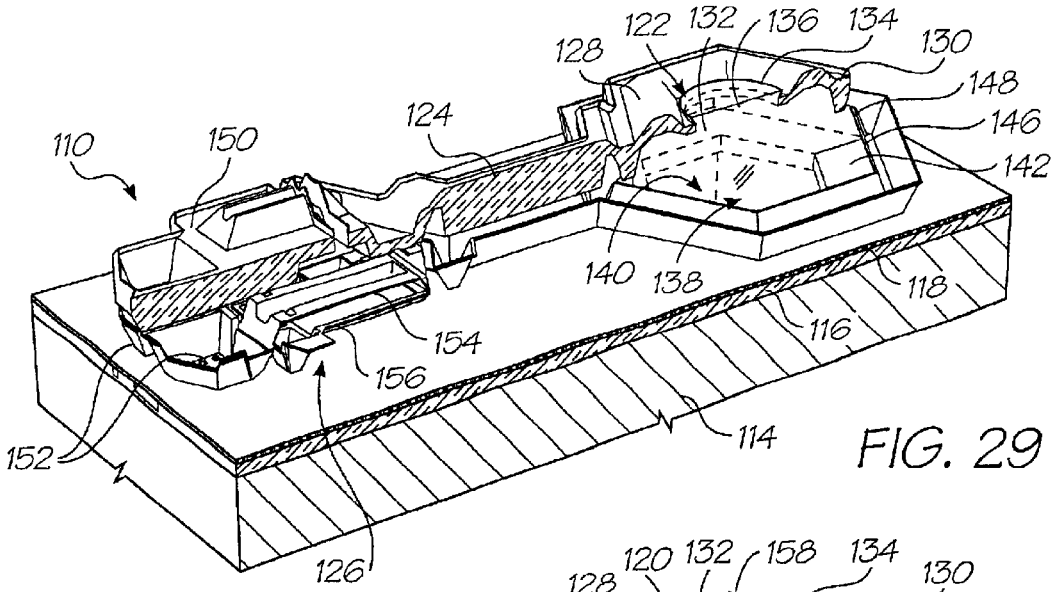
FIGS. 29 to 31 show a three dimensional, schematic illustration of an operation of the nozzle assembly of FIG. 29.
Figure 30:
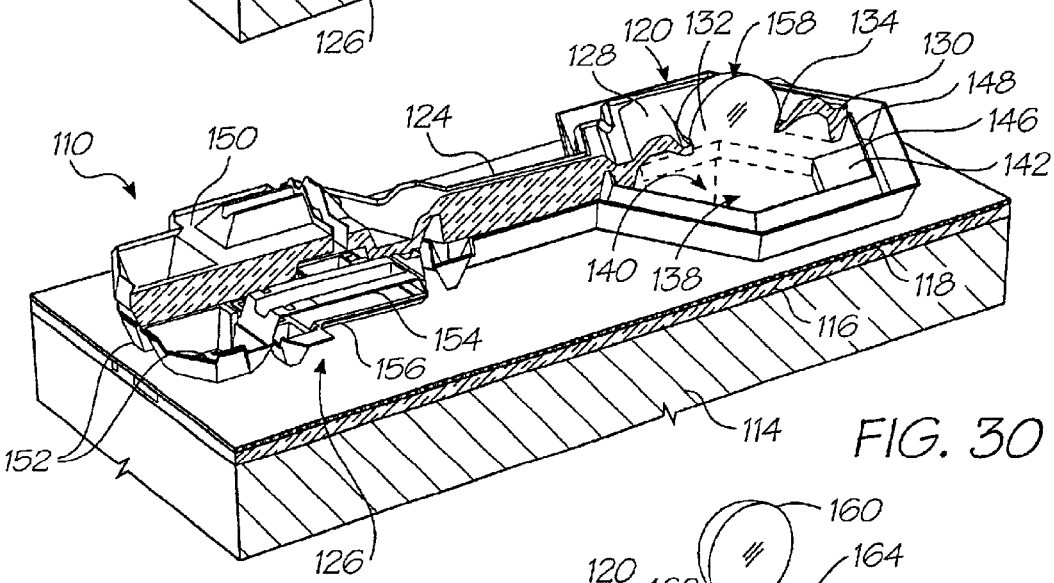
Figure 31:
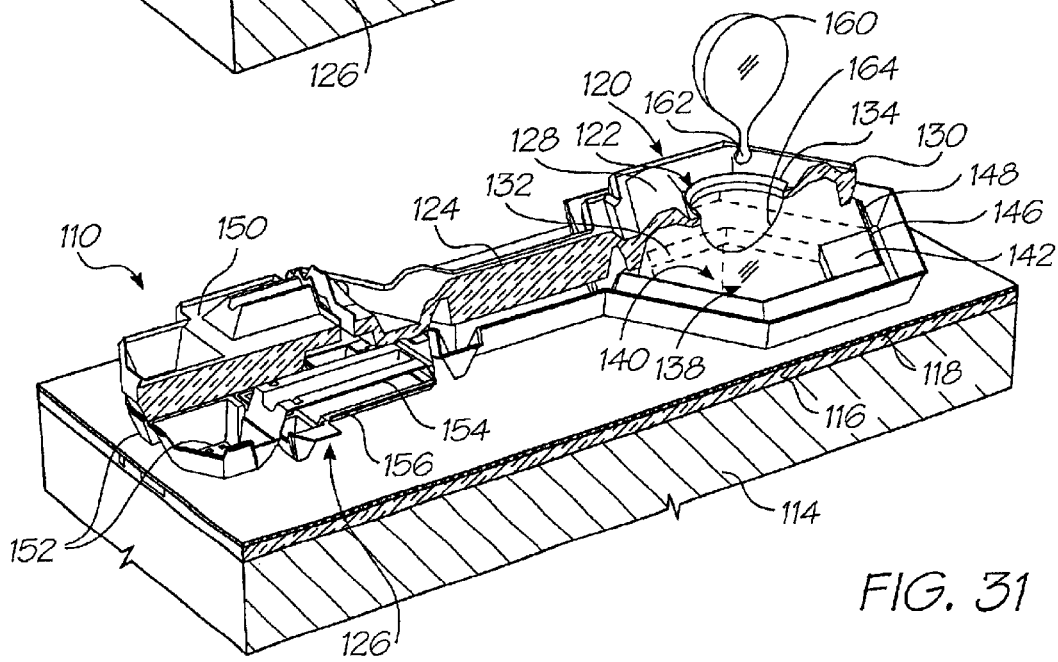

As shown in greater detail in FIGS. 29 to 31 of the drawings, the nozzle 120 includes a crown portion 128 with a skirt portion 130 depending from the crown portion 128. The skirt portion 130 forms part of a peripheral wall of a nozzle chamber 132 (FIGS. 29 to 31 of the drawings). The nozzle opening 122 is in fluid communication with the nozzle chamber 132. It is to be noted that the nozzle opening 122 is surrounded by a raised rim 134, which "pins" a meniscus 136 (FIG. 29) of a body of ink 138 in the nozzle chamber 132.

An ink inlet aperture 140 (shown most clearly in FIG. 33 of the drawings) is defined in a floor 46 of the nozzle chamber 132. The aperture 140 is in fluid communication with an ink inlet channel 144 defined through the substrate 114.

A wall portion 146 bounds the aperture 140 and extends upwardly from the floor 142. The skirt portion 130 of the nozzle 120 defines a first part of a peripheral wall of the nozzle chamber 132 and the wall portion 146 defines a second part of the peripheral wall of the nozzle chamber 132.

The wall portion 146 has an inwardly directed lip 148 at its free end, which serves as a fluidic seal, which inhibits the escape of ink when the nozzle 120 is displaced, as will be described in greater detail below. It will be appreciated that, due to the viscosity of the ink 138 and the small dimensions of the spacing between the lip 148 and the skirt portion 130, the inwardly directed lip 148 and surface tension function as a seal for inhibiting the escape of ink from the nozzle chamber 132.

The actuator 126 is a thermal bend actuator and is connected to an anchor 150 extending upwardly from the substrate 114 or, more particularly, from the CMOS passivation layer 118. The anchor 150 is mounted on conductive pads 152 which form an electrical connection with the actuator 126.

The actuator 126 comprises a first, active beam 154 arranged above a second, passive beam 156. In a preferred embodiment, both beams 154 and 156 are of, or include, a conductive ceramic material such as titanium nitride (TiN).

Both beams 154 and 156 have their first ends anchored to the anchor 150 and their opposed ends connected to the arm 124. When a current is caused to flow through the active beam 154 thermal expansion of the beam 154 results. As the passive beam 156, through which there is no current flow, does not expand at the same rate, a bending moment is created causing the arm 124 and thus the nozzle 120 to be displaced downwardly towards the substrate 114 as shown in FIG. 30 of the drawings. This causes an ejection of ink through the nozzle opening 122 as shown at 62 in FIG. 30 of the drawings. When the source of heat is removed from the active beam 154, i.e. by stopping current flow, the nozzle 120 returns to its quiescent position as shown in FIG. 31 of the drawings. When the nozzle 120 returns to its quiescent position, an ink droplet 160 is formed as a result of the breaking of an ink droplet neck as illustrated at 162 in FIG. 31 of the drawings. The ink droplet 160 then travels on to the print media such as a sheet of paper. As a result of the formation of the ink droplet 160, a "negative" meniscus is formed as shown at 164 in FIG. 31 of the drawings. This "negative" meniscus 164 results in an inflow of ink 138 into the nozzle chamber 132 such that a new meniscus 136 (FIG. 2) is formed in readiness for the next ink drop ejection from the nozzle assembly 110.

Figure 32:
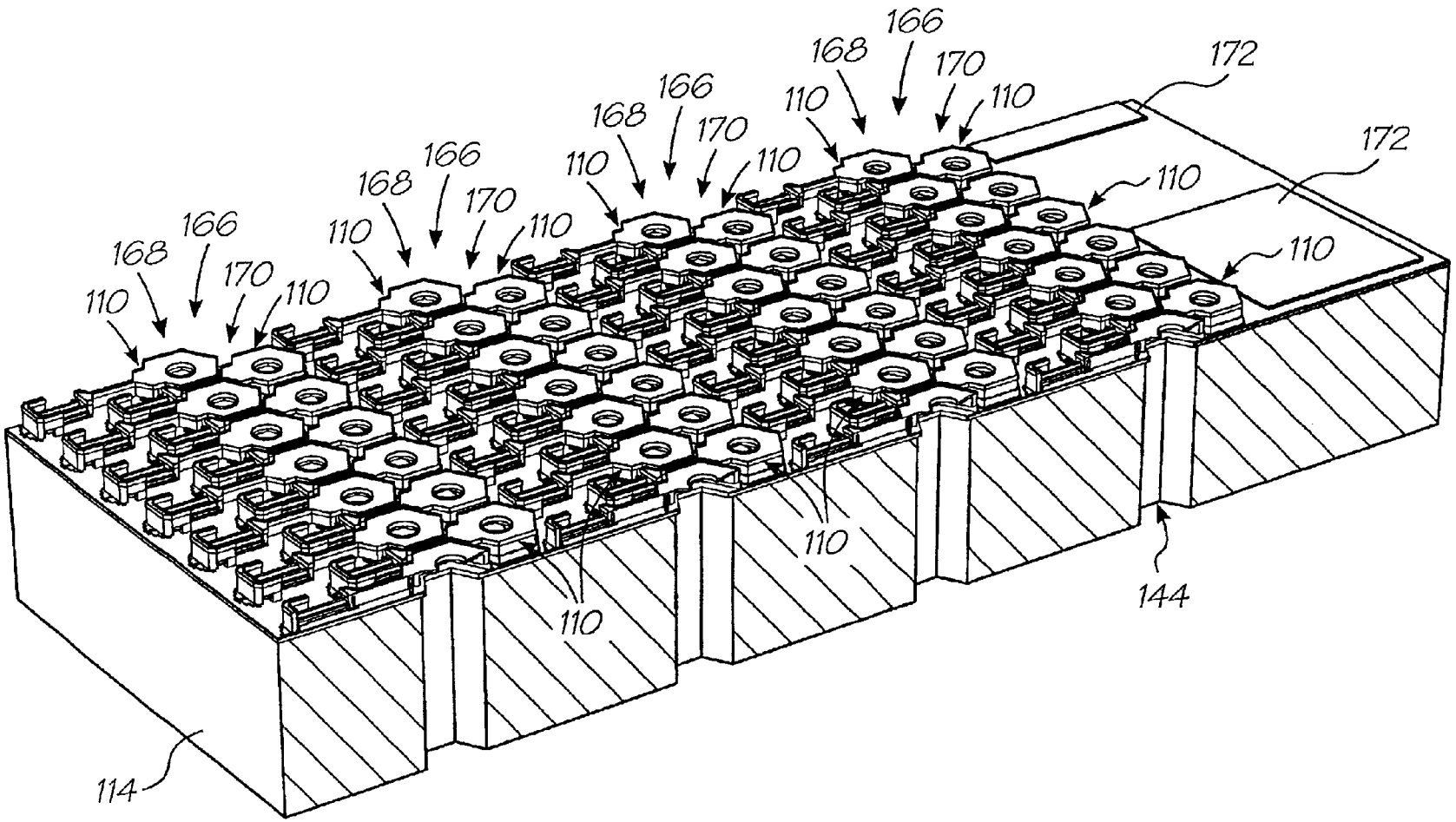
FIG. 32 shows a three-dimensional view of an array of the nozzle assemblies of FIGS. 29 to 31 constituting the printhead chip.
Figure 33:
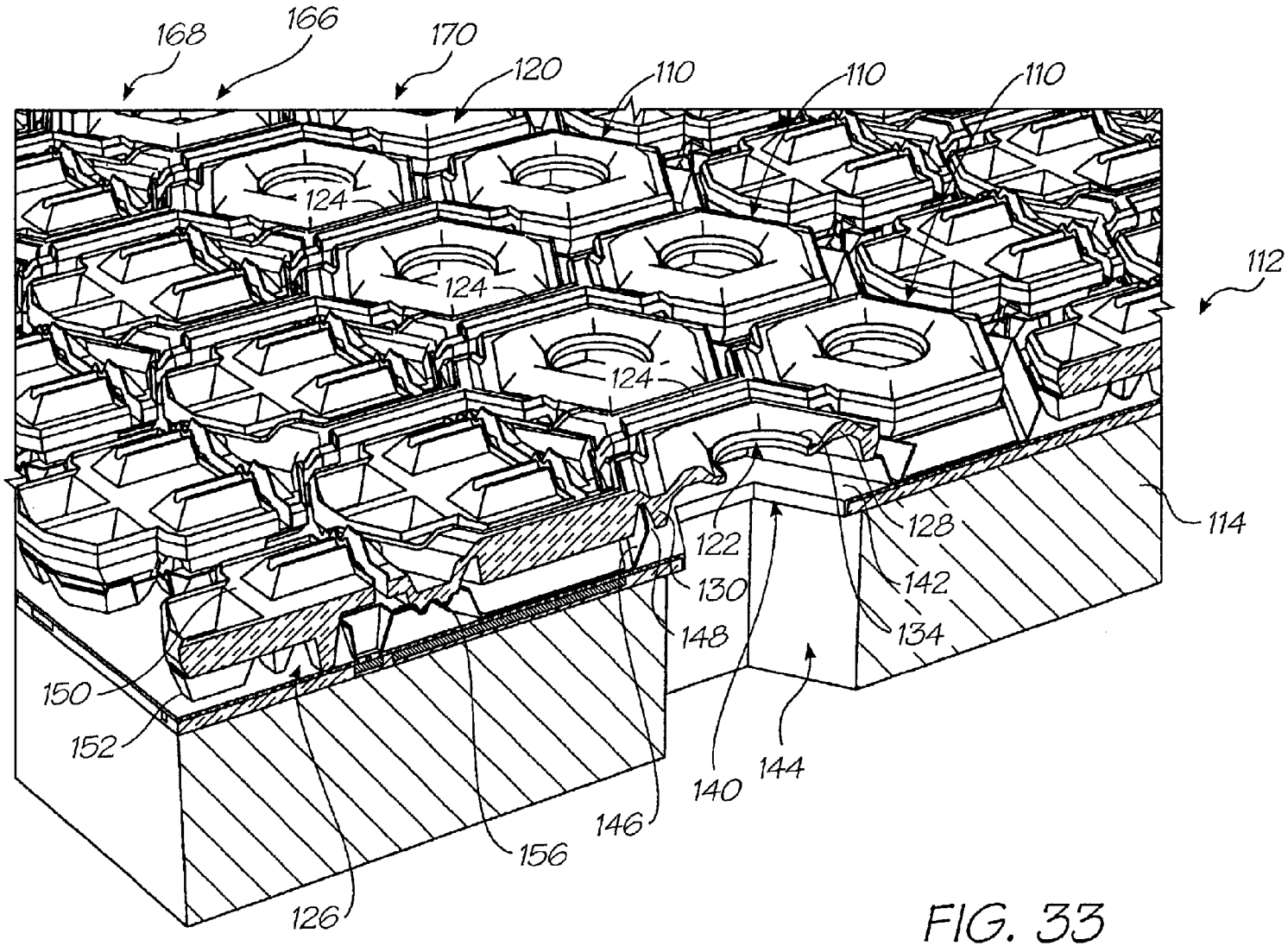
FIG. 33 shows, on an enlarged scale, part of the array of FIG. 32.
Figure 34:
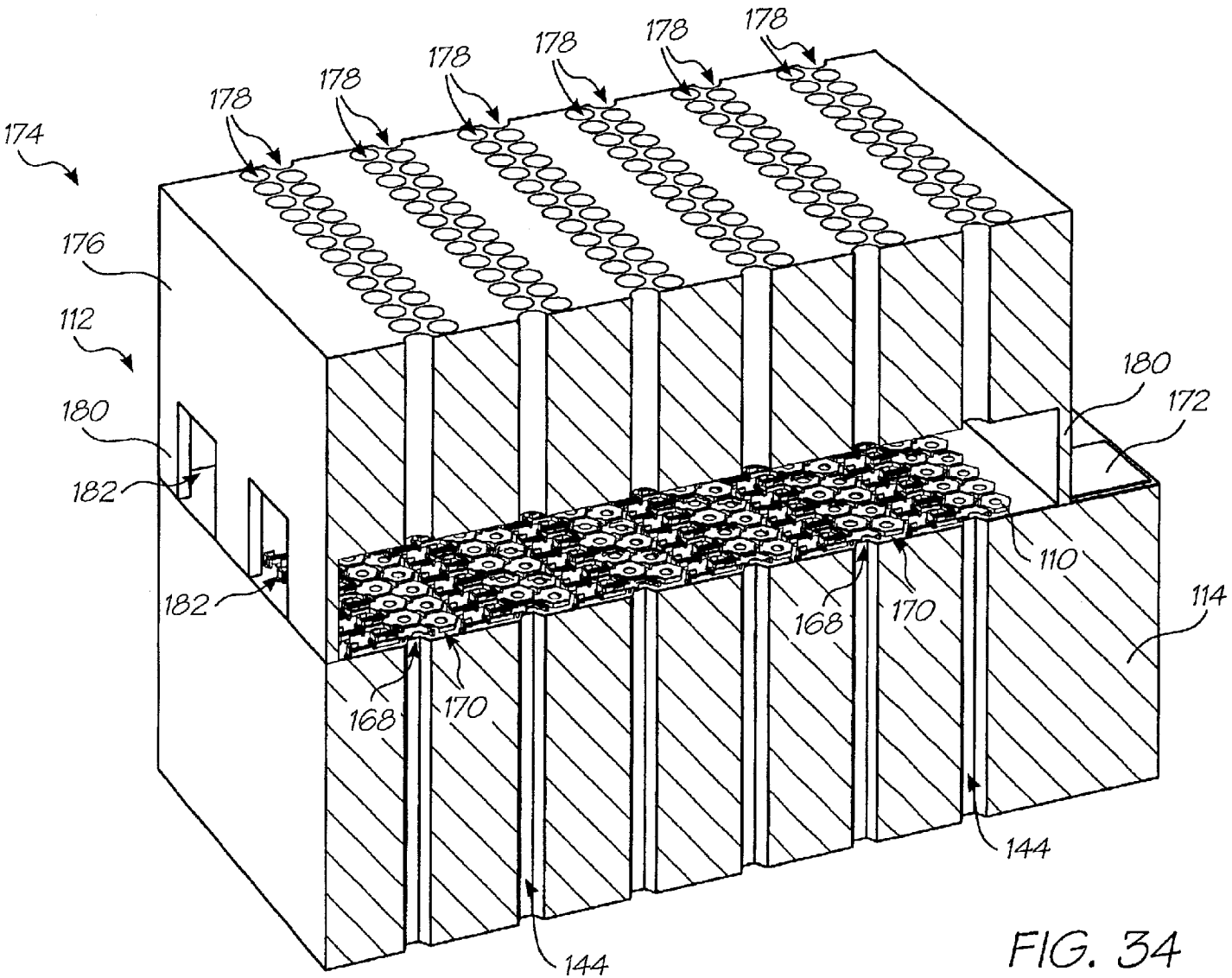
FIG. 34 shows a three dimensional view of the ink jet printhead chip with a nozzle guard positioned over the printhead chip.
Figure 36A:
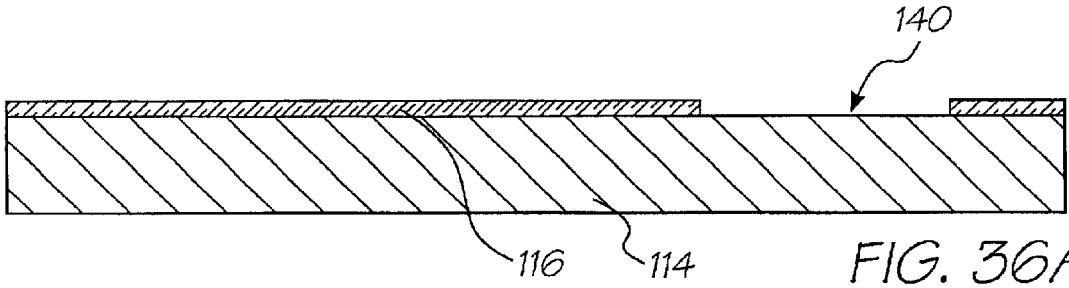
FIGS. 36*a* to 36*r* show sectional side views of the manufacturing steps.
Figure 37A:
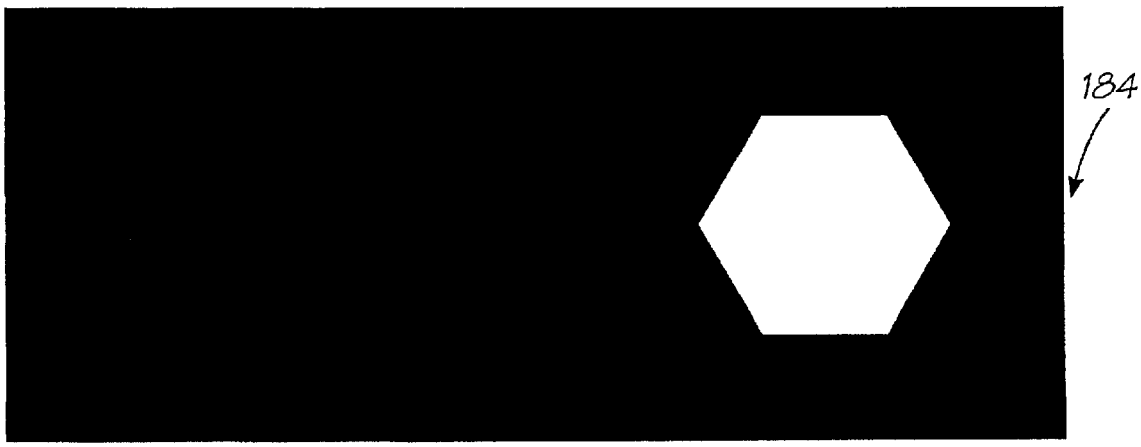
FIGS. 37*a* to 37*k* show layouts of masks used in various steps in the manufacturing process.

Referring now to FIGS. 32 and 33 of the drawings, the nozzle array 112 is described in greater detail. The array 112 is for a four-color printhead. Accordingly, the array 112 includes four groups 166 of nozzle assemblies 110, one for each color. Each group 166 has its nozzle assemblies 110 arranged in two rows 168 and 170. One of the groups 166 is shown in greater detail in FIG. 33 of the drawings.

To facilitate close packing of the nozzle assemblies 110 in the rows 168 and 170, the nozzle assemblies 110 in the row 170 are offset or staggered with respect to the nozzle assemblies 110 in the row 168. Also, the nozzle assemblies 110 in the row 168 are spaced apart sufficiently far from each other to enable the lever arms 124 of the nozzle assemblies 110 in the row 170 to pass between adjacent nozzles 120 of the assemblies 110 in the row 168. It is to be noted that each nozzle assembly 110 is substantially dumbbell shaped so that the nozzles 120 in the row 168 nest between the nozzles 120 and the actuators 126 of adjacent nozzle assemblies 110 in the row 170.

Further, to facilitate close packing of the nozzles 120 in the rows 168 and 170, each nozzle 120 is substantially hexagonally shaped.

It will be appreciated by those skilled in the art that, when the nozzles 120 are displaced towards the substrate 114, in use, due to the nozzle opening 122 being at a slight angle with respect to the nozzle chamber 132, ink is ejected slightly off the perpendicular. It is an advantage of the arrangement shown in FIGS. 32 and 33 of the drawings that the actuators 126 of the nozzle assemblies 110 in the rows 168 and 170 extend in the same direction to one side of the rows 168 and 170. Hence, the ink droplets ejected from the nozzles 120 in the row 168 and the ink droplets ejected from the nozzles 120 in the row 170 are parallel to one another resulting in an improved print quality.

Also, as shown in FIG. 32 of the drawings, the substrate 114 has bond pads 172 arranged thereon which provide the electrical connections, via the pads 152, to the actuators 126 of the nozzle assemblies 110. These electrical connections are formed via the CMOS layer (not shown).

Referring to FIG. 7 of the drawings, a development of the invention is shown. With reference to the previous drawings; like reference numerals refer to like parts, unless otherwise specified.

A nozzle guard 174 is mounted on the substrate 114 of the array 112. The nozzle guard 174 includes a planar cover member 176 having a plurality of passages 178 defined therethrough. The passages 178 are in register with the nozzle openings 122 of the nozzle assemblies 110 of the array 112 such that, when ink is ejected from any one of the nozzle openings 122, the ink passes through the associated passage 178 before striking the print media.

The cover member 176 is mounted in spaced relationship relative to the nozzle assemblies 110 by a support structure in the form of limbs or struts 180. One of the struts 180 has nitrogen inlet openings 182 defined therein.

The cover member 176 and the struts 180 are of a wafer substrate. Thus, the passages 178 are formed with a suitable etching process carried out on the cover member 176. The cover member 176 has a thickness of not more than approximately 300 microns. This speeds the etching process. Thus, the manufacturing cost is minimized by reducing etch time.

In use, when the array 112 is in operation, nitrogen is charged through the inlet openings 182 to be forced through the passages 178 together with ink travelling through the passages 178.

The ink is not entrained in the nitrogen since the nitrogen is charged through the passages 178 at a different velocity from that of the ink droplets 160. For example, the ink droplets 160 are ejected from the nozzles 120 at a velocity of approximately 3 m/s. The nitrogen is charged through the passages 178 at a velocity of approximately 1 m/s.

The purpose of the nitrogen is to maintain the passages 178 clear of foreign particles. A danger exists that these foreign particles, such as dust particles, could fall onto the nozzle assemblies 110 adversely affecting their operation. With the provision of the nitrogen inlet openings 182 in the nozzle guard 174 this problem is, to a large extent, obviated.

The nitrogen also serves the purpose of providing an inert environment for the nozzle assemblies 110 in which to operate. As set out above, the actuators 126 oscillate at very high frequencies in order to achieve the high printing speeds. These must be maintained for long periods of time, especially during commercial printing operations. The actuators 126 operate most efficiently when they are at high temperatures. In a normal air-based environment, oxidation of the actuator can occur as a result of the heat and frequency of oscillation. This oxidation can lead to destruction and subsequent failure of the nozzle assemblies 110.

The fact that the nozzle assemblies 110 are in a nitrogen-based environment ensures that oxidation is inhibited. Thus, the nozzle assemblies can be operated at optimal temperatures and high frequencies without the danger of failure.

Referring now to FIGS. 35 to 37 of the drawings, a process for manufacturing the nozzle assemblies 110 is described.

Starting with the silicon substrate or wafer 114, the dielectric layer 116 is deposited on a surface of the wafer 114. The dielectric layer 116 is in the form of approximately 1.5 microns of CVD oxide. Resist is spun on to the layer 116 and the layer 116 is exposed to mask 184 and is subsequently developed.

After being developed, the layer 116 is plasma etched down to the silicon layer 114. The resist is then stripped and the layer 116 is cleaned. This step defines the ink inlet aperture 140.

Figure 35A:
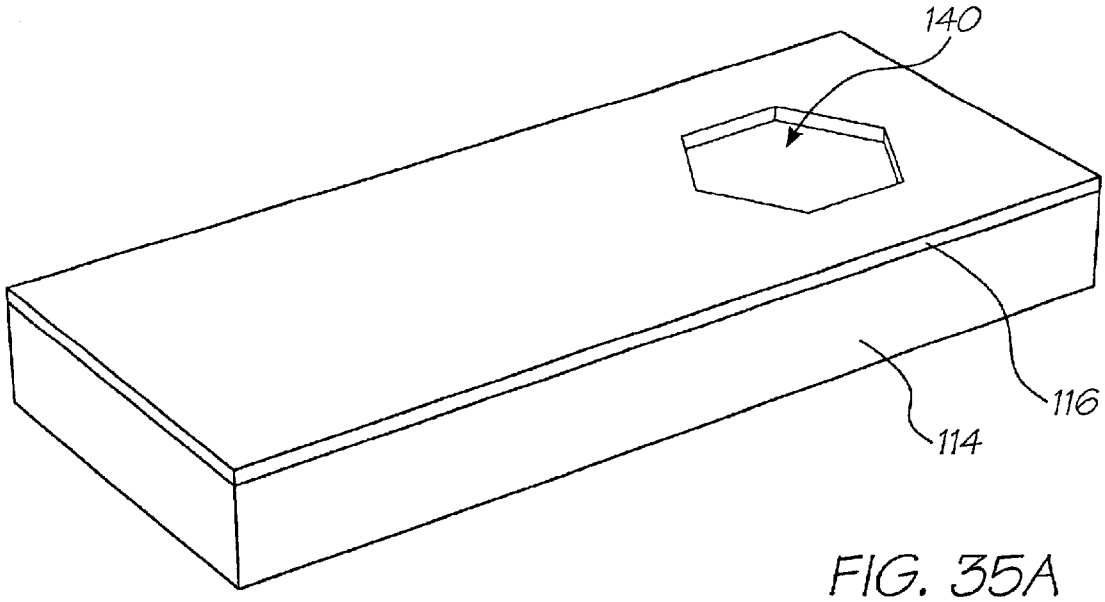
FIGS. 35*a* to 35*r* show three-dimensional views of steps in the manufacture of a nozzle assembly of the ink jet printhead chip.
Figure 35B:
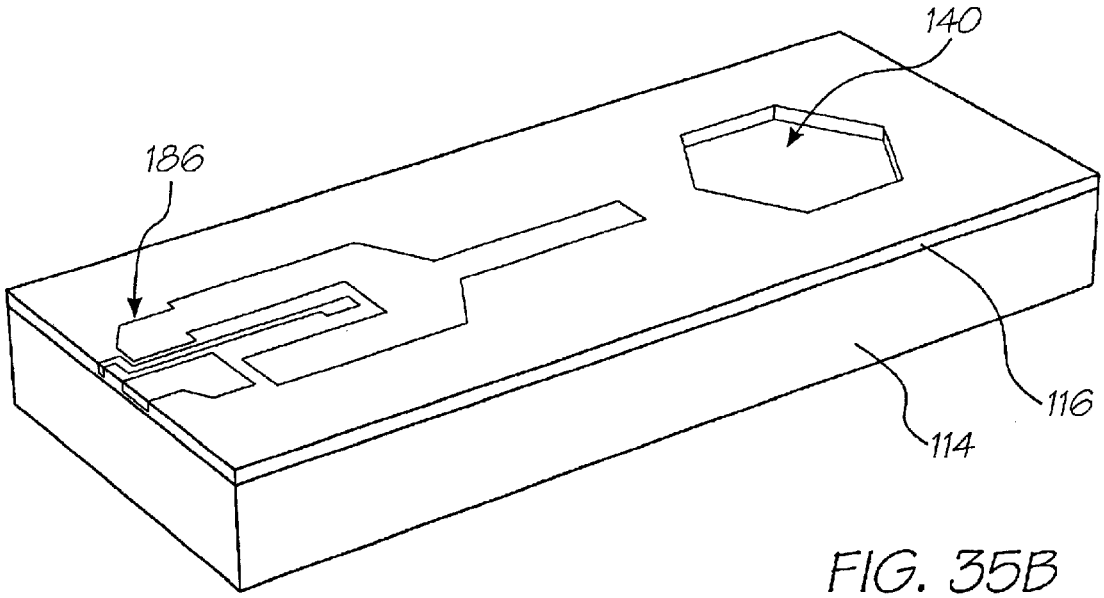
Figure 36B:
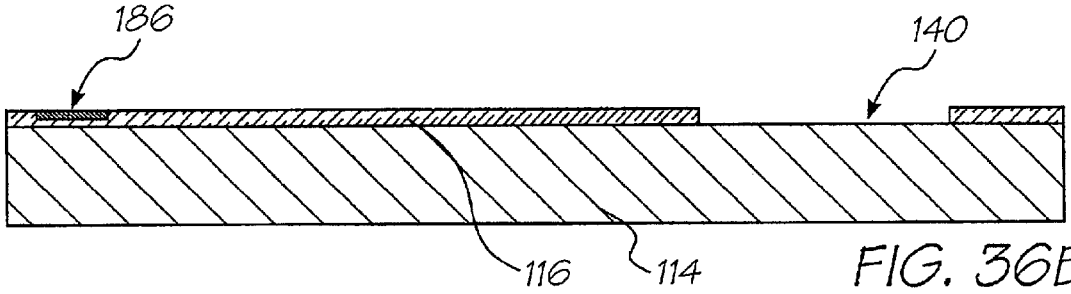
Figure 37B:
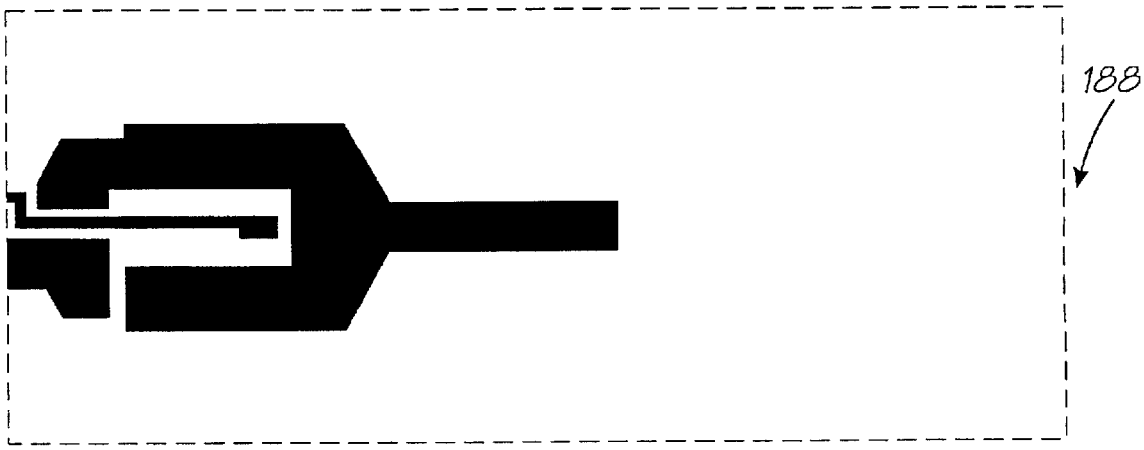
Figure 35C:
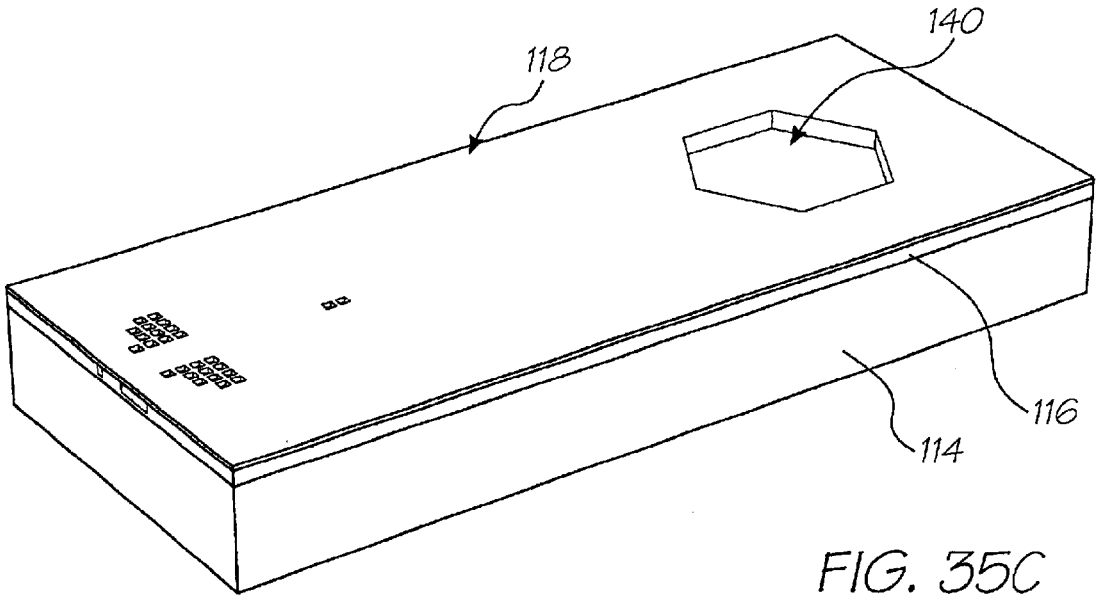
Figure 36C:
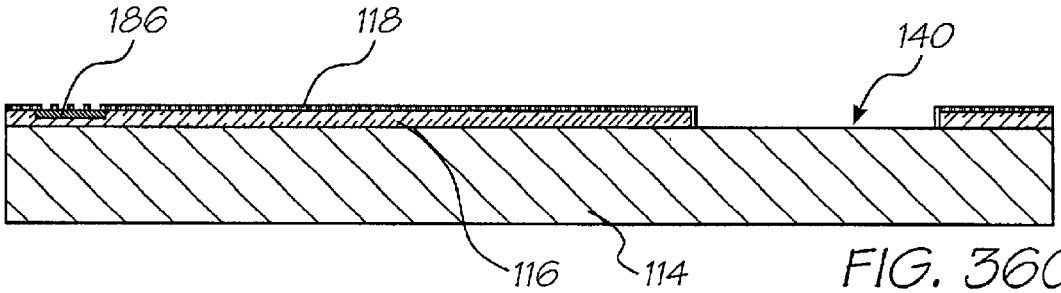
Figure 37C:
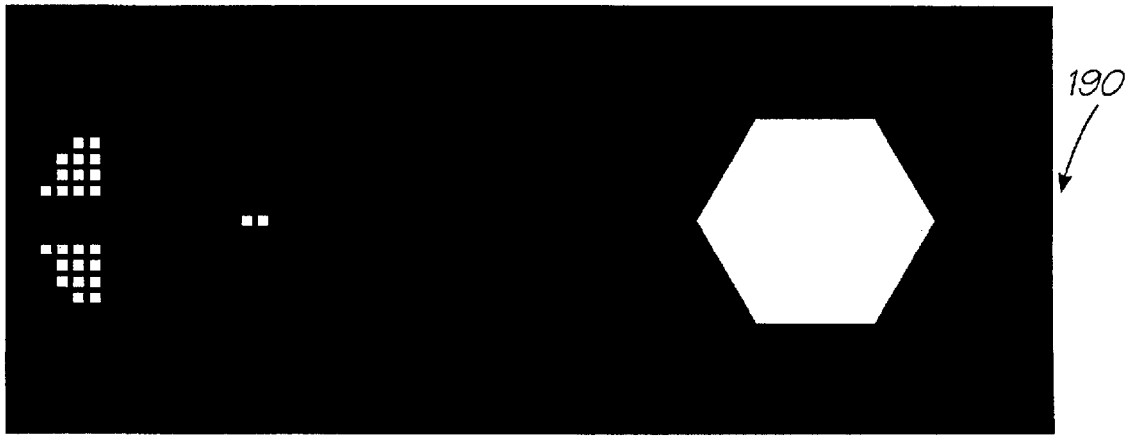
Figure 35D:
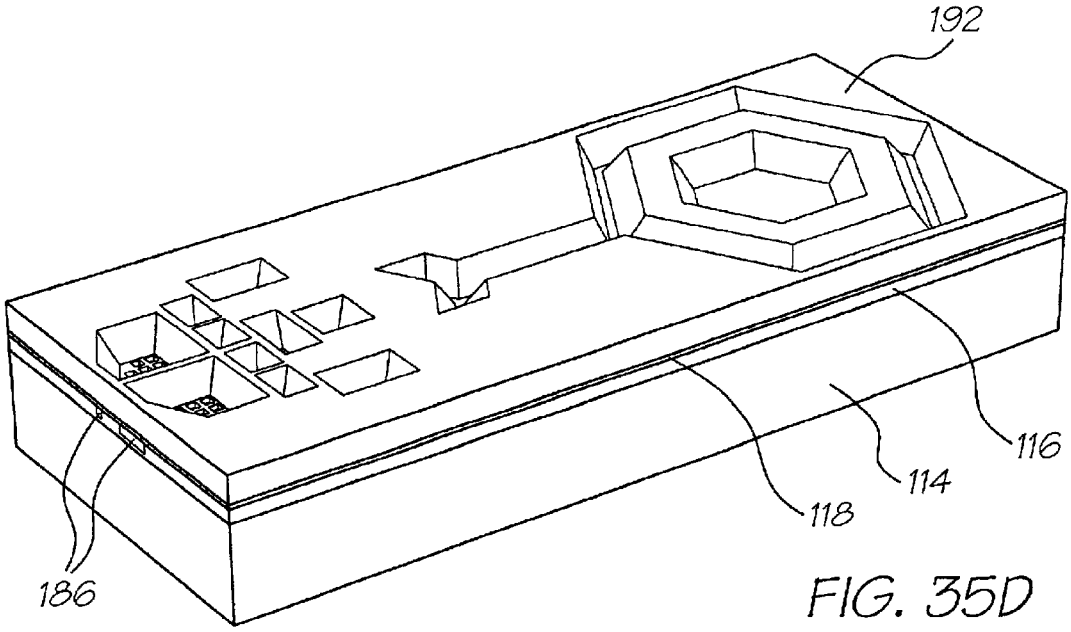
Figure 36D:
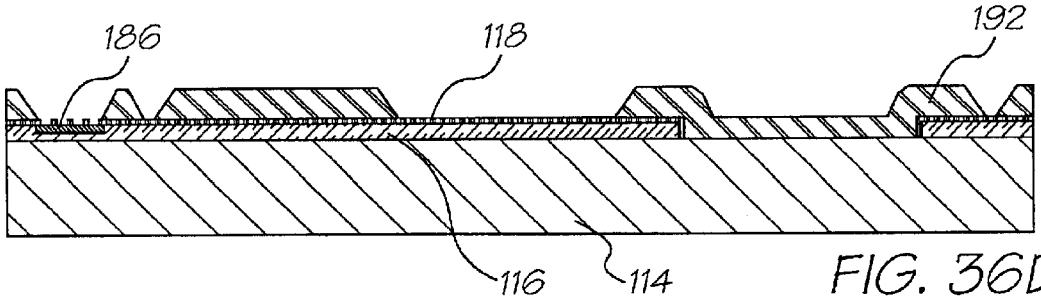
Figure 37D:
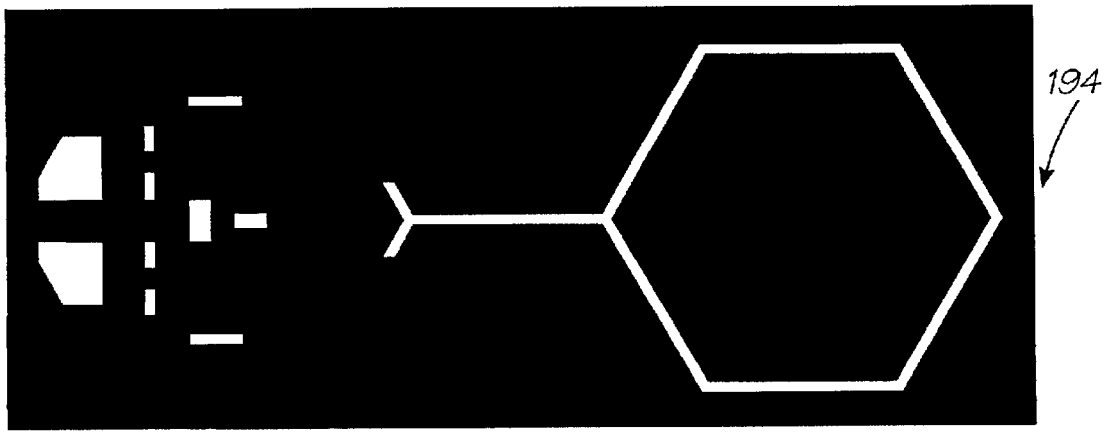

In FIG. 35*b* of the drawings, approximately 0.8 microns of aluminum 186 is deposited on the layer 116. Resist is spun on and the aluminum 186 is exposed to mask 188 and developed. The aluminum 186 is plasma etched down to the oxide layer 116, the resist is stripped and the device is cleaned. This step provides bond pads and interconnects to the ink jet actuator 126. This interconnect is to an NMOS drive transistor and a power plane with connections made in the CMOS layer (not shown).

Approximately 0.5 microns of PECVD nitride is deposited as the CMOS passivation layer 118. Resist is spun on and the layer 118 is exposed to mask 190 whereafter it is developed. After development, the nitride is plasma etched down to the aluminum layer 186 and the silicon layer 114 in the region of the inlet aperture 140. The resist is stripped and the device cleaned.

A layer 192 of a sacrificial material is spun on to the layer 118. The layer 192 is 6 microns of photosensitive polyimide or approximately 4 $\mu$m of high temperature resist. The layer 192 is softbaked and is then exposed to mask 194 whereafter it is developed. The layer 192 is then hardbaked at 400° C. for one hour where the layer 192 is comprised of polyimide or at greater than 300° C. where the layer 192 is high temperature resist. It is to be noted in the drawings that the pattern-dependent distortion of the polyimide layer 192 caused by shrinkage is taken into account in the design of the mask 194.

Figure 35E:
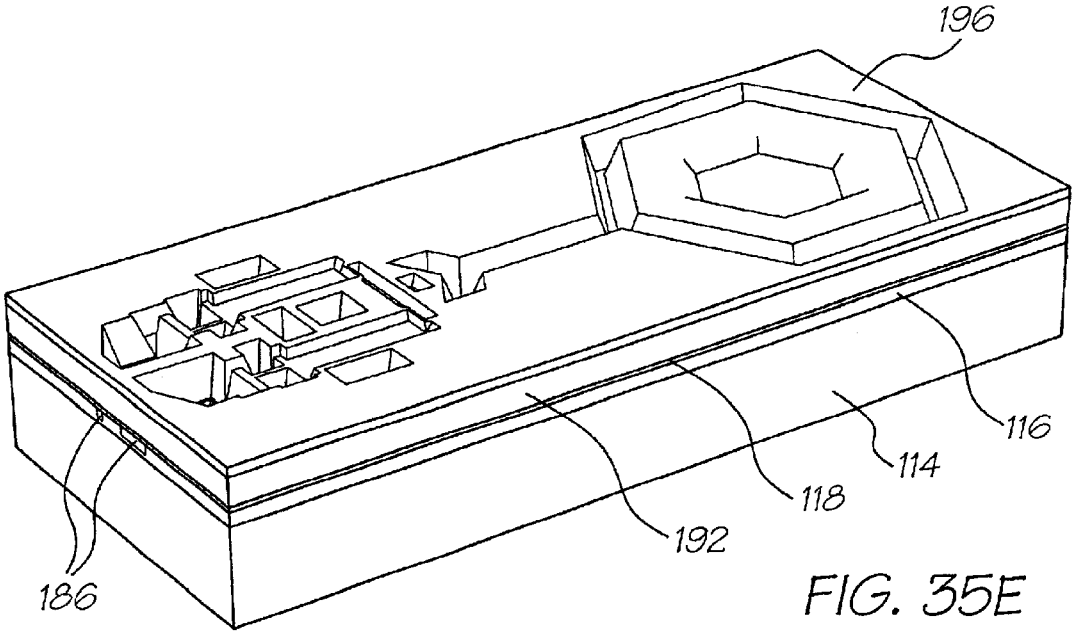
Figure 37E:
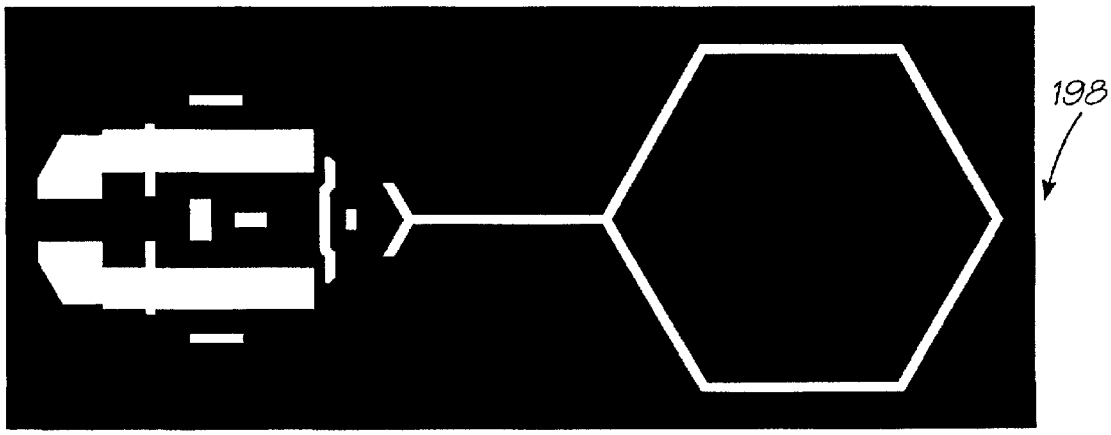
Figure 35F:
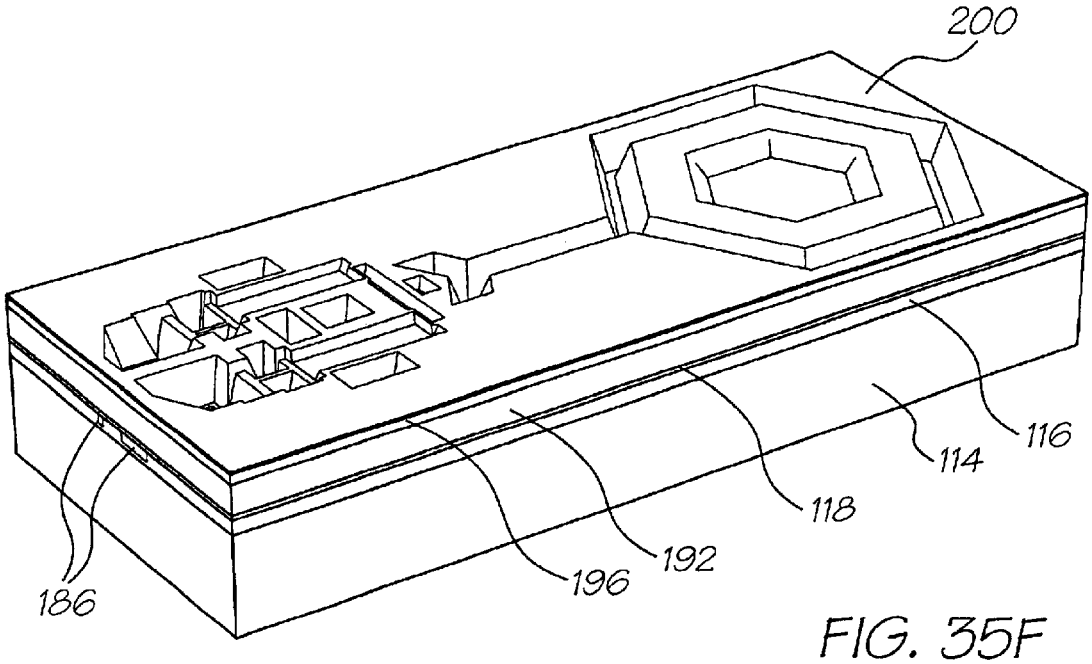
Figure 35G:
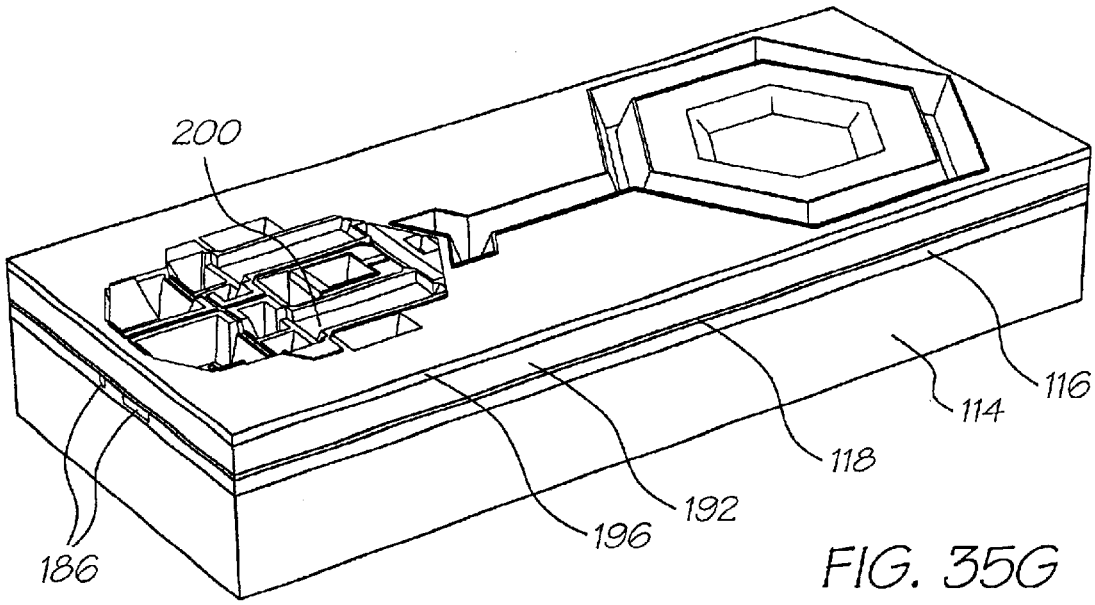
Figure 37F:
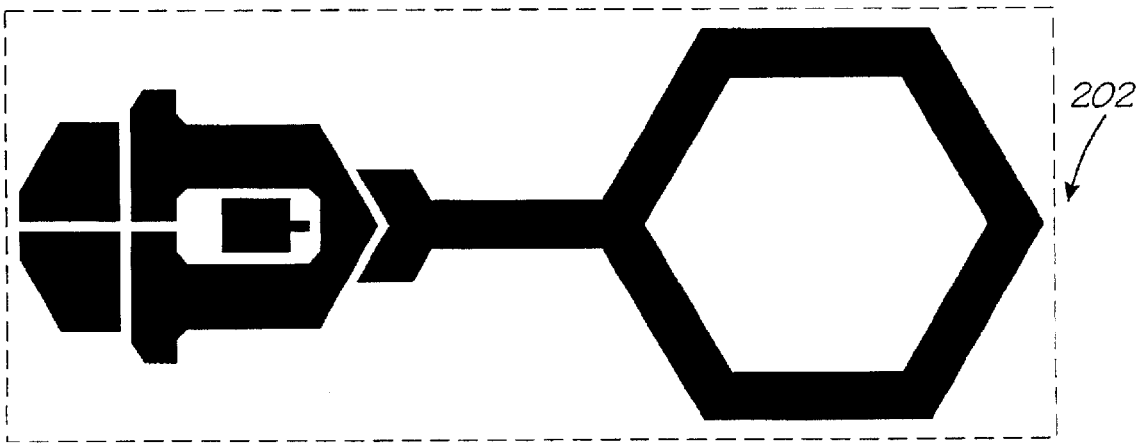
Figure 35H:
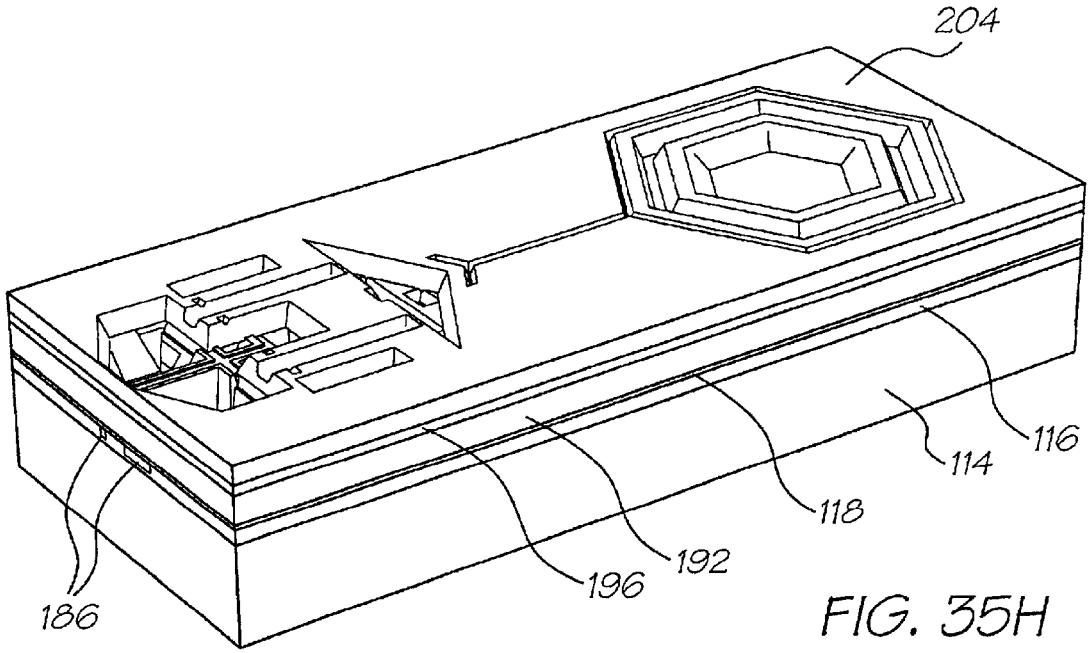
Figure 37G:
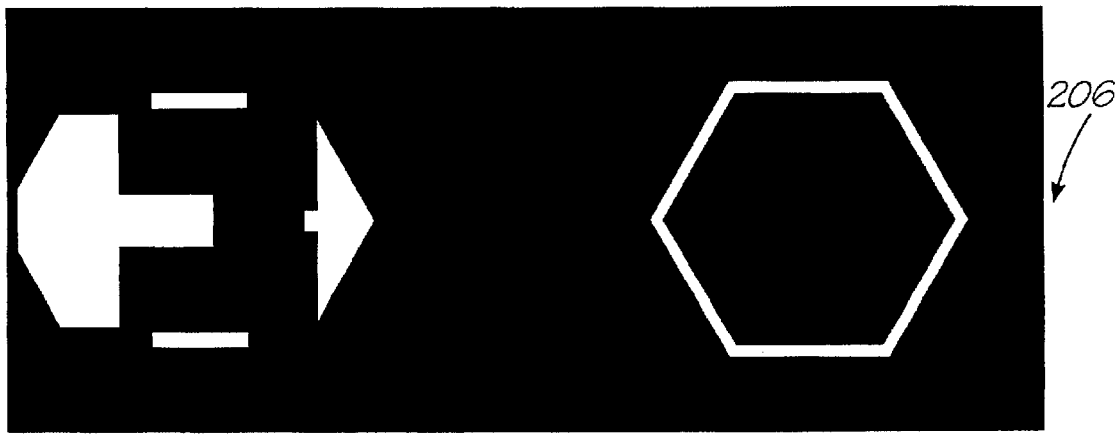
Figure 351:
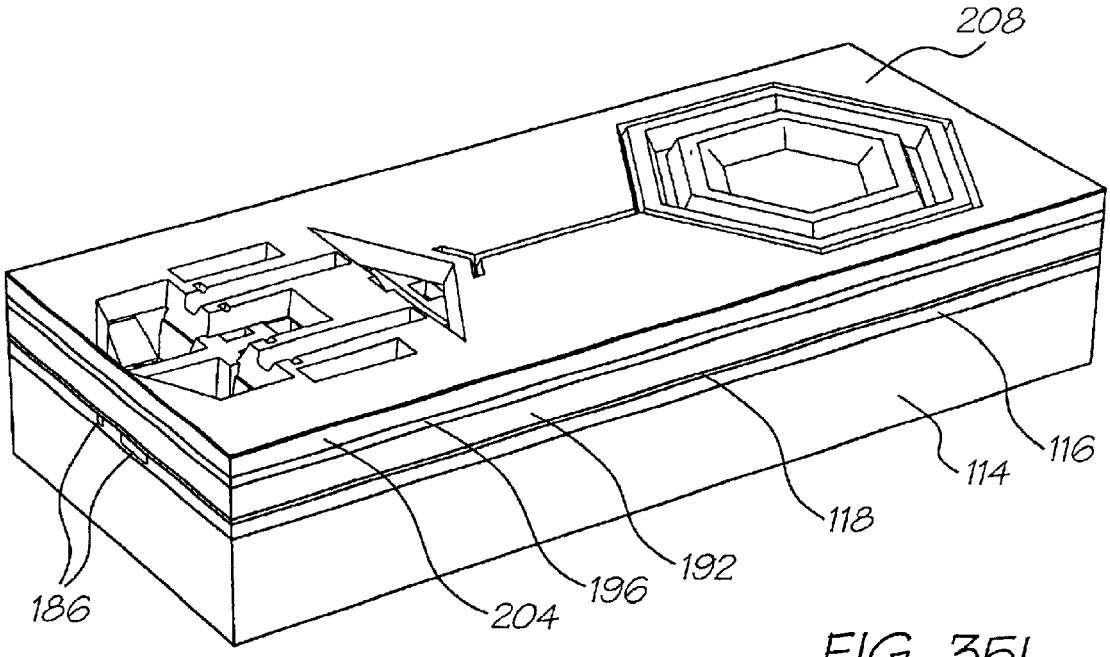
Figure 361:
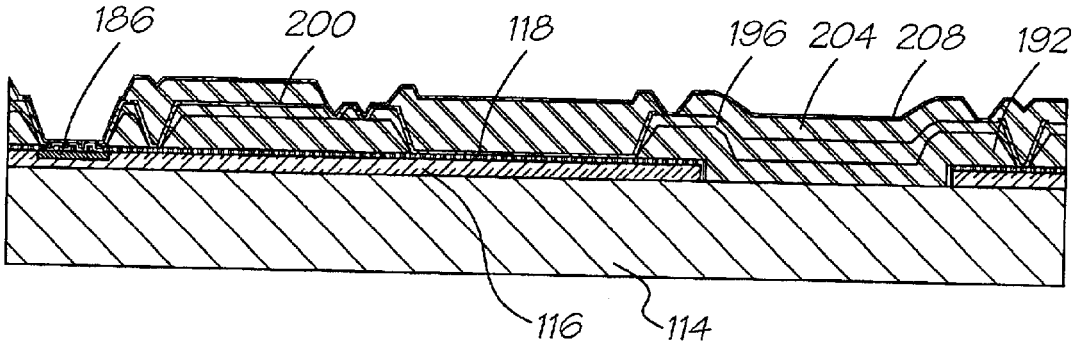
Figure 35J:
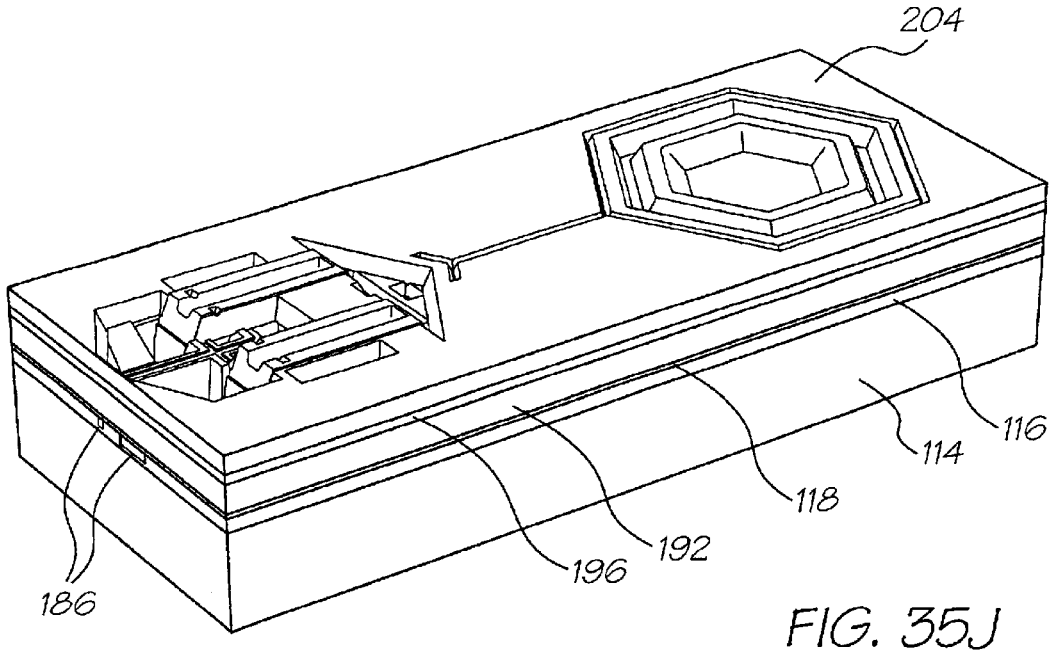
Figure 37H:
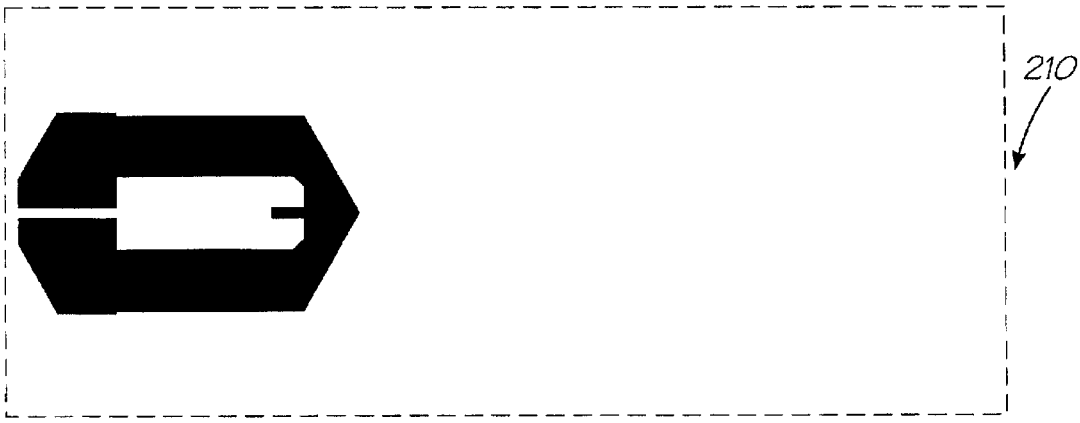
Figure 35K:
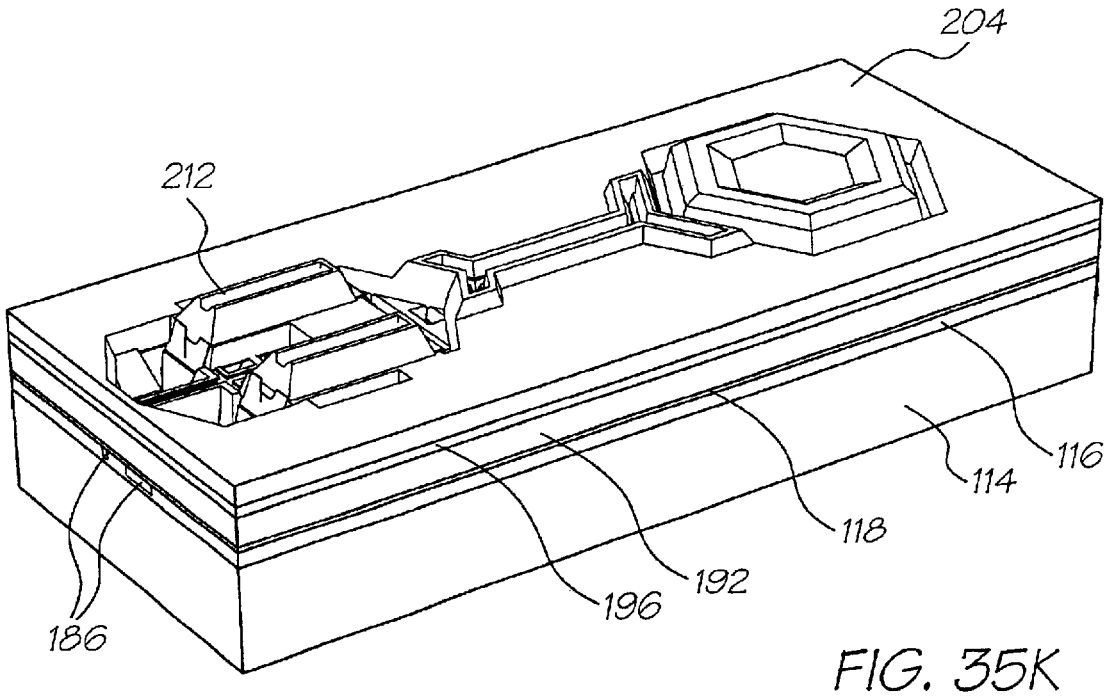

In the next step, shown in FIG. 35*e* of the drawings, a second sacrificial layer 196 is applied. The layer 196 is either 2 microns of photosensitive polyimide, which is spun on, or approximately 1.3 microns of high temperature resist. The layer 196 is softbaked and exposed to mask 198. After exposure to the mask 198, the layer 196 is developed. In the case of the layer 196 being polyimide, the layer 196 is hardbaked at 400° C. for approximately one hour. Where the layer 196 is resist, it is hardbaked at greater than 300° C. for approximately one hour.

A 0.2 micron multi-layer metal layer 200 is then deposited. Part of this layer 200 forms the passive beam 156 of the actuator 126.

The layer 200 is formed by sputtering 1,000 Å of titanium nitride (TiN) at around 300° C. followed by sputtering 50 Å of tantalum nitride (TaN). A further 1,000 Å of TiN is sputtered on followed by 50 Å of TaN, and a further 1,000 Å of TiN.

Other materials, which can be used instead of TiN, are $TiB_2$, $MoSi_2$ or (Ti, Al)N.

The layer 200 is then exposed to mask 202, developed and plasma etched down to the layer 196 whereafter resist, applied to the layer 200, is wet stripped taking care not to remove the cured layers 192 or 196.

A third sacrificial layer 204 is applied by spinning on 4 microns of photosensitive polyimide or approximately 2.6 microns high temperature resist. The layer 204 is softbaked whereafter it is exposed to mask 206. The exposed layer is then developed followed by hardbaking. In the case of polyimide, the layer 204 is hardbaked at 400° C. for approximately one hour or at greater than 300° C. where the layer 204 comprises resist.

A second multi-layer metal layer 208 is applied to the layer 204. The constituents of the layer 208 are the same as the layer 200 and are applied in the same manner. It will be appreciated that both layers 200 and 208 are electrically conductive layers.

The layer 208 is exposed to mask 210 and is then developed. The layer 208 is plasma etched down to the polyimide or resist layer 204 whereafter resist applied for the layer 208 is wet stripped taking care not to remove the cured layers 192, 196 or 204. It will be noted that the remaining part of the layer 208 defines the active beam 154 of the actuator 126.

Figure 36E:
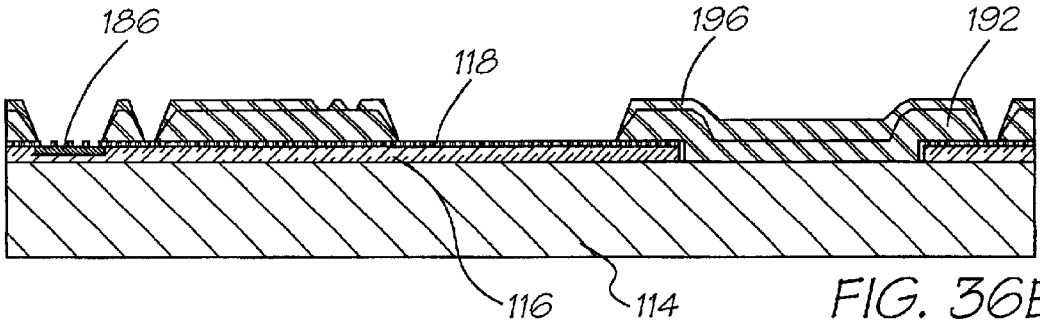
Figure 36F:
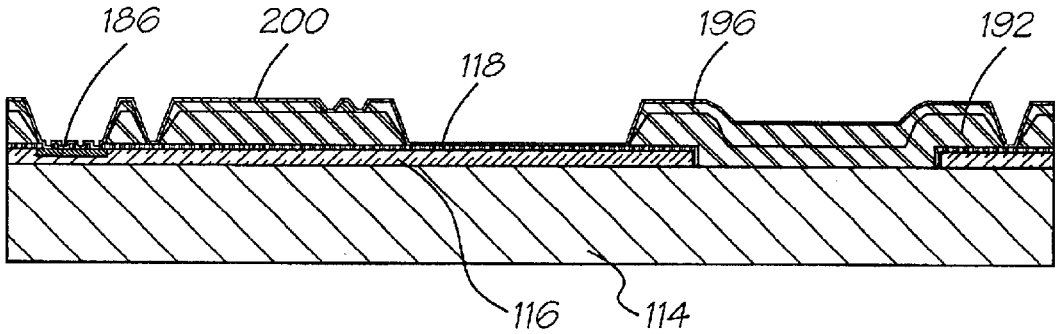
Figure 36G:
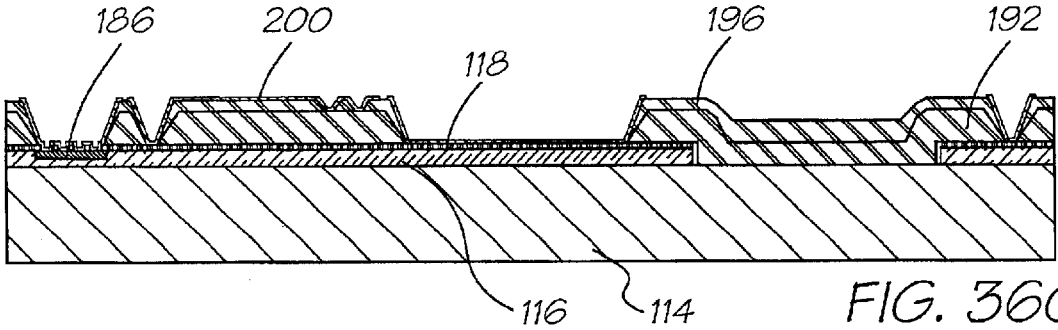
Figure 36H:
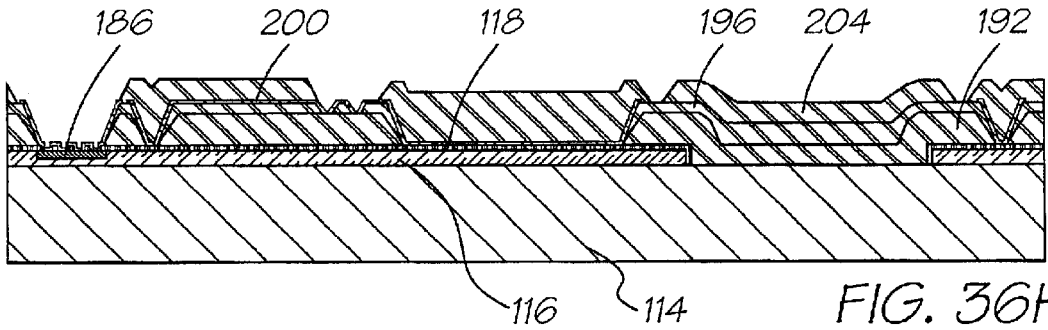
Figure 36J:
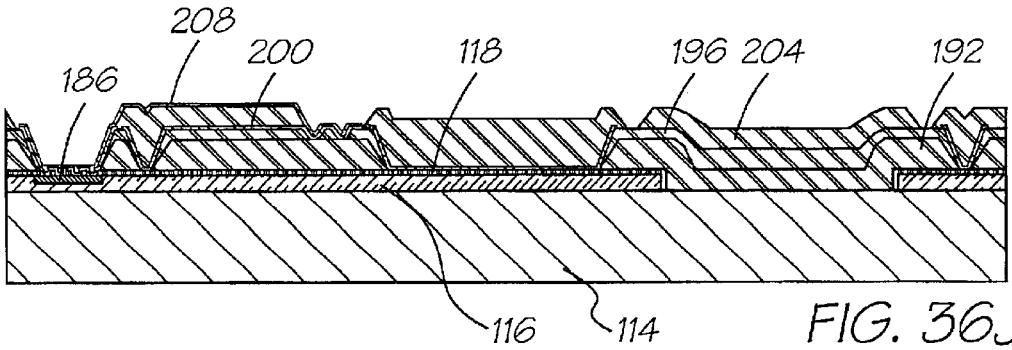
Figure 36K:
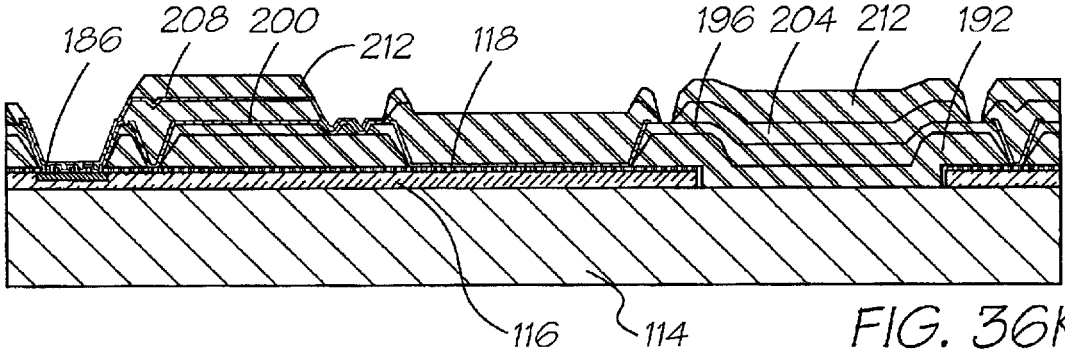
Figure 37I:
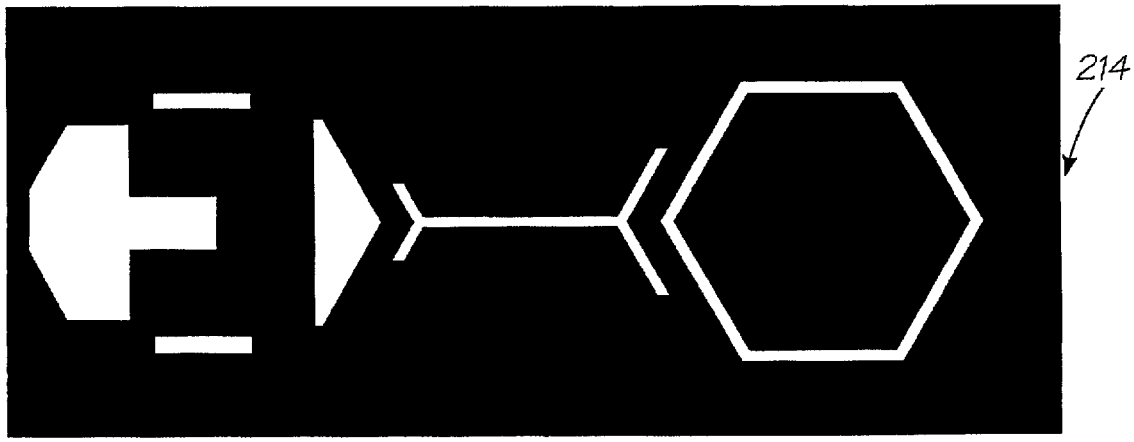

A fourth sacrificial layer 212 is applied by spinning on 4 microns of photosensitive polyimide or approximately 2.6 microns of high temperature resist. The layer 212 is softbaked, exposed to the mask 214 and is then developed to leave the island portions as shown in FIG. 36*k* of the drawings. The remaining portions of the layer 212 are hardbaked at 400° C. for approximately one hour in the case of polyimide or at greater than 300° C. for resist.

Figure 35L:
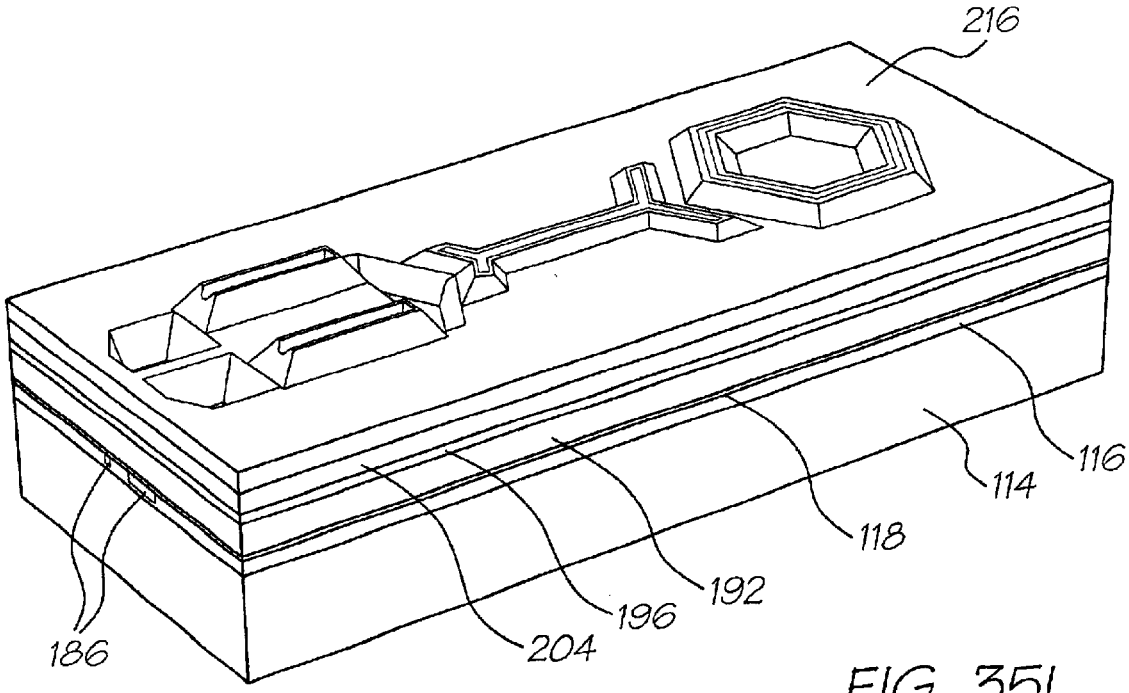
Figure 36L:
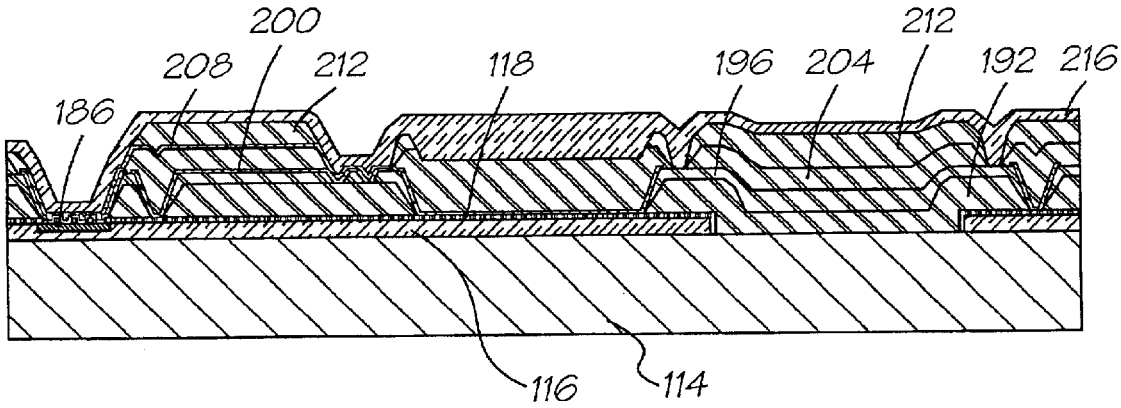
Figure 35M:
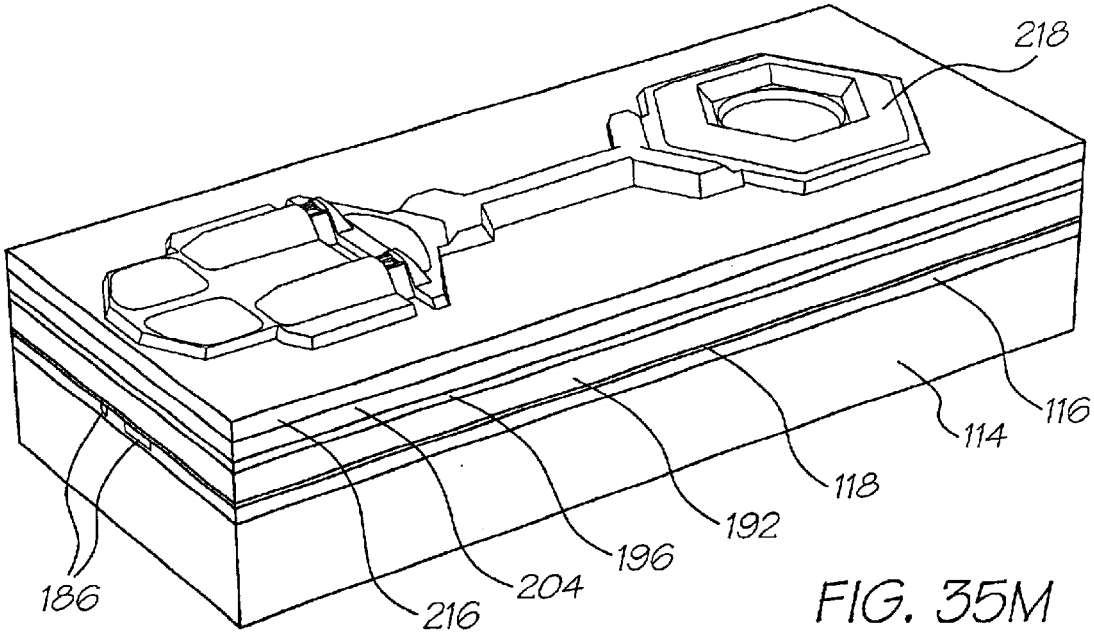
Figure 36M:
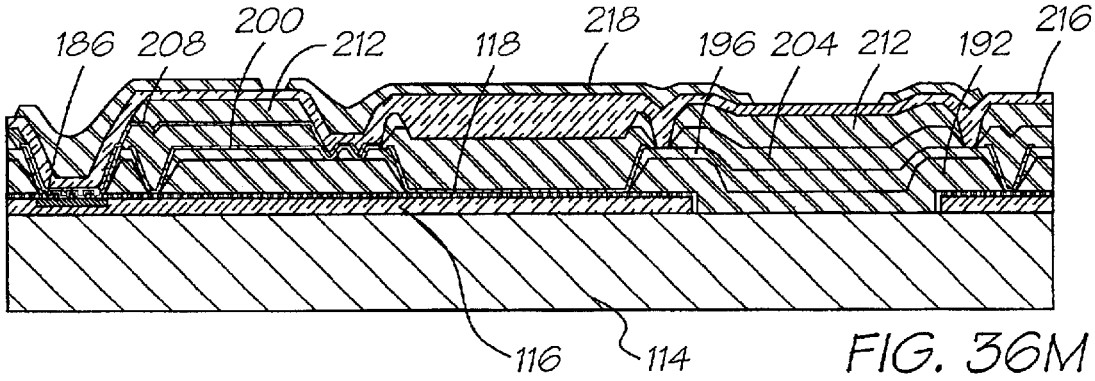
Figure 37J:
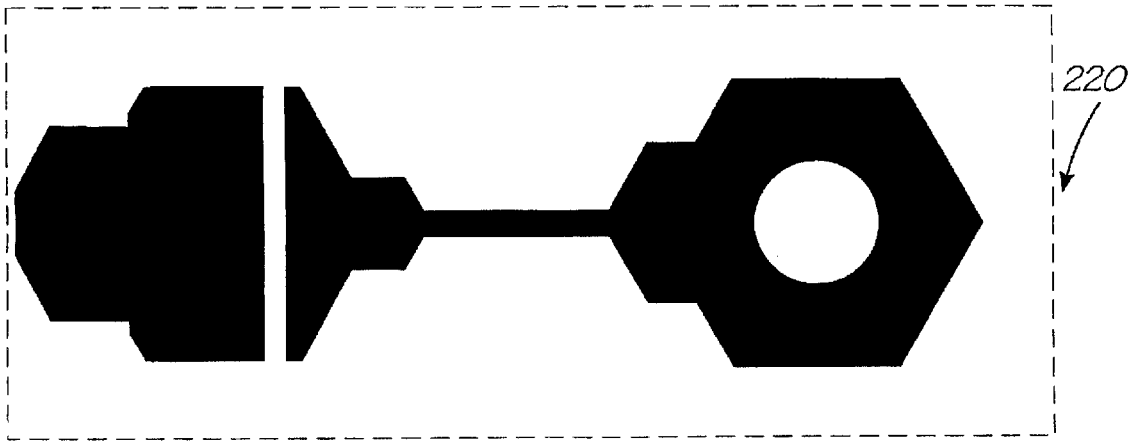
Figure 35N:
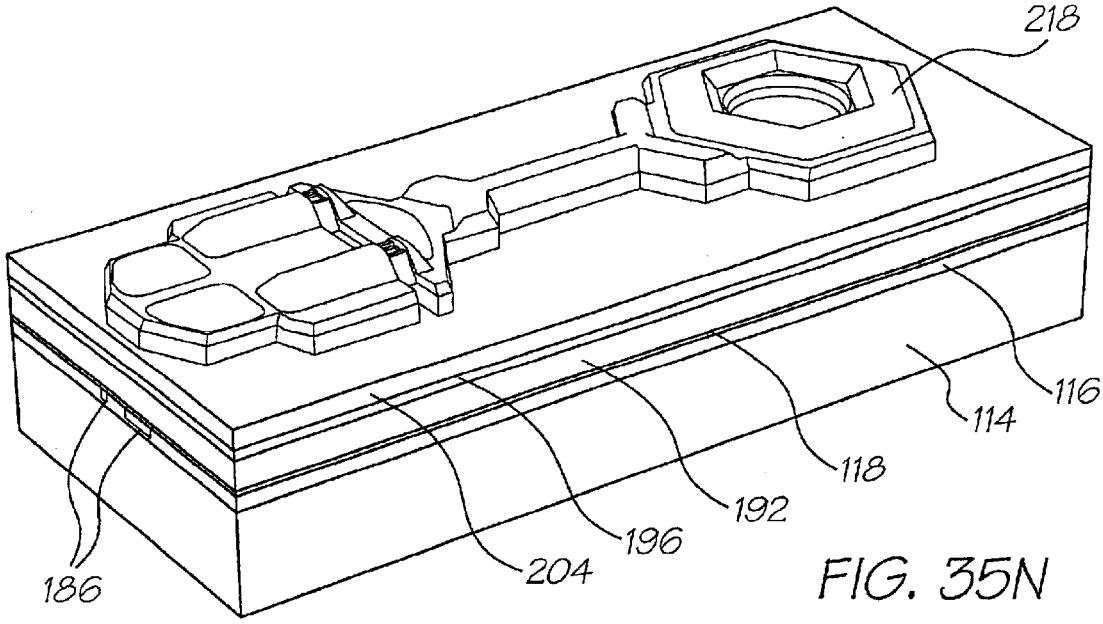
Figure 36N:
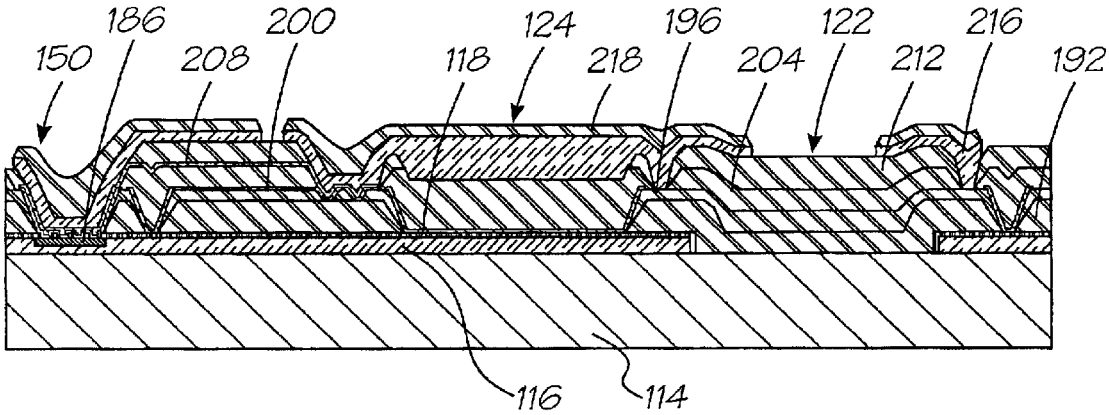
Figure 350:
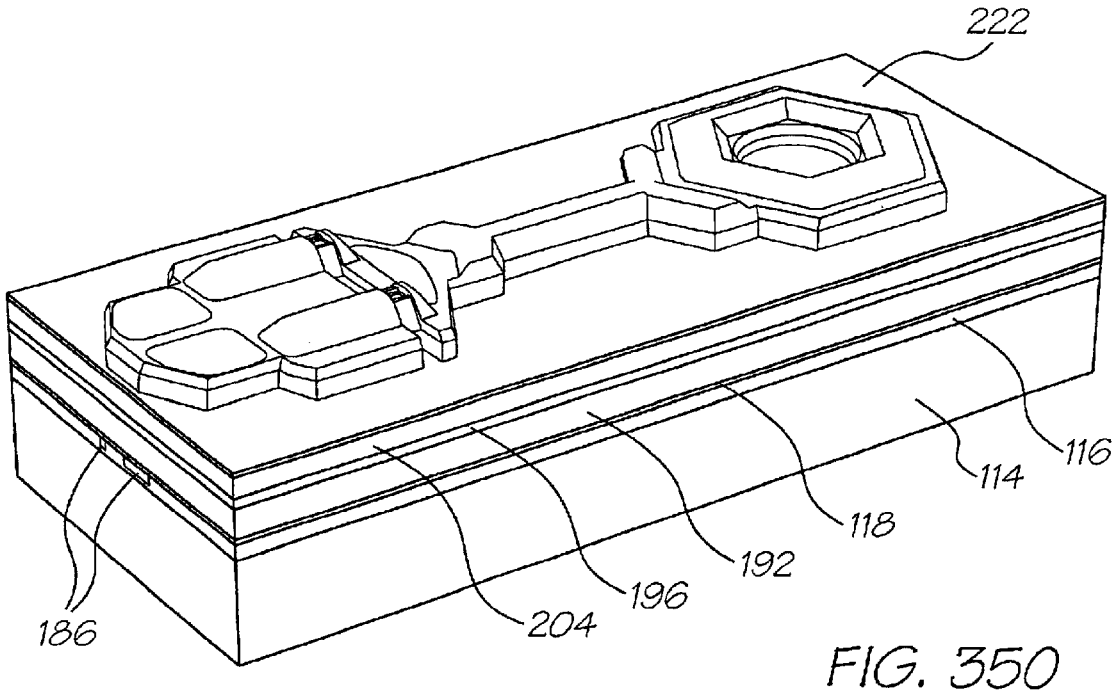
Figure 360:
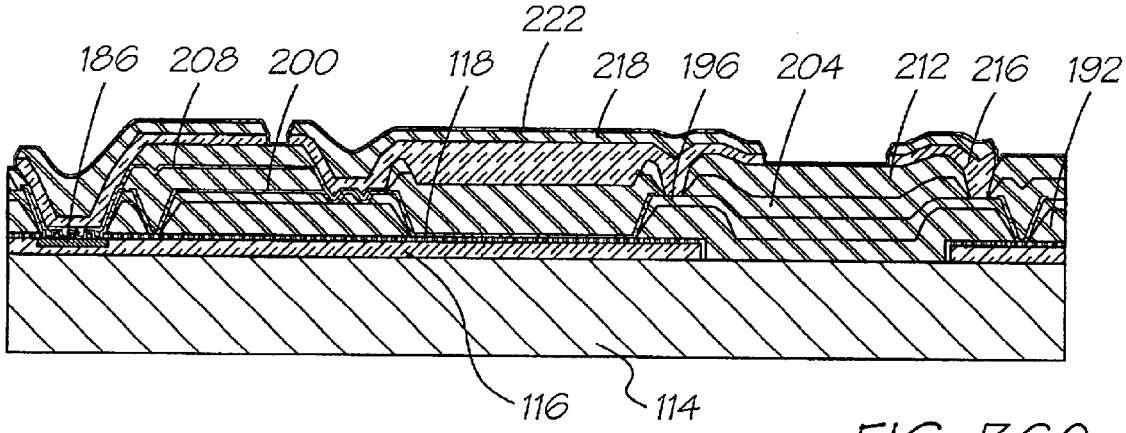

As shown in FIG. 35*l* of the drawing a high Young's modulus dielectric layer 216 is deposited. The layer 216 is constituted by approximately 1 micron of silicon nitride or aluminum oxide. The layer 216 is deposited at a temperature below the hardbaked temperature of the sacrificial layers 192, 196, 204, 212. The primary characteristics required for this dielectric layer 216 are a high elastic modulus, chemical inertness and good adhesion to TiN.

A fifth sacrificial layer 218 is applied by spinning on 2 microns of photosensitive polyimide or approximately 1.3 microns of high temperature resist. The layer 218 is softbaked, exposed to mask 220 and developed. The remaining portion of the layer 218 is then hardbaked at 400° C. for one hour in the case of the polyimide or at greater than 300° C. for the resist.

The dielectric layer 216 is plasma etched down to the sacrificial layer 212 taking care not to remove any of the sacrificial layer 218.

This step defines the nozzle opening 122, the lever arm 124 and the anchor 150 of the nozzle assembly 110.

A high Young's modulus dielectric layer 222 is deposited. This layer 222 is formed by depositing 0.2 microns of silicon nitride or aluminum nitride at a temperature below the hardbaked temperature of the sacrificial layers 192, 196, 204 and 212.

Figure 35P:
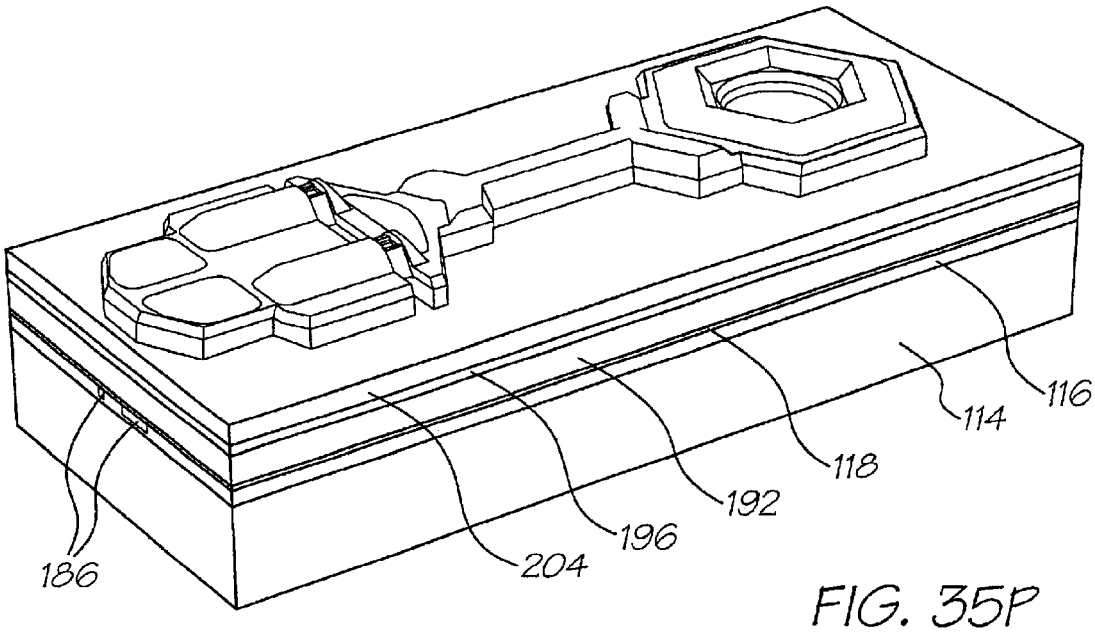
Figure 36P:
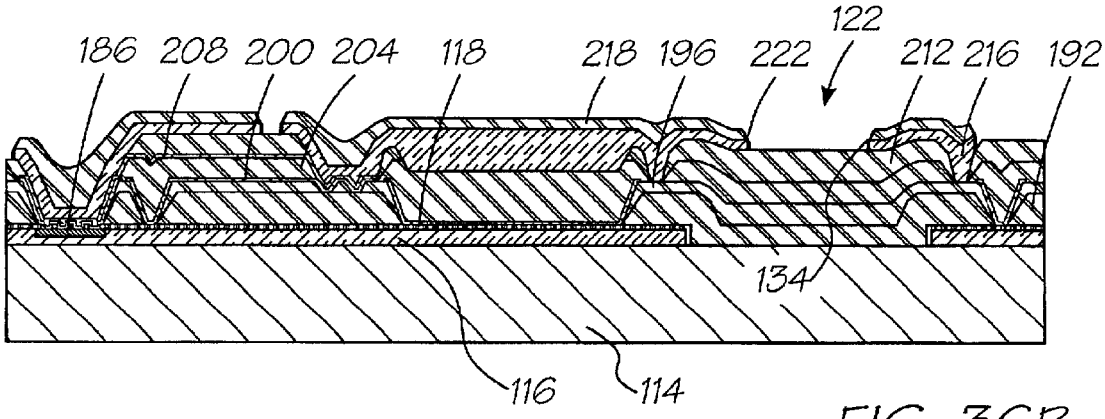
Figure 35Q:
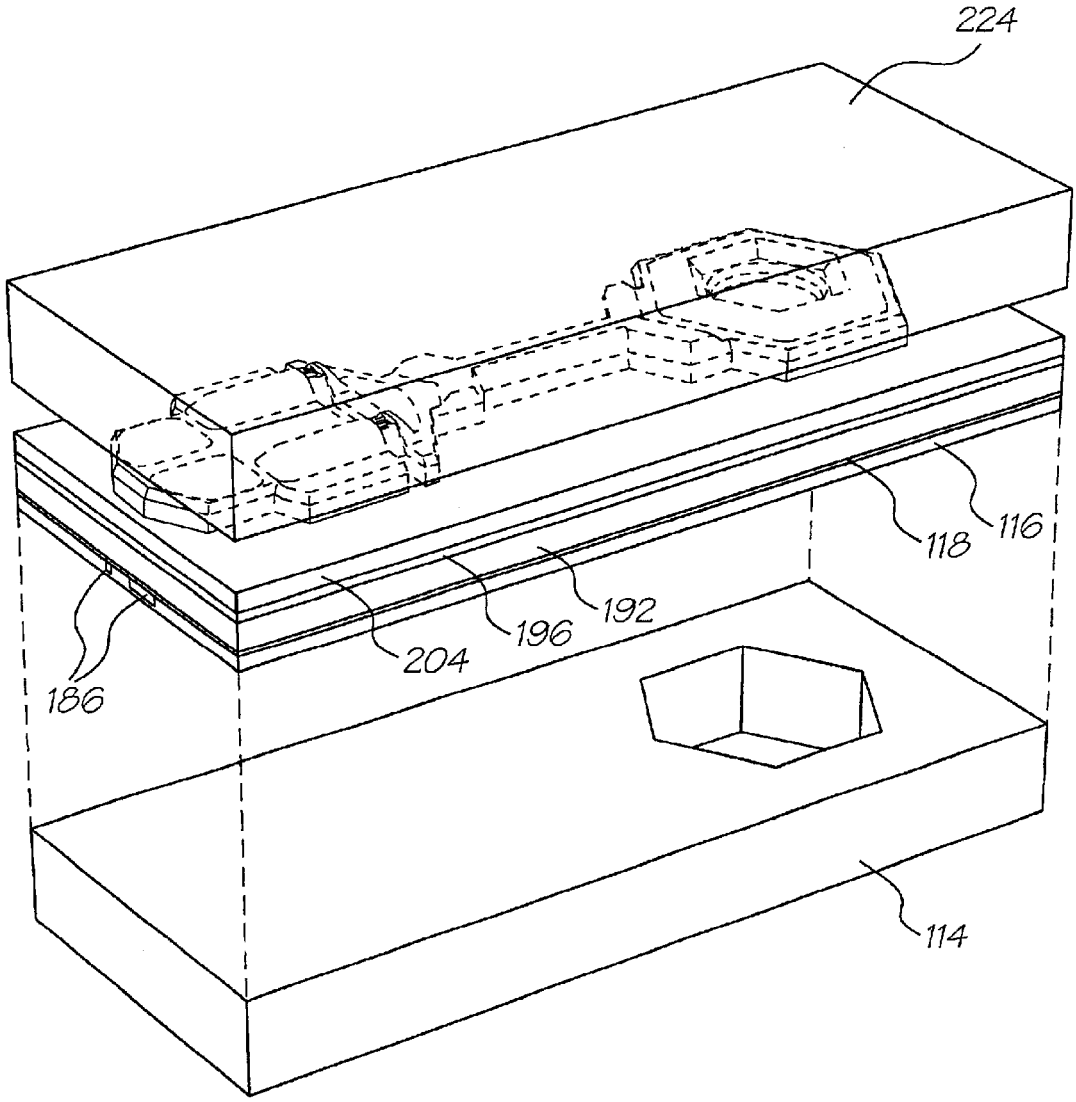

Then, as shown in FIG. 35*p* of the drawings, the layer 222 is anisotropically plasma etched to a depth of 0.35 microns. This etch is intended to clear the dielectric from the entire surface except the sidewalls of the dielectric layer 216 and the sacrificial layer 218. This step creates the nozzle rim 134 around the nozzle opening 122, which "pins" the meniscus of ink, as described above.

An ultraviolet (UV) release tape 224 is applied. 4 microns of resist is spun on to a rear of the silicon wafer 114. The wafer 114 is exposed to mask 226 to back etch the wafer 114 to define the ink inlet channel 144. The resist is then stripped from the wafer 114.

Figure 35R:
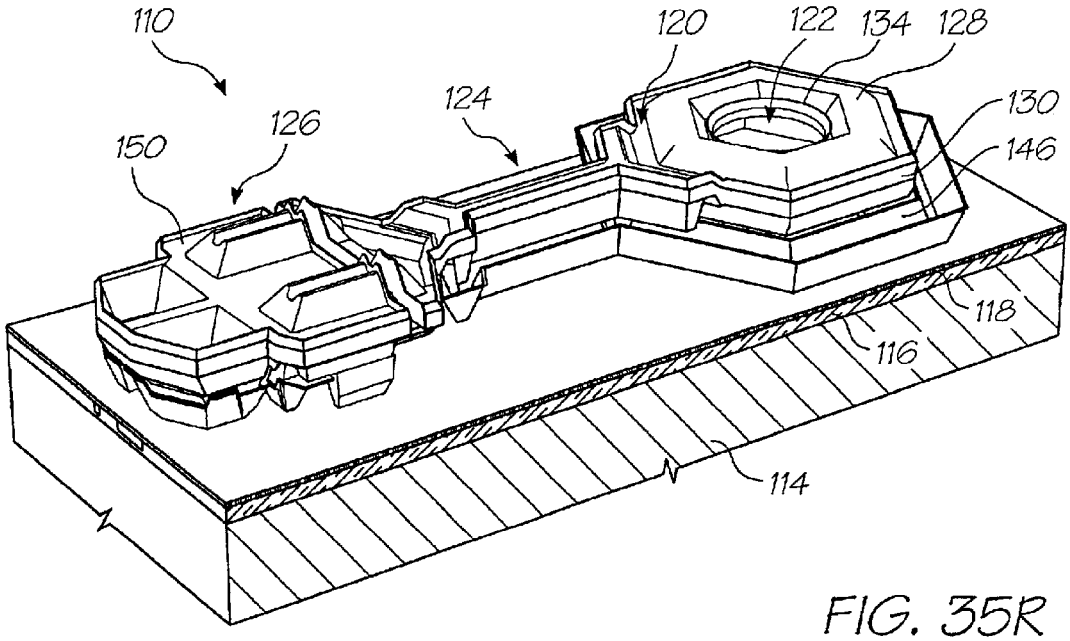
Figure 36R:
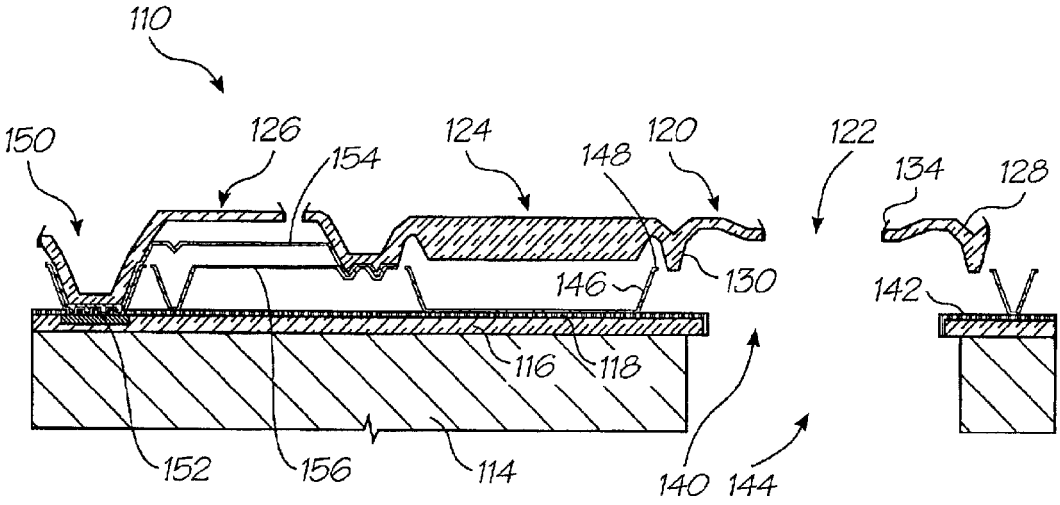
Figure 36Q:
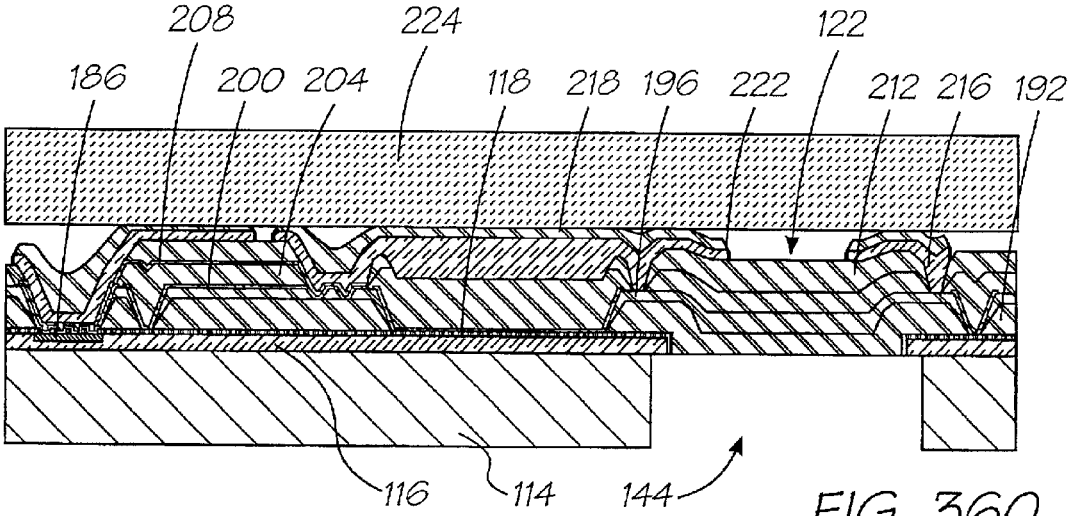
Figure 37K:
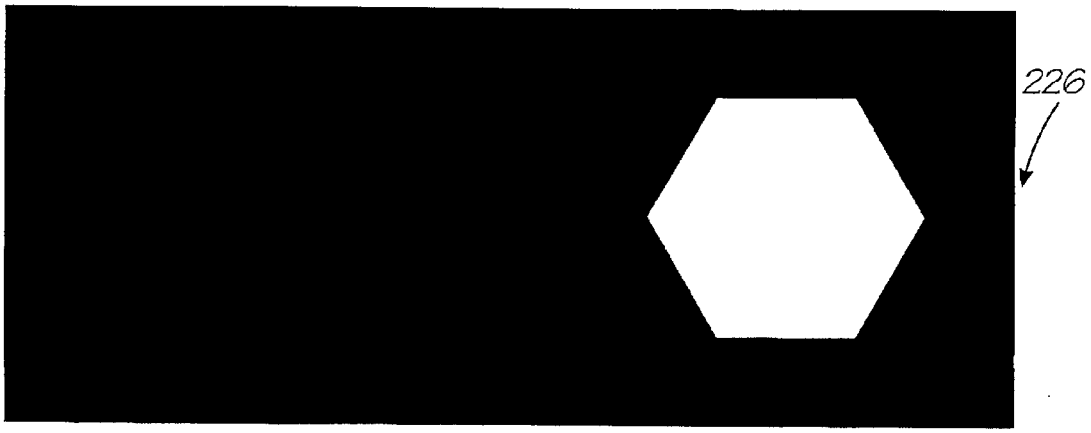
Figure 38A:
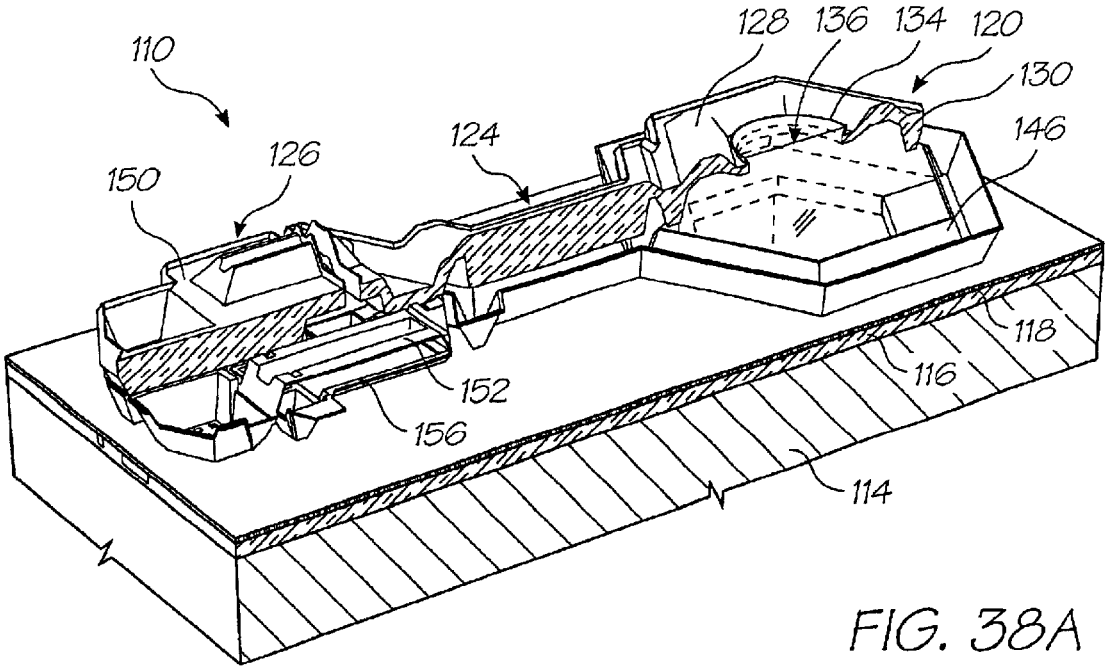
FIGS. 38*a* to 38*c* show three-dimensional views of an operation of the nozzle assembly manufactured according to the method of FIGS. 35 and 36.
Figure 39A:
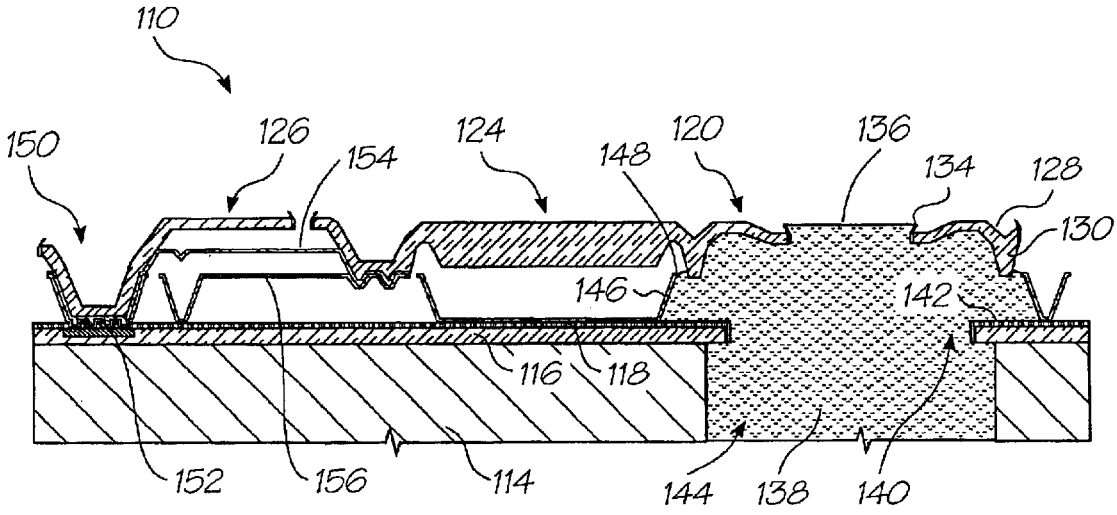
FIGS. 39*a* to 39*c* show sectional side views of an operation of the nozzle assembly manufactured according to the method of FIGS. 35 and 36.
Figure 38B:
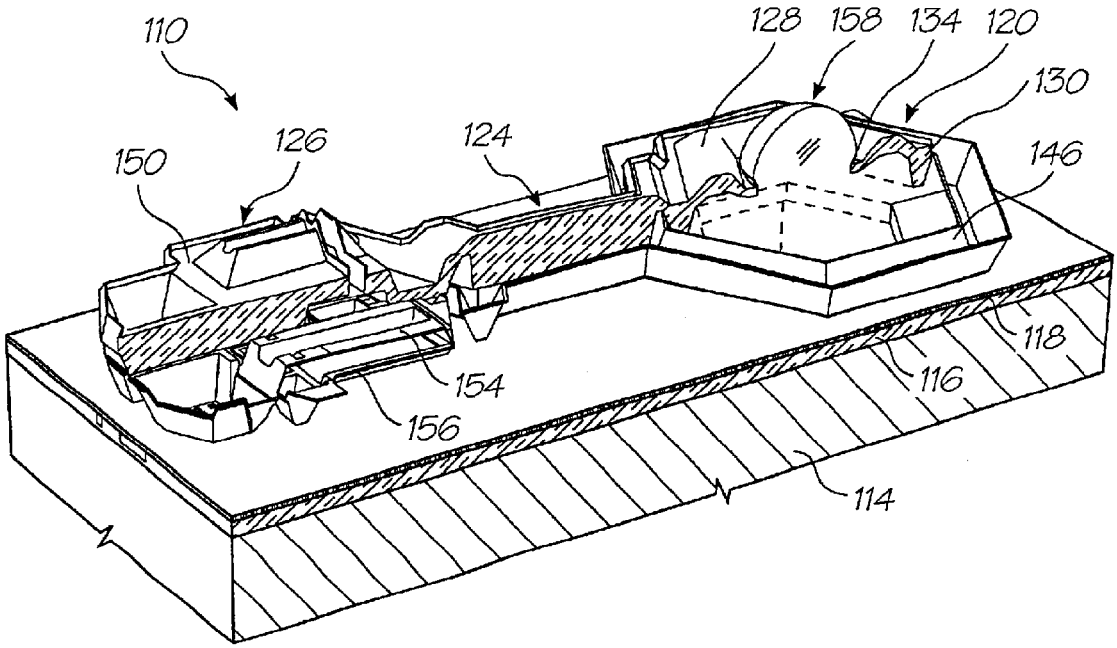
Figure 39B:
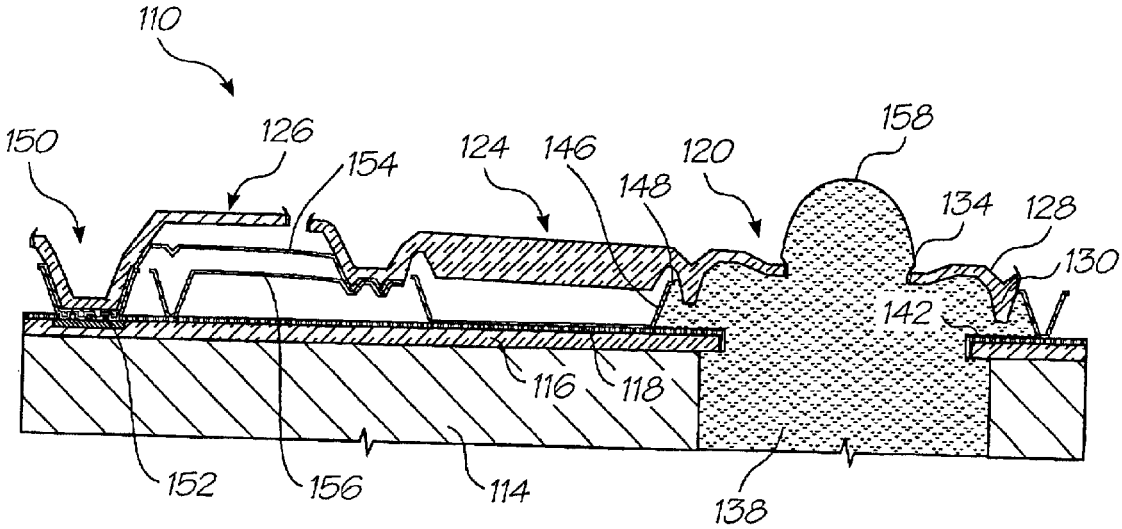
Figure 38C:
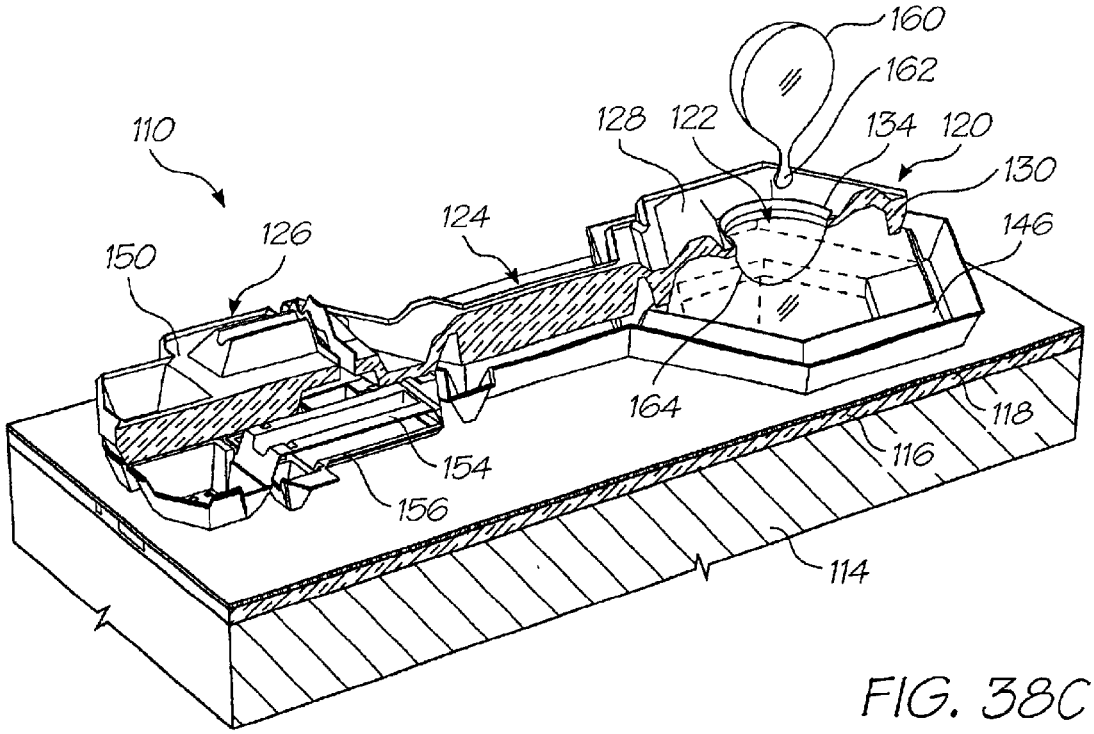
Figure 39C:
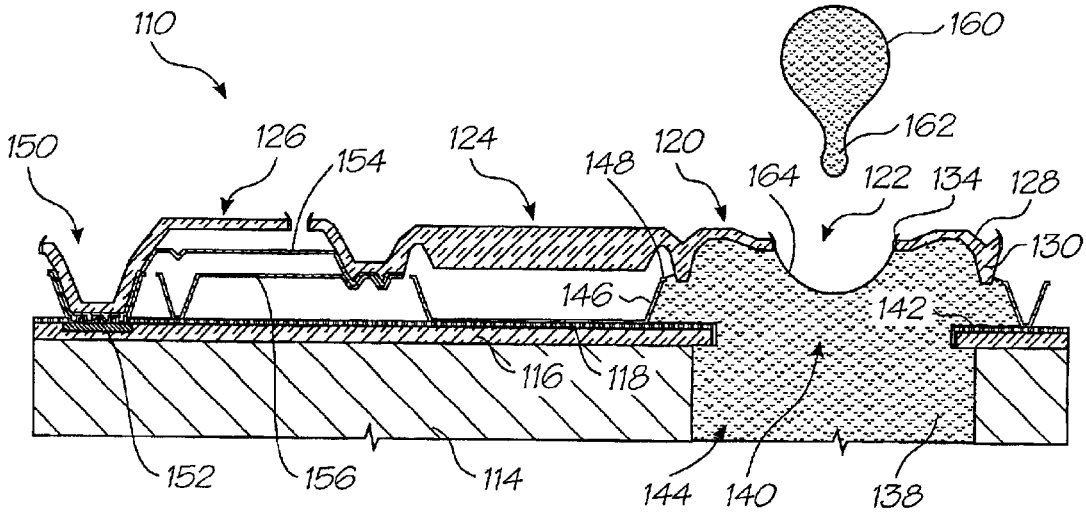

A further UV release tape (not shown) is applied to a rear of the wafer 114 and the tape 224 is removed. The sacrificial layers 192, 196, 204, 212 and 218 are stripped in oxygen plasma to provide the final nozzle assembly 110 as shown in FIGS. 35*r* and 36*r* of the drawings. For ease of reference, the reference numerals illustrated in these two drawings are the same as those in FIG. 28 of the drawings to indicate the relevant parts of the nozzle assembly 110. FIGS. 38 and 39 show the operation of the nozzle assembly 110, manufactured in accordance with the process described above with reference to FIGS. 35 and 36, and these figures correspond to FIGS. 29 to 31 of the drawings.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. A printing assembly that comprises a printing unit including at least one thermally actuated ink jet printhead; and an inert gas supply that is connected to the printing unit to provide components of the printing unit with inert gas during a printing operation.

2. A printing assembly as claimed in claim 1, in which the printing unit has at least one ink jet printhead that incorporates micro-electromechanical components for the ejection of ink.

3. A printing assembly as claimed in claim 2, in which the micro-electromechanical components are thermally actuated.

4. A printing assembly as claimed in claim 3, in which the printing unit includes a printhead assembly that has at least one printhead chip and defines an inert gas inlet, the at least one printhead chip comprising a plurality of nozzle assemblies positioned on a wafer substrate, each nozzle assembly having nozzle chamber walls and a roof wall that define a nozzle chamber and an ink ejection port in fluid communication with the nozzle chamber and a micro-electromechanical actuator that acts on ink within the nozzle chamber to eject ink from the nozzle chamber.

5. A printing assembly as claimed in claim 4, in which a conduit assembly is arranged within the printing unit to provide an inert gas conduit from the inlet to the at least one printhead chip, the conduit assembly being configured so that inert gas pumped into the conduit assembly provides an inert operating environment for the printhead assembly and an inert gas supply device is connected to th printing unit at the inlet to supply the conduit assembly with inert gas.

6. A printing assembly as claimed in claim 5, in which the printing unit includes a number of printhead chips, and a number of corresponding nozzle guards that are positioned over respective printhead chips, each nozzle guard having a cover member and a support structure that supports the cover member over each printhead chip, the cover member defining a plurality of passages, each passage being aligned with a respective ink ejection port so that an ink droplet ejected from each ink ejection port can pass through the passage and onto a print medium, the support structure defining a plurality of openings so that inert gas can pass into a region between each printhead cover and its associated printhead chip and through the passages defined by the printhead cover.

7. A printing assembly as claimed in claim 1, in which the inert gas supply is in the form of a nitrogen supply unit.

8. A printing assembly as claimed in claim 7, in which the nitrogen supply unit is a membrane nitrogen separation unit.

* * * * *